US012575677B2

(12) United States Patent
Prizzi et al.

(10) Patent No.: US 12,575,677 B2
(45) Date of Patent: Mar. 17, 2026

(54) ORGANIZER WALL PANEL ASSEMBLY AND MOUNTING ASSEMBLY

(71) Applicant: 2840629 ONTARIO INC., Woodbridge (CA)

(72) Inventors: Giuseppe Prizzi, Kleinburg (CA); Marcello Venafro, Toronto (CA)

(73) Assignee: 2840629 ONTARIO INC., Woodbridge (CA)

( * ) Notice: Subject to any disclaimer, the term of this patent is extended or adjusted under 35 U.S.C. 154(b) by 0 days.

(21) Appl. No.: 18/570,567

(22) PCT Filed: Jun. 16, 2022

(86) PCT No.: PCT/CA2022/050971
§ 371 (c)(1),
(2) Date: Dec. 14, 2023

(87) PCT Pub. No.: WO2022/261778
PCT Pub. Date: Dec. 22, 2022

(65) Prior Publication Data

US 2024/0423368 A1 Dec. 26, 2024

Related U.S. Application Data

(60) Provisional application No. 63/211,526, filed on Jun. 16, 2021.

(51) Int. Cl.
*A47B 96/20* (2006.01)
*A47F 5/08* (2006.01)
(Continued)

(52) U.S. Cl.
CPC ..... *A47B 96/20* (2013.01); *A47F 5/0815* (2013.01); *A47F 5/0853* (2013.01); *E04F 13/0846* (2013.01); *E04F 13/18* (2013.01)

(58) Field of Classification Search
CPC ..... A47F 5/0853; A47F 5/0846; E04F 13/18; E04F 2203/04; E04F 13/076;
(Continued)

(56) References Cited

U.S. PATENT DOCUMENTS 3,385,182 A * 5/1968 Harvey ..... E01C 9/083 52/579
5,050,362 A * 9/1991 Tal ..... E04D 3/363 52/579
(Continued)

FOREIGN PATENT DOCUMENTS

AU 2022200842 A1 8/2022
AU 2022204872 A1 2/2023
(Continued)

OTHER PUBLICATIONS

International Search Report and Written Opinion issued for PCT/CA2022/050971, dated Sep. 14, 2022.

*Primary Examiner* — Ko H Chan
(74) *Attorney, Agent, or Firm* — SMART & BIGGAR LP; James Raakman; Justin Philpott

(57) ABSTRACT

Disclosed herein is a panel that is configured to be secured to a wall. The panel comprises a first side, defining an outermost surface configured for being visible while the panel is secured to the wall, and a first panel-defined connection system counterpart. The panel is connectible to a second panel, such that connected first and second panels are established. The second panel is configured to be secured to the wall, and comprises a first side, defining an outermost surface configured for being visible while the panel is secured to the wall, and a second panel-defined connection system counterpart. The connection of the first and second panels being effected by snap-fit engagement between the first panel-defined connection system counterpart and the
(Continued)

second panel-defined connection system counterpart; and the snap-fit engagement is audibly discernible.

17 Claims, 58 Drawing Sheets

(51) Int. Cl.
*E04F 13/08* (2006.01)
*E04F 13/18* (2006.01)

(58) Field of Classification Search
CPC ..... E04F 15/02038; E04F 13/0894; E04F 13/0889; E04F 15/10; E04F 2201/0146; E04F 2201/041; E04F 2201/043; E04F 2201/044; E04F 2201/042; E04F 2201/023; E04F 2201/0138; G09F 13/0413; G09F 15/0006; E04C 2/38; E04B 1/54
See application file for complete search history.

(56) References Cited

U.S. PATENT DOCUMENTS 5,819,491 A * 10/1998 Davis ..... E04F 15/02161 52/592.1
6,199,340 B1 * 3/2001 Davis ..... E04F 15/105 52/592.1
7,047,697 B1 * 5/2006 Heath ..... E04F 15/10 52/592.1
7,306,107 B2 12/2007 Secondino
7,520,092 B2 * 4/2009 Showers ..... E04F 17/00 52/579
8,720,140 B2 * 5/2014 Petta ..... E04F 21/1855 52/592.1
8,763,312 B2 * 7/2014 Carter ..... E04F 13/0894 52/36.5
9,200,445 B2 * 12/2015 Leines ..... E04B 5/02
10,017,944 B2 * 7/2018 Boettcher ..... E04D 3/361
11,180,915 B2 * 11/2021 Richardson ..... E04F 13/0833
11,821,204 B2 * 11/2023 Richardson ..... E04F 13/0894
12,369,731 B2 * 7/2025 Secondino ..... A47F 5/0846
2005/0055938 A1 3/2005 Secondino
2006/0207201 A1 * 9/2006 Klimek ..... A47F 5/0846 52/239
2006/0288651 A1 * 12/2006 Zeng ..... E04F 15/02194 52/177
2022/0248873 A1 8/2022 Prizzi et al.
2022/0248874 A1 8/2022 Prizzi et al.
2023/0010434 A1 1/2023 Prizzi et al.
2023/0013603 A1 1/2023 Prizzi

FOREIGN PATENT DOCUMENTS

AU 2022206733 A1 2/2023
CA 3109041 A1 8/2022
CA 3148147 A1 8/2022
CA 3167064 A1 1/2023
CA 3168274 A1 1/2023

* cited by examiner

ORGANIZER WALL PANEL ASSEMBLY AND MOUNTING ASSEMBLY

CROSS-REFERENCE TO RELATED APPLICATION

This Application is a Section 371 National Stage Application of International Application No. PCT/CA2022/050971, filed Jun. 16, 2022 and published as WO2022/261778A1 on Dec. 22, 2022, in English, which claims priority to U.S. provisional patent application Ser. No. 63/211,526, filed Jun. 16, 2021, the contents of which are hereby incorporated by reference in their entirety.

FIELD

The present disclosure relates to a panel of a wall panel assembly, and in particular, a panel that includes one or more cavities for supporting a mounting bracket.

BACKGROUND

To avoid clutter, and to organize objects, such as tools, toys, organizing boxes and bins, equipment, and the like, the objects may be hung from a wall. A mounting bracket may be secured to the wall, and the object may be hung from the mounting bracket, such that the object is hung from the wall via the mounting bracket. The mounting bracket is typically secured to a stud of the wall such that the weight of the object hung from the mounting bracket is supported by the stud rather than the drywall. Accordingly, a relatively heavy object may be hung from the mounting bracket. However, each wall has a limited number of studs, and the bracket are secured to the studs where a user may access with relative ease, which limits the number of mounting brackets that may be secured to the wall.

To increase the number of mounting bracket that may be secured to the wall, a wall panel assembly may first be secured to the wall. Existing wall panel assemblies comprise a plurality of wall panels that are connected together to define the wall panel assembly. The wall panel assembly is typically secured to two adjacent studs, such that the wall panel assembly extends between the adjacent studs. The wall panel assembly defines one or more cavities to retain the mounting bracket, such that the mounting bracket is secured to the wall via the wall panel assembly. The one or more cavities extend along the length of the wall panel assembly, such that a plurality of mounting brackets may be retained by the wall panel assembly.

Unfortunately, existing wall panel assemblies are susceptible to bowing, in response to thermal expansion of the wall panels or while an object is supported by a mounting bracket that is retained to the wall panel assembly. In addition, the mounting bracket may be poorly received in the cavity of the existing wall panel assembly.

Moreover, existing mounting brackets are limited to being retained by one cavity of the wall panel assembly, and are not securable to the wall panel assembly.

SUMMARY

In one aspect, there is provided a panel configured to be secured to a wall, comprising: a first side, defining an outermost surface configured for being visible while the panel is secured to the wall; a first panel-defined connection system counterpart; wherein: the panel is connectible to a second panel, such that connected first and second panels are established; the second panel configured to be secured to the wall, and comprising: a first side, defining an outermost surface configured for being visible while the panel is secured to the wall; a second panel-defined connection system counterpart; and the connection of the first and second panels being effected by snap-fit engagement between the first panel-defined connection system counterpart and the second panel-defined connection system counterpart; and the snap-fit engagement is audibly discernible.

In another aspect, there is provided a method of assembly of a wall panel assembly, the wall panel assembly comprising a first panel and a second panel, the first panel comprising a first panel-defined connection system counterpart, the second panel comprising a second panel-defined connection system counterpart, the method comprising: connecting the first panel and the second panel via the first panel-defined connection system counterpart and the second panel-defined connection system counterpart; wherein: the connecting includes snap-fit engagement between the first panel-defined connection system counterpart and the second panel-defined connection system counterpart, and the snap-fit engagement is audibly discernible.

In another aspect, there is provided a panel configured to be secured to a wall, and defining a first end and second opposite end, comprising: a first side, defining an outermost surface configured for being visible while the panel is secured to the wall; a second side, disposed on an opposite side of the panel relative to the first side, and defining a wall-opposing surface configured for opposing the wall while the panel is secured to the wall; a plurality of ribs, connecting the first side to the second side, and defining: at the first end, a first end-defined space-defining counterpart; and at the second end, a second-end defined space-defining counterpart; at the first end, a first end-defined connection system counterpart; and at the second end, a second end-defined connection system counterpart; wherein: the panel is connectible to a second panel, such that connected first and second panels are established; the second panel configured to be secured to the wall, and defining a first end and second opposite end, and comprising: a first side, defining an outermost surface configured for being visible while the panel is secured to the wall; a second side, disposed on an opposite side of the panel relative to the first side, and defining a wall-opposing surface configured for opposing the wall while the panel is secured to the wall; a plurality of ribs, connecting the first side to the second side, and defining: (i) at the first end, a first end-defined space-defining counterpart; and (ii) at the second end, a second end-defined space-defining counterpart; at the first end, a first end-defined connection system counterpart; and at the second end, a second end-defined connection system counterpart; the connection of the first and second panels being effected by snap-fit engagement between the second end-defined connection system counterpart of the first panel and the first end-defined connection system counterpart of the second panel; the connection being with effect that an internal space is defined between the first end-defined space-defining counterpart and the second end-defined space-defining counterpart; the first and second panels being co-operatively configured such that, while: (i) the first and second panels are connected; (ii) for each one of the first and second panels, independently, the panel is secured to the wall such that displacement of the panel, relative to the wall, is resisted; and (iii) a stress is applied to the connected panels such that relative displacement between the first and second panels is being urged: the internal space receives deformation of at least one of the second end-defined space-defining counterpart of the first panel and the first end-defined space-defining counterpart of the second panel.

In another aspect, there is provided a panel configured to retain a mounting bracket, the mounting bracket including a connector, and defining a cavity for receiving the connector, the panel comprising: a guide surface; and a retaining surface; wherein: the cavity, the guide surface, and the retaining surface are co-operatively configured such that, while the panel is secured to the wall and the bracket connector is being inserted into the cavity, the guide surface engages the connector with effect that the connector is rotated, relative to the panel, such that movement of the bracket connector, within the cavity, is directed, with effect that a retained configuration is established; in the retained configuration: the bracket is vertically supported by the panel; and the retaining surface is opposing displacement of the bracket, relative to the panel, in a direction that is normal to the wall.

In another aspect, there is provided a kit for a wall panel assembly, comprising: a panel, the panel comprising a panel-defined connection system counterpart configuration that includes a panel-defined connection system counterpart; a trim, comprising a trim-defined connection system counterpart configuration that includes a trim-defined connection system counterpart, and further includes an outermost surface configured for being visible while the trim is connected to the panel, the outermost surface including a continuous surface that extends along the length of the trim; wherein: the trim is connectible to the panel, such that connected trim and panel are established; the connection of the trim and the panel being effected by snap-fit engagement between the trim-defined connection system counterpart and the panel-defined connection system counterpart; the connection being with effect that the panel-defined connection system counterpart configuration is concealed by the trim-defined connection system counterpart configuration.

In another aspect, there is provided a kit for a wall panel assembly, comprising: a trim, comprising a trim-defined connection system counterpart configuration that includes a trim-defined connection system counterpart; a panel, the panel comprising a panel-defined connection system counterpart configuration that includes a panel-defined connection system counterpart configuration, and further includes an outermost surface configured for being visible while the trim is connected to the panel, the outermost surface including a continuous surface that extends along the length of the panel; wherein: the trim is connectible to the panel, such that connected trim and panel are established; the connection of the trim and the panel being effected by snap-fit engagement between the trim-defined connection system counterpart and the panel-defined connection system counterpart; the connection being with effect that the trim-defined connection system counterpart configuration is concealed by the panel-defined connection system counterpart configuration.

In another aspect, there is provided a panel configured to be secured to a wall, and defining a first end and a second end that is opposite the first end, comprising: at the first end, a first end-defined connection system counterpart; and at the second end, a second end-defined connection system counterpart; and wherein: the panel is connectible to a second panel, such that connected first and second panels are established; the second panel configured to be secured to the wall, and defining a first end and a second end that is opposite the first end, and comprising: at the first end, a first end-defined connection system counterpart; at the second end, a second end-defined connection system counterpart; and the connection of the first and second panels is effected by snap-fit engagement between the second end-defined connection system counterpart of the first panel and the first end-defined connection system counterpart of the second panel; the first and second panels being co-operatively configured such that, while the first and second panels are connected: the first panel is rotatable, relative to the second panel, wherein the rotation of the first panel, relative to the second panel, is effective for defeating of the connection between the first and second panels.

In another aspect, there is provided a panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, wherein the panel comprises: an interacting portion, extending from the front-facing surface, and comprising: a covering portion; and a first panel-defined connection system counterpart; an interference defeater, defining an urging force receiving surface; wherein: the interacting portion is configurable in an interference-effective configuration; the interacting portion is deformable for effectuating transitioning of the interacting portion from the interference-effective configuration to an interference-ineffective configuration; the panel is configured for defining a first panel which is co-operable with a second panel, the second panel being co-operable with a fastener for effectuating connection of the second panel to a wall with the fastener, wherein the co-operability of the first panel with the second panel is such that: the first panel-defined connection system counterpart, of the first panel, and a second panel-defined connection system counterpart, of the second panel, are configurable for disposition in a relative movement effectible relationship and a relative movement interference relationship, wherein: in the relative movement effectible relationship: the interacting portion is disposed in the interference-ineffective configuration; and there is an absence of interference, to relative movement, between the first panel and the second panel; in the relative movement interference relationship: the interacting portion is disposed in the interference-effective configuration; and interference, to relative movement, between the first panel and the second panel, is established; the interference defeater is disposed, relative to the second panel-defined connection system counterpart, of the second panel, such that the urging force receiving surface is unoccluded by the second panel-defined connection system counterpart; a deformation-urging force is applicable, by a deformation-urging force applicator, to the urging force-receivable surface of the interference defeater, wherein the interacting portion is deformable from the interference-effective configuration, by the deformation-urging force, for effecting transitioning of the interacting portion to the interference-ineffective configuration; and while the first panel-defined connection system counterpart and the second panel-defined connection system counterpart are disposed in the relative movement interference relationship, and the second panel is connected to a wall with a fastener, the covering portion of the first panel is covering the fastener.

In another aspect, there is provided a panel configured to be secured to a wall, wherein the panel comprises: a wall covering portion, comprising: a front-facing wall, defining a front-facing surface; a rear-facing wall, defining a rear-facing surface, wherein the rear-facing surface is disposed, relative to the front-facing surface, on an opposite side of the panel, wherein the securing of the panel to the wall is such that the rear-facing surface is opposing the wall; an intermediate wall, disposed intermediate the front facing wall and the rear facing wall, and extends from the front facing wall, at a joint, the intermediate wall having a width having a minimum value of at least 0.080 inches; wherein the front facing wall includes an interacting portion, having a terminal end, and extending from the joint, and comprising; at the terminal end, a panel-defined first connection system counterpart of a first connection system; a fastener-receiver covering portion; a wall member, disposed rearwardly of the interacting portion; a recess, disposed intermediate the front facing wall and the rear facing wall, and defined by: an inner surface of the interacting portion; an inner surface of the wall member; and the intermediate wall; wherein: the panel is configured for defining a first panel which is connectible with a second panel, the second panel being co-operable with a fastener for effectuating connection of the second panel to a wall with the fastener; the second panel defining a first end and a second end opposite the first end, and comprising: at the second end, comprising: a panel-defined second connection system counterpart of the first connection system; and an insertable projection; the connection of the first and second panels is effected by: snap-fit engagement between the panel-defined first connection system counterpart of a first connection system of the first panel and the panel-defined second connection system counterpart of the first connection system of the second panel; and disposition of the projection of the second panel within the recess of the first panel; while the first and second panels are connected: i) the panel-defined first connection system counterpart of the first connection system, of the first panel; ii) the wall member, of the first panel; iii) the panel-defined second connection system counterpart of the first connection system, of the second panel; and iv) the projection, of the second panel, are configured for disposition in a relative movement interference relationship, wherein, in the relative movement interference relationship: the panel-defined first connection system counterpart and the panel-defined second connection system counterpart of the first connection system are co-operatively configured such that displacement of the first panel, away from to the second panel, in a direction that is perpendicular to a normal axis of the front-facing wall, is resisted; the wall member and the projection are co-operatively configured such that displacement of the first panel, relative to the second panel, in a direction that is parallel to the normal axis of the front-facing surface, is resisted; while: i) the panel-defined first connection system counterpart of the first connection system, of the first panel; ii) the wall member, of the first panel; iii) the panel-defined second connection system counterpart of the first connection system, of the second panel; and iv) the projection, of the second panel, are disposed in the relative movement interference relationship, and the second panel is connected to the wall with the fastener, the covering portion of the first panel is covering the fastener.

In another aspect, there is provided a panel configured to be connected to a wall, comprising: a fastener locator, defined by a panel member for locating placement of a fastener in a fastener effective position, such that: while the panel is disposed in abutting engagement with the wall, and while a fastener is emplaced in the fastening effective position, penetration through the panel, and into the wall, of the fastener, is effective for connecting the panel to the wall; the panel member includes a first side surface and a second side surface that is disposed opposite the first side surface, wherein a thickness of the panel member is defined by the minimum spacing distance between the first side surface and the second side surface; the fastener guide is defined by a groove defined within the first side surface of the panel member; a minimum spacing distance between the groove and the second side surface has a minimum value of at least 90% of the thickness of the panel member.

In another aspect, there is provided a panel, defining a front-facing surface and a rear-facing surface, wherein the rear-facing surface is disposed, relative to the front-facing surface, on an opposite side of the panel, wherein the panel is configured for mounting to a wall such that the rear-facing surface is opposing the wall, the panel comprising: a projection and a residual panel portion, the residual panel portion defining the front facing surface and the rear facing surface, wherein the projection is connected to the residual panel portion about a first joint and a second joint; a wall member, extending between the first joint and the second joint; a first panel-defined connection system counterpart; wherein: the projection is configurable in a relative movement-effective configuration; the panel is configured for defining a first panel which is co-operable with a second panel, the second panel comprising: a second panel-defined interacting portion, comprising: a second panel-defined connection system counterpart; wherein: the second panel-defined interacting portion is configurable in a pre-deformation configuration; the second panel-defined interacting portion is deformable for effecting transitioning of the second panel-defined interacting portion from the pre-deformation configuration to an interference-ineffective configuration, wherein the transitioning of the second panel-defined interacting portion from the pre-deformation configuration to the interference-ineffective configuration includes a forwardly displacement of the second panel-defined connection system counterpart; wherein the co-operability of the first panel with the second panel is such that: the connection of the first and second panels is effected by snap-fit engagement between the first panel-defined connection system counterpart of the first panel and the second panel-defined connection system counterpart of the second panel; the projection and the second panel-defined interacting portion are configurable for disposition in a relative movement effectible relationship, wherein: in the relative movement effectible relationship: the projection is disposed in the relative movement-effective configuration; the second panel-defined interacting portion is disposed in the interference-ineffective configuration; and the second panel is displaceable towards the first panel, such that the second panel-defined connection system counterpart is displaceable, past the projection and towards the first panel-defined connection system counterpart, to effect the snap fit connection between the first panel-defined connection system counterpart and the second panel-defined connection system counterpart; while: (i) the projection is disposed in the relative movement-effective configuration, (ii) the second panel-defined interacting portion is disposed in the pre-deformation configuration, and (iii) the projection and the second panel-defined interacting portion are disposed in contact engagement: in response to displacement of the second panel towards the first panel, a force is applied, by the second panel-defined interacting portion, to the projection, with effect that the deformation of the projection, is urged; the first joint, the second joint, and the wall member are co-operatively configured such that deformation of the projection, to a connection prevention configuration, wherein, in the connection prevention configuration, the projection is preventing the displacement of the second panel-defined connection system counterpart of the second panel past the projection for effectuating the snap fit engagement of the first panel defined connection system counterpart of the first panel and the second panel-defined connection system counterpart of the second panel, is resisted, such that, in response to the force, applied by the second panel-defined interacting portion, to the projection, a reaction force is applied by the projection to the second-panel defined interacting portion, with effect that the second panel-defined interacting portion is deformed, such that that: the second panel-defined interacting portion is transitioned from the pre-deformation configuration to the interference-ineffective configuration; and the projection and the second panel-defined interacting portion become disposed in the relative movement effectible relationship; in response to further displacement of the second panel to towards the first panel, the second panel-defined connection system counterpart is displaced, past the projection and towards the first panel-defined connection system counterpart, with effect that the snap fit connection between the first panel-defined connection system counterpart and the second panel-defined connection system counterpart is established.

In another aspect, there is provided a panel configured to retain a mounting bracket, the mounting bracket including a bracket connector, the panel comprising: a bracket receiving cavity for receiving the bracket connector; a retaining surface-defining configuration, defining a retaining surface; a rearwall configuration, disposed in force transmission communication with the retaining surface defining configuration, and includes a first wall disposed forwardly of a second wall, wherein: the first wall includes an outer surface; the second wall includes an outer surface; the cavity is defined by a cavity-defining surface, the cavity-defining surface including the outer surface of the first wall; the cavity and the retaining surface are co-operatively configured such that, while the panel is secured to a mounting wall: 1) an outer surface of the second wall is disposed in opposing relationship to the mounting wall, and 2) insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from the mounting wall; while the retained configuration is established: in response to mounting of a load to the bracket, a displacement-urging force is applied by the bracket connector to the retaining surface, with effect that bending of the rear wall configuration is urged; the bending of the rear wall configuration is resisted; wherein: an internal cavity is defined between the first wall and the second wall of the rear wall configuration; the internal cavity includes an intermediate narrow portion disposed between a first wider end portion and a second wider end portion.

In another aspect, there is provided a panel configured to retain a mounting bracket, the mounting bracket including a bracket connector, the panel comprising: a bracket receiving cavity for receiving the bracket connector; a front-facing wall, defining a front-facing surface; a rear-facing wall, defining a rear-facing surface, wherein the rear-facing surface is disposed, relative to the front-facing surface, on an opposite side of the panel; a retaining surface-defining configuration, defining a retaining surface; a rear wall configuration, disposed in force transmission configuration with the retaining surface defining configuration, and comprising: a wall; a wall member, extending rearwardly from the front-facing wall to the wall of the rear wall configuration, the wall member including a wall portion having an arcuate wall surface having a radius of curvature having a minimum value of at least 1/16 inches; the cavity is defined by a cavity-defining surface, the cavity-defining surface including the arcuate wall surface of the wall member; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from the mounting wall; while the retained configuration is established: in response to mounting of a load to the bracket, a displacement-urging force is applied by the bracket connector to the retaining surface, with effect that rotation of a rotation-urgable portion of the panel, relative to the rear facing wall, is urged; the rotation of the rotation-urgable portion of the panel, relative to the rear facing wall, is resisted by the wall portion of the wall member.

In another aspect, there is provided a panel configured to retain a mounting bracket, the mounting bracket including a bracket connector, the panel comprising: a bracket receiving cavity for receiving the bracket connector; a retaining surface-defining configuration, defining a retaining surface; a rear wall configuration, disposed in force transmission communication with the retaining surface-defining configuration, the rear wall configuration comprising: a first wall, defining an outer surface; a second wall, disposed rearwardly of the first wall; wherein the first wall and the second wall are disposed in a non-parallel relationship; the cavity is defined by a cavity-defining surface, the cavity-defining surface including the outer surface of the first wall; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from the mounting wall; while the retained configuration is established: in response to mounting of a load to the bracket, a displacement-urging force is applied by the bracket connector to the retaining surface, with effect that displacement of the retaining surface-defining configuration, in the direction away from the mounting wall, is urged; the first wall and the second wall of the rear wall configuration are co-operatively configured such that the displacement of the retaining surface-defining configuration, in the direction away from the mounting wall, is resisted.

In another aspect, there is provided a panel configured to retain a mounting bracket, the mounting bracket including a bracket connector, the panel comprising: a bracket receiving cavity, for receiving the bracket connector; a retaining surface-defining configuration, including a retaining surface-defining wall that defines a retaining surface; a rear wall configuration, disposed in force transmission communication with the retaining surface defining configuration, the rear wall configuration comprising: a wall; a wall member, connecting the retaining surface-defining wall of the retaining surface defining configuration and the wall of the rear wall configuration, the wall member including a wall portion including an arcuate wall surface; the cavity is defined by a cavity defining surface, the cavity defining surface including the arcuate wall surface of the wall portion; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from to the mounting wall; while the retained configuration is established: in response to mounting of a load to the bracket, a displacement-urging force is applied by the bracket connector to the retaining surface, with effect that displacement of the retaining surface-defining configuration, in the direction away from the mounting wall, is urged; the displacement of the retaining surface-defining configuration, away from the mounting wall, is resisted, by the wall portion.

In another aspect, there is provided a panel configured to retain a mounting bracket, the mounting bracket including a bracket connector, the panel comprising: a plurality of bracket receiving cavities, wherein each one of the plurality of bracket receiving cavities, independently, is for receiving the bracket connector; for each one of the plurality of bracket receiving cavities, independently, the panel comprises: a front-facing wall portion, defining a front-facing surface; a rear-facing wall portion, defining a rear-facing surface, wherein the rear-facing surface is disposed, relative to the front-facing surface, on an opposite side of the panel; a retaining surface-defining configuration, defining a retaining surface; a rear wall configuration, disposed in force transmission configuration with the retaining surface defining configuration, and comprising: a wall; a wall member, extending rearwardly from the front-facing wall portion to the wall of the rear wall configuration, the wall member including a wall portion having an arcuate wall surface having a radius of curvature having a minimum value of at least 1/16 inches; the cavity is defined by a cavity-defining surface, the cavity-defining surface including the arcuate wall surface of the wall member; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from the mounting wall; while the retained configuration is established: in response to mounting of a load to the bracket, a rotation-urging force is applied by the bracket connector to the retaining surface, with effect that rotation of a rotation-urgable portion of the panel, relative to the rear facing wall, is urged; the rotation of the rotation-urgable portion of the panel, relative to the rear facing wall, is resisted by the wall portion of the wall member.

In another aspect, there is provided a panel configured to retain a mounting bracket, the mounting bracket including a bracket connector, the panel comprising: a plurality of bracket receiving cavities, wherein each one of the plurality of bracket receiving cavities, independently, is for receiving the bracket connector; for each one of the plurality of bracket receiving cavities, independently, the panel comprises: a retaining surface-defining configuration, defining a retaining surface; a rear wall configuration, disposed in force transmission communication with the retaining surface-defining configuration, the rear wall configuration comprising: a first wall, defining an outer surface; a second wall, disposed rearwardly of the first wall; wherein the first wall and the second wall are disposed in a non-parallel relationship; the cavity is defined by a cavity-defining surface, the cavity-defining surface including the outer surface of the first wall; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from the mounting wall; while the retained configuration is established: in response to mounting of a load to the bracket, a displacement-urging force is applied by the bracket connector to the retaining surface, with effect that displacement of the retaining surface-defining configuration, in the direction away from the mounting wall, is urged; the first wall and the second wall of the rear wall configuration are co-operatively configured such that the displacement of the retaining surface-defining configuration, in the direction away from the mounting wall, is resisted.

In another aspect, there is provided a panel configured to retain a mounting bracket, the mounting bracket including a bracket connector, the panel comprising: a plurality of bracket receiving cavities, wherein each one of the plurality of bracket receiving cavities, independently, is for receiving the bracket connector; for each one of the plurality of bracket receiving cavities, independently, the panel comprises: a retaining surface-defining configuration, including a retaining surface-defining wall that defines a retaining surface; a rear wall configuration, disposed in force transmission communication with the retaining surface defining configuration, the rear wall configuration comprising: a wall; a wall member, connecting the retaining surface-defining wall of the retaining surface defining configuration and the wall of the rear wall configuration, the wall member including a wall portion including an arcuate wall surface; the cavity is defined by a cavity defining surface, the cavity defining surface including the arcuate wall surface of the wall portion; the cavity and the retaining surface are co-operatively configured such that, while the panel is secured to a mounting wall, insertion of the bracket connector into the cavity is with effect that the bracket connector is rotated, relative to the panel, with effect that a retained configuration is established, wherein, in the retained configuration: the bracket is vertically supported by the panel, and the retaining surface is opposing displacement of the bracket, relative to the panel, in a direction away from to the mounting wall; while the retained configuration is established: in response to mounting of a load to the bracket, a displacement-urging force is applied by the bracket connector to the retaining surface, with effect that displacement of the retaining surface-defining configuration, in the direction away from the mounting wall, is urged; the displacement of the retaining surface-defining configuration, in the direction away from the mounting wall, is resisted, by the wall portion.

In another aspect, there is provided a panel configured to retain a mounting bracket, the mounting bracket including a bracket connector, the panel comprising: a plurality of bracket receiving cavities, wherein each one of the plurality of bracket receiving cavities, independently, is for receiving the bracket connector; for each one of the plurality of bracket receiving cavities, independently, the panel comprises: a guide surface; a retaining surface; wherein: the cavity, the guide surface, and the retaining surface are co-operatively configured such that, while the panel is secured to the wall and the bracket connector is being inserted into the cavity, the guide surface engages the connector with effect that the connector is rotated, relative to the panel, such that movement of the bracket connector, within the cavity, is directed, with effect that a retained configuration is established; in the retained configuration: the bracket is vertically supported by the panel; and the retaining surface is opposing displacement of the bracket, relative to the panel, in a direction that is normal to the wall.

In another aspect, there is provided a bracket assembly configured to be connected to a first wall surface configuration having a first pair of panel-defined connection counterparts spaced apart by a first spacing distance, and further configured to be connected to a second wall surface configuration having a second pair of panel-defined connection counterparts spaced apart by a second spacing distance, the bracket assembly comprising: a first connection counterpart; a second connection counterpart; wherein: the bracket assembly is configurable in a fixed configuration and an adjustable configuration; in the fixed configuration, there is an absence of adjustability of the spacing between the first and second connection counterparts; in the adjustable configuration, spacing between the first and second connection counterparts is adjustable between at least a first spacing and a second spacing, wherein: in the first spacing, the first and second bracket connection counterparts are disposed for connection to the first pair of panel-defined connection counterparts; in the second spacing, the first and second bracket connection counterparts are disposed for connection to the second pair of panel-defined connection counterparts.

In another aspect, there is provided a mounting assembly configured to be connected to a first wall surface configuration having a first pair of panel-defined connection counterparts spaced apart by a first spacing distance, and further configured to be connected to a second wall surface configuration having a second pair of panel-defined connection counterparts spaced apart by a second spacing distance, the mounting assembly comprising: a bracket, defining a first connection counterpart; a connection counterpart-defining configuration, releasably coupled to the bracket, and defining a second connection counterpart; wherein: the mounting assembly is configurable in a fixed configuration and an adjustable configuration; in the fixed configuration, the releasably coupling between the bracket and the connection counterpart-defining configuration is such that there is an absence of displaceability of the connection counterpart-defining configuration, relative to the bracket, such that there is an absence of adjustability of the spacing between the first and second connection counterparts; in the adjustable configuration, the releasably coupling between the bracket and the connection counterpart-defining configuration is such that the connection counterpart-defining configuration is displaceable, relative to the bracket, such that spacing between the first and second connection counterparts is adjustable between at least a first spacing and a second spacing, wherein: in the first spacing, the first and second connection counterparts are disposed for connection to the first pair of panel-defined connection counterparts; in the second spacing, the first and second connection counterparts are disposed for connection to the second pair of panel-defined connection counterparts.

In another aspect, there is provided a kit for a mounting assembly configured to be connected to a first wall surface configuration having a first pair of panel-defined connection counterparts spaced apart by a first spacing distance, and further configured to be connected to a second wall surface configuration having a second pair of panel-defined connection counterparts spaced apart by a second spacing distance, the kit comprising: a bracket, defining a first connection counterpart; a connection counterpart-defining configuration, releasably couplable to the bracket, and defining a second connection counterpart; wherein, while the bracket and the connection counterpart-defining configuration are releasably coupled: the mounting assembly is defined, the mounting assembly is configurable in a fixed configuration and an adjustable configuration; in the fixed configuration, the releasably coupling between the bracket and the connection counterpart-defining configuration is such that there is an absence of displaceability of the connection counterpart-defining configuration, relative to the bracket, such that there is an absence of adjustability of the spacing between the first and second connection counterparts; in the adjustable configuration, the releasably coupling between the bracket and the connection counterpart-defining configuration is such that the connection counterpart-defining configuration is displaceable, relative to the bracket, such that spacing between the first and second connection counterparts is adjustable between at least a first spacing and a second spacing, wherein: in the first spacing, the first and second connection counterparts are disposed for connection to the first pair of panel-defined connection counterparts; in the second spacing, the first and second connection counterparts are disposed for connection to the second pair of panel-defined connection counterparts.

In another aspect, there is provided a bracket, comprising: a first connection counterpart; the bracket is releasably couplable to a connection counterpart-defining configuration, the connection counterpart-defining configuration defining a second connection counterpart; wherein: while the bracket and the connection counterpart-defining configuration are releasably coupled: a mounting assembly is defined, the mounting assembly configurable in a fixed configuration and an adjustable configuration; in the fixed configuration, the releasably coupling between the bracket and the connection counterpart-defining configuration is such that there is an absence of displaceability of the connection counterpart-defining configuration, relative to the bracket, such that there is an absence of adjustability of the spacing between the first and second connection counterparts; in the adjustable configuration, the releasably coupling between the bracket and the connection counterpart-defining configuration is such that the connection counterpart-defining configuration is displaceable, relative to the bracket, such that spacing between the first and second connection counterparts is adjustable between at least a first spacing and a second spacing, wherein: in the first spacing, the first and second connection counterparts are disposed for connection to a first wall surface configuration having a first pair of panel-defined connection counterparts spaced apart by a first spacing distance; in the second spacing, the first and second connection counterparts are disposed for connection to a second wall surface configuration having a second pair of panel-defined connection counterparts spaced apart by a second spacing distance.

In another aspect, there is provided a bracket, comprising: a first connection counterpart; the bracket is releasably couplable to a first connection counterpart-defining configuration, the first connection counterpart-defining configuration defining a second connection counterpart; wherein: while the bracket and the first connection counterpart-defining configuration are releasably coupled: a first mounting assembly is defined, the first mounting assembly configurable in a fixed configuration and an adjustable configuration; in the fixed configuration, the releasably coupling between the bracket and the first connection counterpart-defining configuration is such that there is an absence of displaceability of the first connection counterpart-defining configuration, relative to the bracket, such that there is an absence of adjustability of the spacing between the first and second connection counterparts; in the adjustable configuration, the releasably coupling between the bracket and the first connection counterpart-defining configuration is such that the first connection counterpart-defining configuration is displaceable, relative to the bracket, such that spacing between the first and second connection counterparts is adjustable between at least a first spacing and a second spacing, wherein: in the first spacing, the first and second connection counterparts are disposed for connection to a first wall surface configuration having a first pair of panel-defined connection counterparts spaced apart by a first spacing distance; in the second spacing, the first and second connection counterparts are disposed for connection to a second wall surface configuration having a second pair of panel-defined connection counterparts spaced apart by a second spacing distance; the bracket is further releasably couplable to a second connection counterpart-defining configuration, the second connection counterpart-defining configuration defining a third connection counterpart; wherein: while the bracket and the second connection counterpart-defining configuration are releasably coupled: a second mounting assembly is defined, the second mounting assembly configurable in a fixed configuration and an adjustable configuration; in the fixed configuration, the releasably coupling between the bracket and the second connection counterpart-defining configuration is such that there is an absence of displaceability of the second connection counterpart-defining configuration, relative to the bracket, such that there is an absence of adjustability of the spacing between the first and third connection counterparts; in the adjustable configuration, the releasably coupling between the bracket and the second connection counterpart-defining configuration is such that the second connection counterpart-defining configuration is displaceable, relative to the bracket, such that spacing between the first and third connection counterparts is adjustable between at least a third spacing and a fourth spacing, wherein: in the third spacing, the first and third connection counterparts are disposed for connection to a third wall surface configuration having a third pair of panel-defined connection counterparts spaced apart by a third spacing distance; in the fourth spacing, the first and third connection counterparts are disposed for connection to a fourth wall surface configuration having a fourth pair of panel-defined connection counterparts spaced apart by a fourth spacing distance.

In another aspect, there is provided a kit for a mounting assembly configured to be connected to: 1) a first wall surface configuration having a first pair of panel-defined connection counterparts spaced apart by a first spacing distance, 2) a second wall surface configuration having a second pair of panel-defined connection counterparts spaced apart by a second spacing distance, 3) a third wall surface configuration having a third pair of panel-defined connection counterparts spaced apart by a third spacing distance, and 4) a fourth wall surface configuration having a fourth pair of panel-defined connection counterparts spaced apart by a fourth spacing distance, the kit comprising: a bracket, defining a first connection counterpart; a first connection counterpart-defining configuration, the first connection counterpart-defining configuration defining a second connection counterpart; a second connection counterpart-defining configuration, the first connection counterpart-defining configuration defining a third connection counterpart; wherein: the bracket and the first connection counterpart-configuration are releasably couplable, such that, while the bracket and the first connection counterpart-defining configuration are releasably coupled: a first mounting assembly is defined, the first mounting assembly configurable in a fixed configuration and an adjustable configuration; in the fixed configuration, the releasably coupling between the bracket and the first connection counterpart-defining configuration is such that there is an absence of displaceability of the first connection counterpart-defining configuration, relative to the bracket, such that there is an absence of adjustability of the spacing between the first and second connection counterparts; in the adjustable configuration, the releasably coupling between the bracket and the first connection counterpart-defining configuration is such that the first connection counterpart-defining configuration is displaceable, relative to the bracket, such that spacing between the first and second connection counterparts is adjustable between at least a first spacing and a second spacing, wherein: in the first spacing, the first and second connection counterparts are disposed for connection to the first pair of panel-defined connection counterparts; in the second spacing, the first and second connection counterparts are disposed for connection to the second pair of panel-defined connection counterparts; the bracket and the second connection counterpart-configuration are releasably couplable, such that, while the bracket and the second connection counterpart-defining configuration are releasably coupled: a second mounting assembly is defined, the second mounting assembly configurable in a fixed configuration and an adjustable configuration; in the fixed configuration, the releasably coupling between the bracket and the second connection counterpart-defining configuration is such that there is an absence of displaceability of the second connection counterpart-defining configuration, relative to the bracket, such that there is an absence of adjustability of the spacing between the first and third connection counterparts; in the adjustable configuration, the releasably coupling between the bracket and the second connection counterpart-defining configuration is such that the second connection counterpart-defining configuration is displaceable, relative to the bracket, such that spacing between the first and third connection counterparts is adjustable between at least a third spacing and a fourth spacing, wherein: in the third spacing, the first and third connection counterparts are disposed for connection to the third pair of panel-defined connection counterparts; in the fourth spacing, the first and third connection counterparts are disposed for connection to the fourth pair of panel-defined connection counterparts.

Other aspects will be apparent from the description and drawings provided herein.

BRIEF DESCRIPTION OF DRAWINGS

In the figures, which illustrate example embodiments.

DETAILED DESCRIPTION

Figure 1:
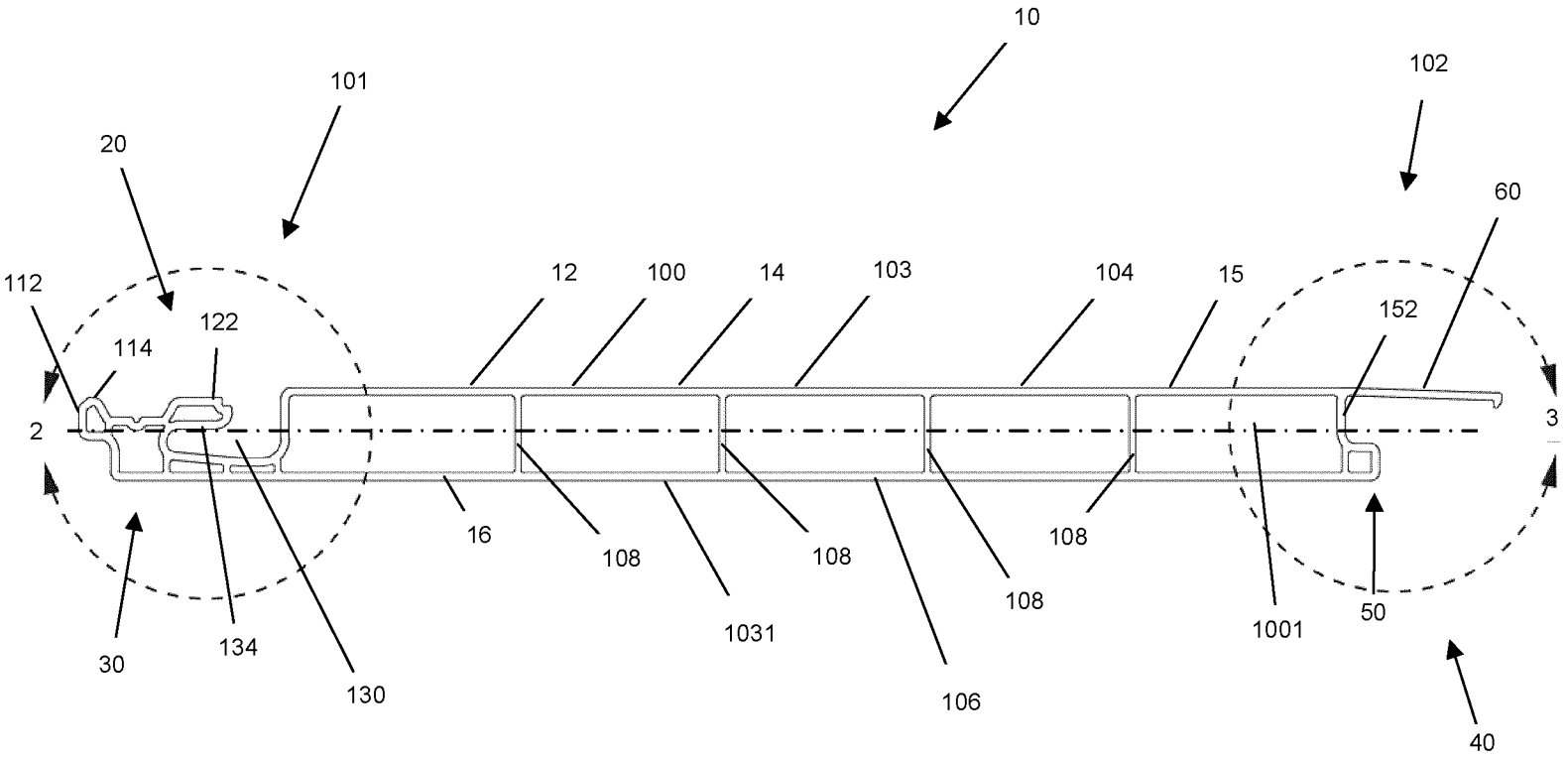
FIG. 1 is a cross-sectional view of an example embodiment of a panel.
Figure 4:
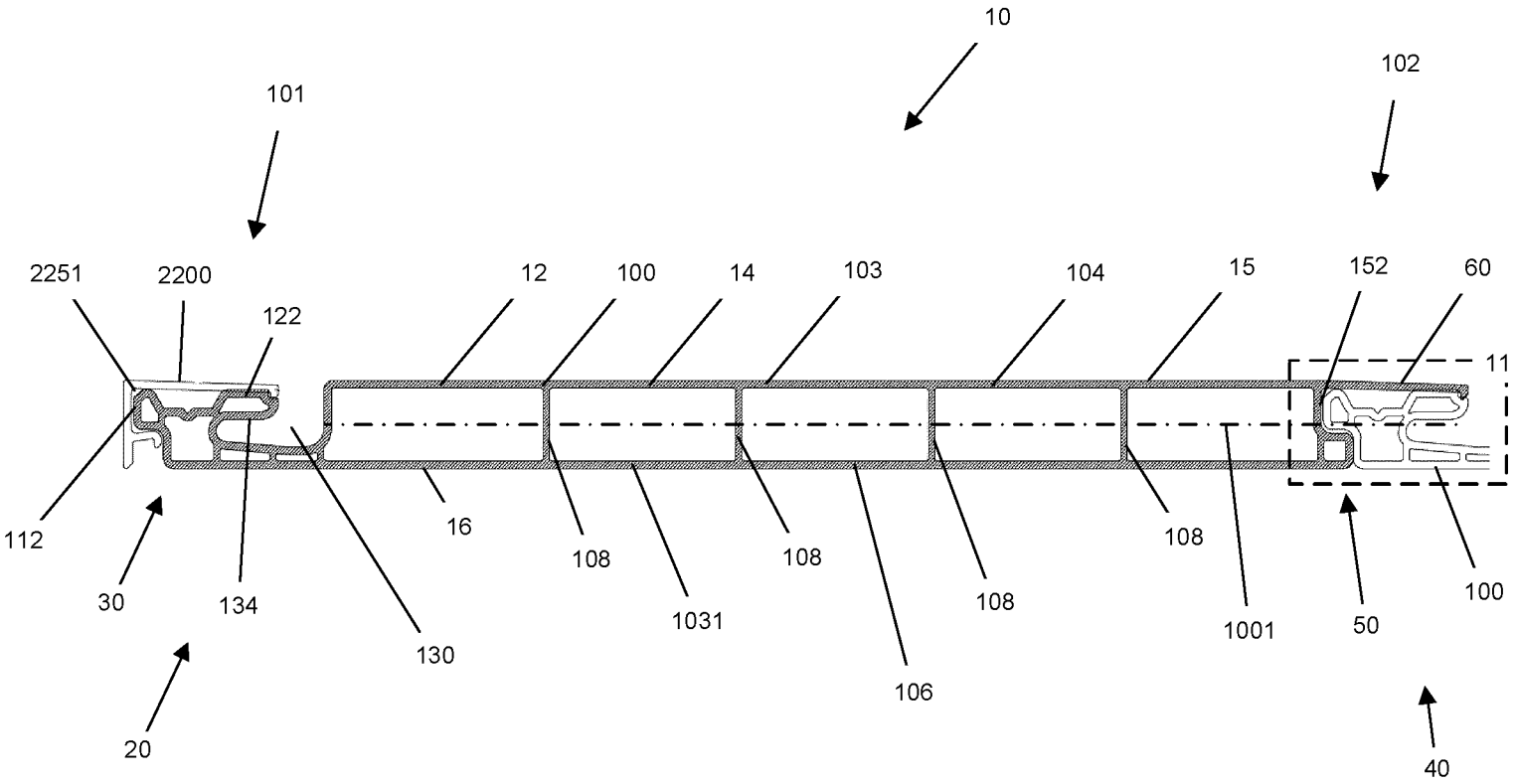
FIG. 4 is a cross-sectional view of a wall panel assembly including the panel of FIG. 1.
Figure 13:
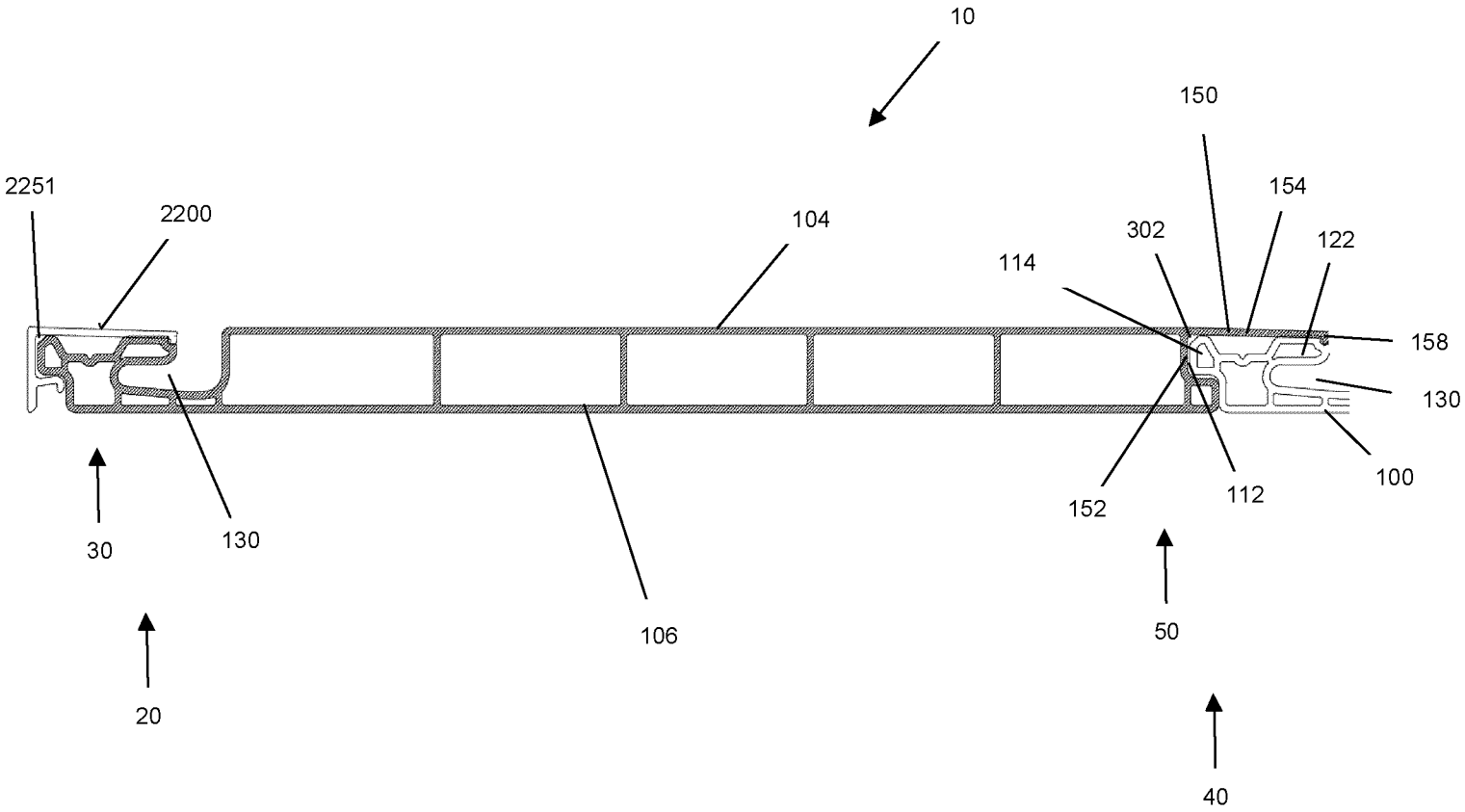
FIG. 13 is a cross-sectional view of the wall panel assembly of FIG. 4.
Figure 37:
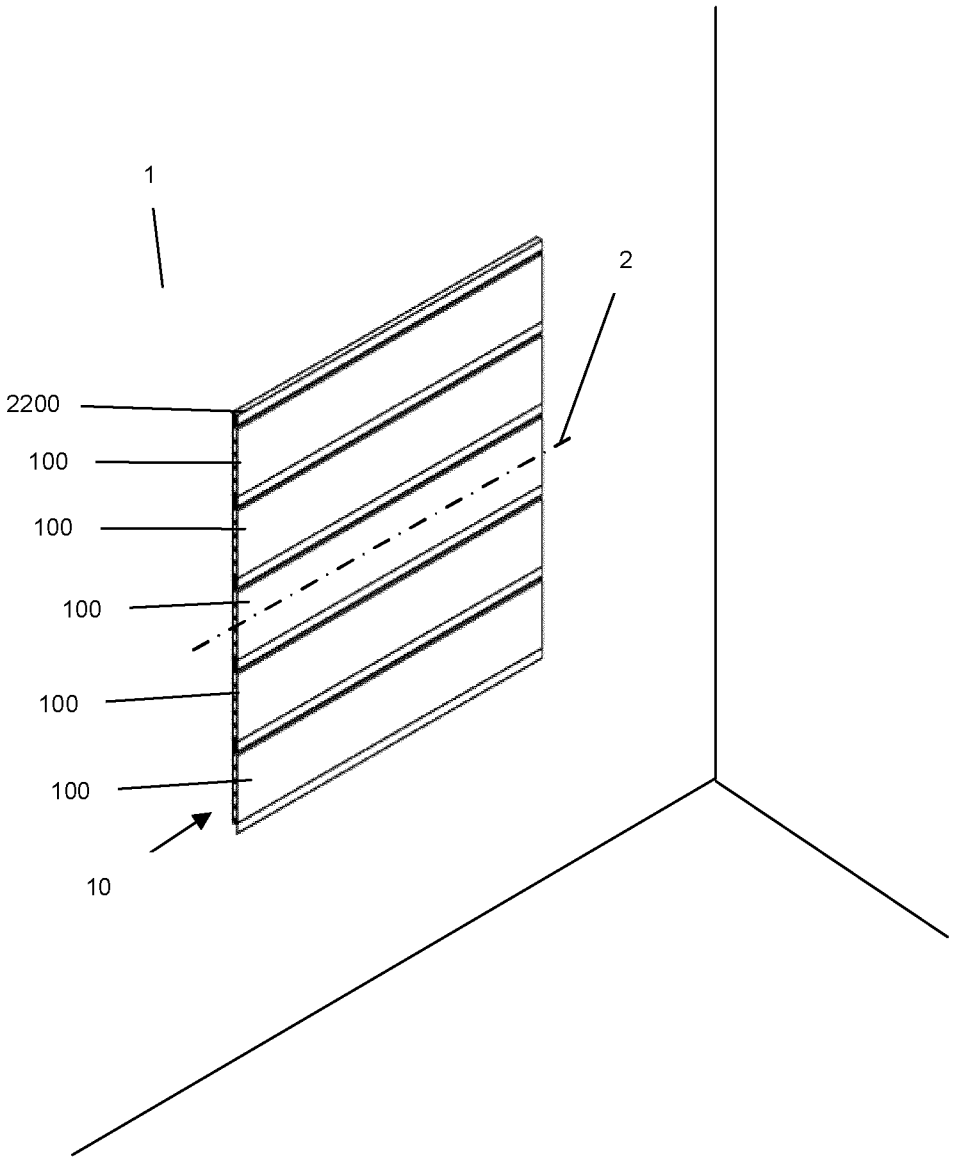
FIG. 37 is a perspective view of a wall panel assembly connected to a wall.
Figure 38:
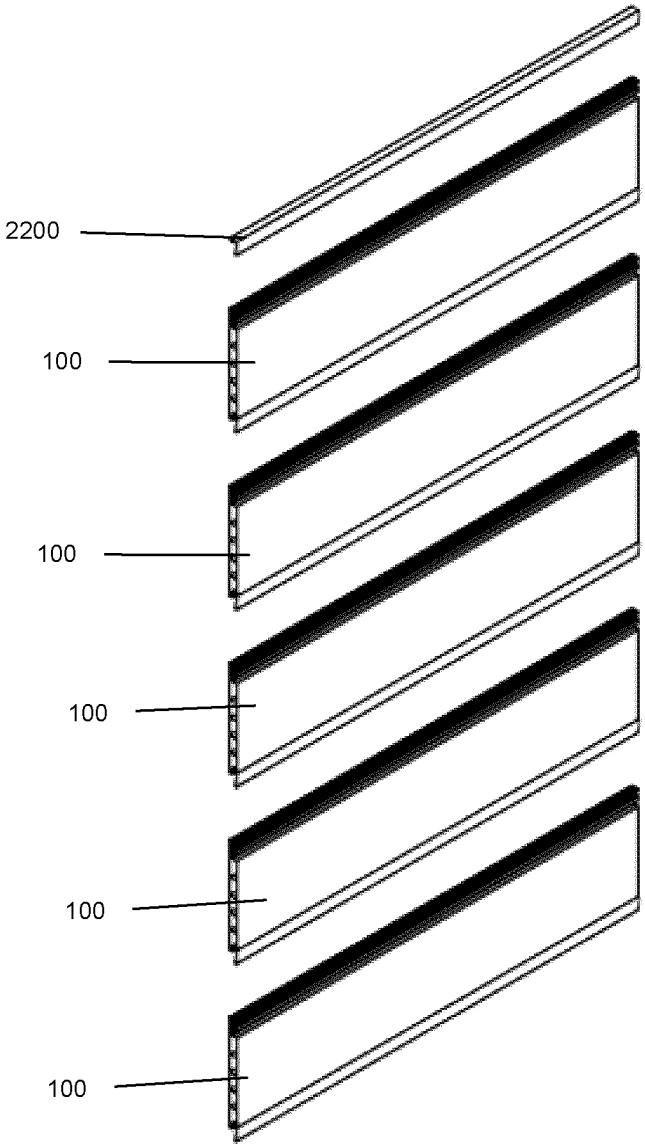
FIG. 38 is an exploded view of the wall panel assembly of FIG. 37.

FIG. 1 depicts an embodiment of a panel 100. FIG. 4 and FIG. 13 depict a wall panel assembly 10, including a first panel 100 and a second panel 100 that are connected together. As depicted, the wall panel assembly 10 is established by the connection of the wall panels such that the wall panels are disposed in adjacent relationship. In some embodiments, for example, each one of the panels 100 of the panel assembly 10 is identical. In some embodiments, for example, at least one of the plurality of panels 100 of the panel assembly 10 is different from the other panels 100 of the assembly 10. It is understood that the wall panel assembly 10 can include more than two panels 100, connected together and disposed in adjacent relationship. Each one of the panels 100, independently, is configured to be secured to a mounting wall 1 (e.g. a wall of a building structure). FIG. 37 depicts the wall panel assembly 10 connected to a wall 1, such that the panels 100 are disposed in a vertical series. FIG. 38 is an exploded view of the wall panel assembly 10 of FIG. 37. In some embodiments, for example, the wall panel assembly 10 further includes one or more trims, for example, a trim 2200 connected to the uppermost one of the panels 100 of the assembly 10, or a trim 2300 connected to the lowermost one of the panels 100 of the assembly 10. As depicted in FIG. 4, a panel 100 is connected to another panel 100, and the panel 100 is also connected to the trim 2200.

As depicted in FIG. 1, the panel 100 defines a central longitudinal axis 1001. The panel 100 further defines a first end 101, a second end 102 that is opposite the first end 101, a first side 103, and a second side 1031 disposed on an opposite side of the panel relative to the first side 103.

The first side 103 of the panel 100 includes a front facing wall 14 that defines a front facing surface 104 configured for being visible while the panel 100 is secured to the wall 1. In some embodiments, for example, the visible surface of the panel 10 is defined by a planar continuous surface having a minimum surface area of at least 3 inches squared. In some embodiments, for example, the minimum width of the outermost surface 104, measured along the axis 1001, is at least 1 inch. In some embodiments, for example, the minimum length of the outermost surface 104, measured along the axis 2, as depicted in FIG. 37, is at least 3 inches. In some embodiments, for example, the axis 2 is parallel to an axis of extrusion of the panel 100. The second side 1031 of the panel 100 includes a rear facing wall 16 that defines a rear-facing surface or wall-opposing surface 106 that is configured for opposing the wall while the panel 100 is secured to the wall. In some embodiments, for example, the panel 100 includes a wall covering portion 12, wherein, while the panel 100 is secured to the wall 1, the wall covering portion covers a portion of the wall 1, such that the covered portion of the wall 1 is occluded from view. In some embodiments, for example, the wall covering portion of the panel 100 includes the front facing wall 14 and the rear facing wall 16.

In some embodiments, for example, the panel 100 further comprises a plurality of ribs 108 that connect the first side 103 and the second side 1031. In some embodiments, for example, the ribs 108 are configured to support a load that is supported by the panel 100 (e.g. the load that is mounted to a mounting assembly 500 that is retained to the panel 100). In some embodiments, for example, the ribs 108 are configured such that the load supported by the panel 100 is distributed about the panel 100

In some embodiments, for example, the panel 100 is connectible to another panel 100, such that connected first and second panels are established, for example, to define a wall panel assembly 10. Similar to the panel 100, the second panel 100 is configured to be secured to the wall, and defines a wall covering portion 12, a first end 101, a second opposite end 102, a first side 103, and a second opposite side 1031. The first side 103 includes a front facing wall 14 that defines an outermost surface 104 configured for being visible while the panel 100 is secured to the wall, and the second side 1031 includes a rear facing wall 16 that defines a wall-opposing surface 106 configured for opposing the wall while the panel 100 is secured to the wall.

In some embodiments, for example, the panel 100 defines, at the first end 101, a panel-defined configuration 20, which includes a first connection system counterpart configuration 30, and, at the second end 102, a panel-defined configuration 40, which includes a second connection system counterpart configuration 50. Similarly, the second panel 100 defines, at the first end 101, a panel-defined configuration 20, which includes a first connection system counterpart configuration 30, and, at the second end 102, a panel-defined configuration 40, which includes a second connection system counterpart configuration 50. The connection of the first panel 100 and the second panel 100 is effected by interaction of one of the first connection system counterpart configuration 30 and the second connection system counterpart configuration 50, of the first panel 100, and the other of the first connection system counterpart configuration 30 and the second connection system counterpart configuration 50, of the second panel 100.

The connection of a first panel 100 and a second panel 100 is effected between the first connection system counterpart configuration 30 of one of the first and second panels and the second connection system counterpart configuration 50 of the other one of the first and second panels. In some embodiments, for example, one of the first connection system counterpart configuration 30 and the second connection system counterpart 50 (in the illustrated embodiment, this is the first connection system counterpart configuration 30) is a male connection system counterpart configuration, and the other one of the first connection system counterpart configuration 30 and the second connection system counterpart configuration 50 (in the illustrated embodiment, this is the second connection system counterpart configuration 50) is a female connection system counterpart configuration, such that the connection of the first and second panels 100 is effectuated by connection the male connection system counterpart configuration, of one of the first and second panels 100, and the female connection system counterpart configuration of the other one of the first and second panels 100. In some embodiments, for example, the connection includes a snap fit connection. In some embodiments, for example, the connection includes an interference fit connection. In some embodiments, for example, the connection includes a friction fit connection.

In some embodiments, for example, the fastener-receiving portion 116 is configured to receive one or more mechanical fasteners, for example, screws, bolts, pins, and the like, to connect the panel 100 to a wall 1. The fastener-receiving portion 116 includes a fastener-engaging surface 118. The fastener-engaging surface 118 is configured to engage with a head of a fastener, and further configured to resist further displacement of the fastener through the panel 100 while the fastener-engaging surface 118 is engaged to the head of the fastener. In some embodiments, for example, the connection of the panel 100 to the wall 1 is effectuated by penetration of the fastener-receiving portion 116 with the mechanical fastener such that the mechanical fastener extends through the fastener-receiving portion 116 and into the wall 1, and the head of the mechanical fastener is bearing against the fastener-engaging surface 118, urging the panel 100 into contact engagement with the wall 1.

Figure 2:
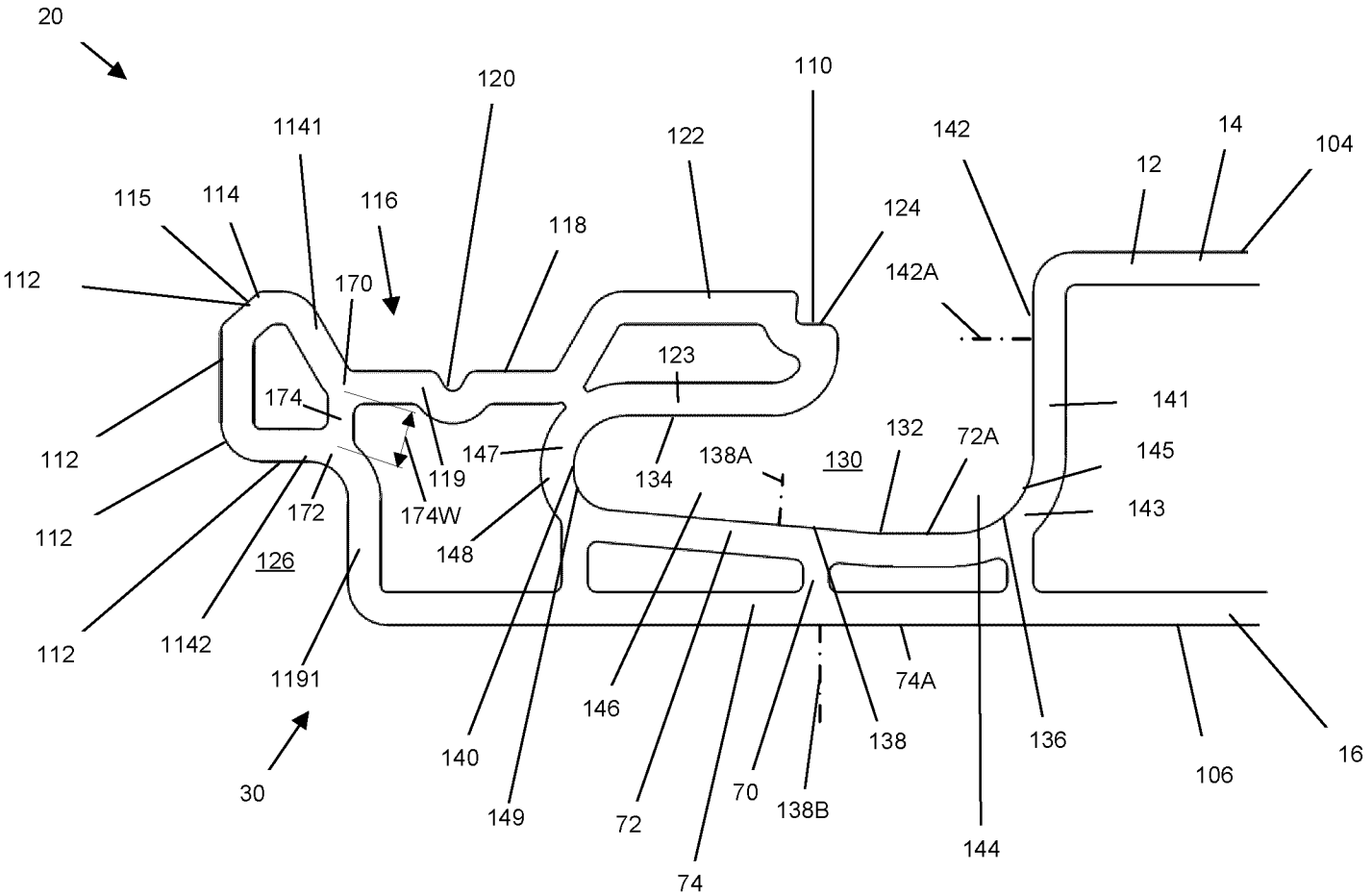
FIG. 2 is an enlarged view of a portion of the panel of FIG. 1, the portion of the panel identified by window 2 in FIG. 1.

In some embodiments, for example, the fastener-receiving portion 116 includes a fastener locator 120 for locating placement of a fastener in a fastener effective position, and for guiding the penetration of the panel 100 by the mechanical fastener. In some embodiments, for example, the fastener locator 120 is defined by a panel member 119, as depicted in FIG. 2. In some embodiments, for example, the fastener is disposed in the fastener effective position while the fastener is disposed perpendicular to the wall 1 to which the panel 100 is to be connected. In some embodiments, for example, the fastener locator 120 includes a groove. In some embodiments, for example, the fastener locator 120 is configured to receive the tip of a fastener. In some embodiments, for example, the fastener locator 120 is sufficiently deep and wide to receive the tip of the fastener. In some embodiments, for example, the fastener locator 120 and the tip of the fastener are co-operatively configured such that, while the tip of the fastener is received in the fastener locator 120, the position of the fastener-receiving portion 116 is identified for a user to fasten the panel 100 to a wall 1. In some embodiments, for example, the fastener locator 120 and the tip of the fastener are co-operatively configured such that, while the tip of the fastener is received in the fastener locator 120, the fastener is oriented such that the fastener is able to fasten the panel 100 to a wall 1 in response to penetration of the fastener receiving portion 116. In some embodiments, for example, the groove 120 is defined on the fastener-engaging surface 118.

To connect the panel 100 to a wall 1, the panel 100 is disposed in abutting engagement against the wall 1, the fastener is emplaced via the fastener locator 120 in the fastening effective position, and penetrated through the fastener-engaging surface 118 the panel 100 and further penetrated through the fastener receiving portion 116, until the fastener engages and penetrates into the wall, such that the panel 100 is coupled to the wall via the fastener.

In some embodiments, for example, while the panel 100 is connected to the wall 1, for example, via a fastener, the visible portion of the outermost surface 104 is parallel to the surface of the wall 1 on which the panel 100 is mounted.

In some embodiments, for example, while the panel 100 is connected to the wall 1 via the penetration of the fastener through the panel 100 and into the wall 1, the fastener is retained by the panel member 118.

In some embodiments, for example, the panel 100 is co-operable with another panel for concealing the fastener while the connection is established between the panel 100 and the another panel 100 via the first connection system counterpart configuration 30 and the second connection system counterpart configuration 50.

In some embodiments, for example, the first panel 100 the second panel 100 are co-operatively configured such that, while the first panel 100 the second panel 100 are connected, and at least one of the first and second panels 100 are secured to a wall 1, for each one of the first panel 100 the second panel 100, independently, the panel is secured to the wall such that displacement of the panel, relative to the wall, at least within a plane that is parallel to the surface of the wall, is resisted.

In some embodiments, for example, the visible surfaces of first panel 100 the second panel 100 are co-planar while the two panels are connected to provide an aesthetically pleasing appearance.

In some embodiments, for example, the visible surface of the first panel 100 is defined by a planar continuous surface having a surface area of at least 3 inches squared.

In some embodiments, for example, the visible surface of the second panel 100 is defined by a planar continuous surface having a surface area of at least 3 inches squared.

FIG. 2 depicts an example embodiment of the first connection system counterpart configuration 30.

As depicted in FIG. 2, the first connection system counterpart configuration 30 includes a first connection system counterpart 110 of a first connection system 32. In some embodiments, for example, the first connection system counterpart 110 of the first connection system 32 includes a notch 124. The notch 124 is configured to receive a rearward projection 158 for connecting the panel 100 and an adjacent panel 100. In some embodiments, for example, while the rearward projection 158 is disposed in or received in the notch 124, the connection between the panel 100 and the adjacent panel 100 is retained.

As depicted in FIG. 2, the panel defined configuration 20 includes an arm 122. In some embodiments, for example, the arm 122 is configured to support an interacting portion 154 of the second connection system counterpart configuration 50 of an adjacent panel 100 while the panel 100 is connected to the adjacent panel 100. In some embodiments, for example, as depicted in FIG. 2, the first connection system counterpart 110 of the first connection system 32 is defined by the arm 122.

In some embodiments, for example, the arm 122 is a retaining surface-defining configuration 122, which includes a retaining surface-defining wall 123 that defines a retaining surface 134. The retaining surface 134 is configured to oppose displacement of a mounting assembly 500, for example, a bracket 502 of the mounting assembly 500, that is retained by the panel 100.

As depicted in FIG. 2, the first connection system counterpart configuration 30 includes a first connection system counterpart 114 of a second connection system counterpart 34. In some embodiments, for example, the first connection system counterpart 114 of the second connection system 34 includes an insertable projection 114.

In some embodiments, for example, the projection 114 is configured to be received in a recess 164 of the panel defined configuration 40 of an adjacent panel 100, for connecting the panel 100 and the adjacent panel 100. In some embodiments, the receiving of the projection 114 in the recess 164 includes a friction fit. In some embodiments, the receiving of the projection 114 in the recess 164 includes an interference fit.

In some embodiments, for example, the projection 114 is sufficiently wide to increase the structural strength of the projection 114 and the connection between the first panel 100 and the second panel 100, and to increase the air flow through the projection 114.

In some embodiments, for example, the projection 114 is configured to support the interacting portion 60 of the second connection system counterpart configuration 50 of an adjacent panel 100 while the panel 100 is connected to the adjacent panel 100.

In some embodiments, for example, as depicted in FIG. 2, the projection 114 includes an urging surface 115. In some embodiments, for example, the urging surface 115 is angled relative to the outermost surface 104. In some embodiments, for example, the urging surface 115 defines a normal axis, the outermost surface 104 defines a normal axis, and an acute angle defined between said normal axes has a minimum value of at least 10 degrees. In some embodiments, for example, said acute angle has a value of 45 degrees.

In some embodiments, for example, the urging surface 115 is configured to engage with the interacting portion 60 of the second connection system counterpart configuration 50, and to urge the interacting portion 60 in a direction away from the axis 1001, such that displacement of the first panel 100 and the second panel 100 towards each other is effectible to effect the interaction between the first connection system counterpart configuration 30 and the second connection system counterpart configuration 50, to connect the first panel 100 and the second panel 100.

Figure 5B:
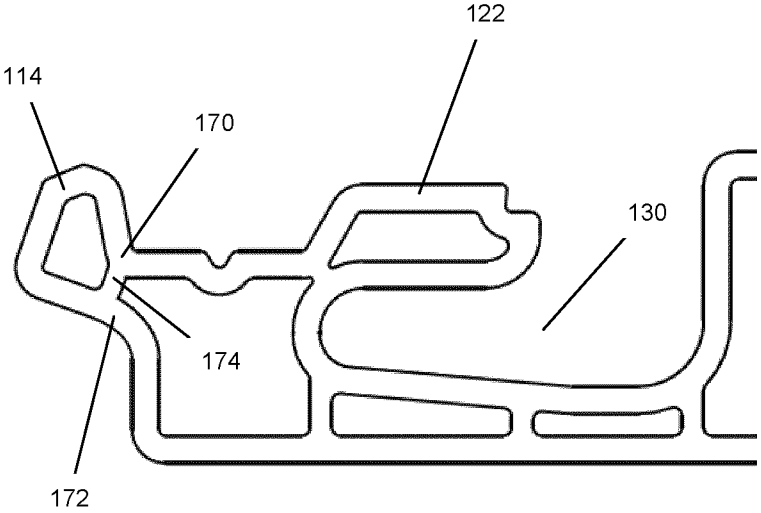
FIG. 5B is a cross-sectional view of the panel defined configuration disposed at the first end of the panel of FIG. 1, with the projection disposed in a connection prevention configuration.
Figure 5A:
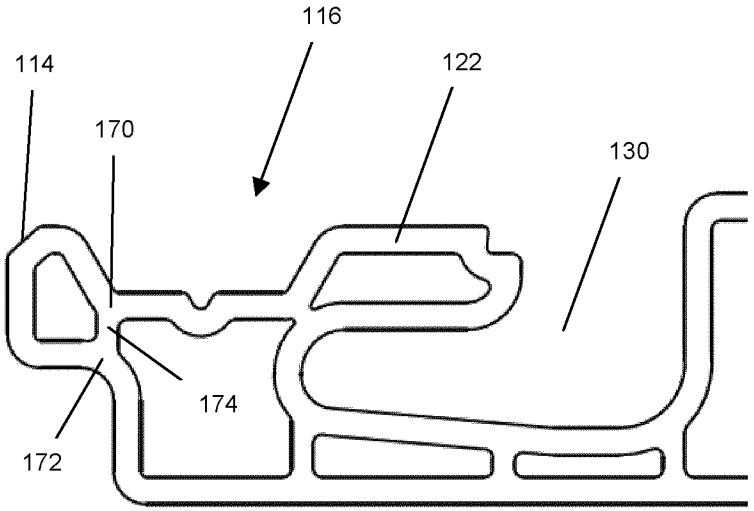
FIG. 5A is a cross-sectional view of a panel defined configuration disposed at a first end of the panel of FIG. 1, with a projection disposed in a relative movement effective configuration.

In some embodiments, for example, the projection 114 is connected to a residual panel portion, wherein the residual panel portion is the portion of the panel that excludes the projection 114. In some embodiments, for example, the projection 114 is configurable in a relative movement-effective configuration, as depicted in FIG. 5A. In some embodiments, for example, the projection is deformable for effecting transitioning of the projection 114 from the relative movement-effective configuration to a connection prevention configuration, as depicted in FIG. 5B, wherein the transitioning includes a forwardly displacement of the projection 114, relative to the residual panel portion. In some embodiments, for example, the forwardly displacement of the projection 114, relative to the residual panel portion, for effecting transitioning of the projection 114 from the relative movement-effective configuration to the connection prevention configuration, includes rotation of the projection 114, relative to the residual panel portion.

As depicted in FIG. 2, in some embodiments, for example, the panel defined configuration 20 includes the fastener receiving portion 116. As depicted, in some embodiments, for example, the projection 114 is connected to the fastener receiving portion 116, and the retaining surface defining configuration 122 is also connected to the fastener receiving portion 116, wherein the projection 114 and the retaining surface-defining configuration 112 are disposed on opposite sides of the fastener receiving portion 116.

In some embodiments, for example, the panel-defined configuration 20 includes a recess 126, configured to receive a second connection system counterpart 160 of the second connection system 34 of the panel-defined configuration 40 of an adjacent panel 100, for effecting connection of the connected panel 100 and the adjacent panel 100. As depicted in FIG. 2, the recess 126 is defined between the projection 114 and the fastener-receiving portion 116.

As depicted in FIG. 2, in some embodiments, for example, the panel-defined configuration 20 includes a rear wall configuration 70, comprising a first wall 72 and a second wall 74. As depicted, the second wall 74 is disposed rearwardly of the first wall 72, and extending from the rear-facing wall 16. The rear wall configuration 70 connects the first connection system counterpart configuration 30, the fastener-receiving portion 116, and the retaining surface defining configuration 122 to the wall covering portion 12. In some embodiments, for example, the rear wall configuration 70 extends between: 1) the fastener-receiving portion 116, and 2) the wall covering portion 12. In some embodiments, for example, the rear wall configuration 70 is disposed in force transmission communication with the retaining surface defining configuration 122.

In some embodiments, for example, the first wall 72 includes an outer surface 72A, and the second wall 74 includes an outer surface 74A. In some embodiments, for example, the outer surface 72A of the first wall 72 is a front facing surface of the rear wall configuration 70. In some embodiments, for example, the outer surface 74A of the second wall 74 is a rear facing surface of the rear wall configuration 70. The surface 74A is disposed, relative to the surface 72A, on an opposite side of the rear wall configuration 70. While the panel 100 is secured to a wall 1, the outer surface 74A of the second wall is disposed in opposing relationship to the wall 1.

Figure 3:
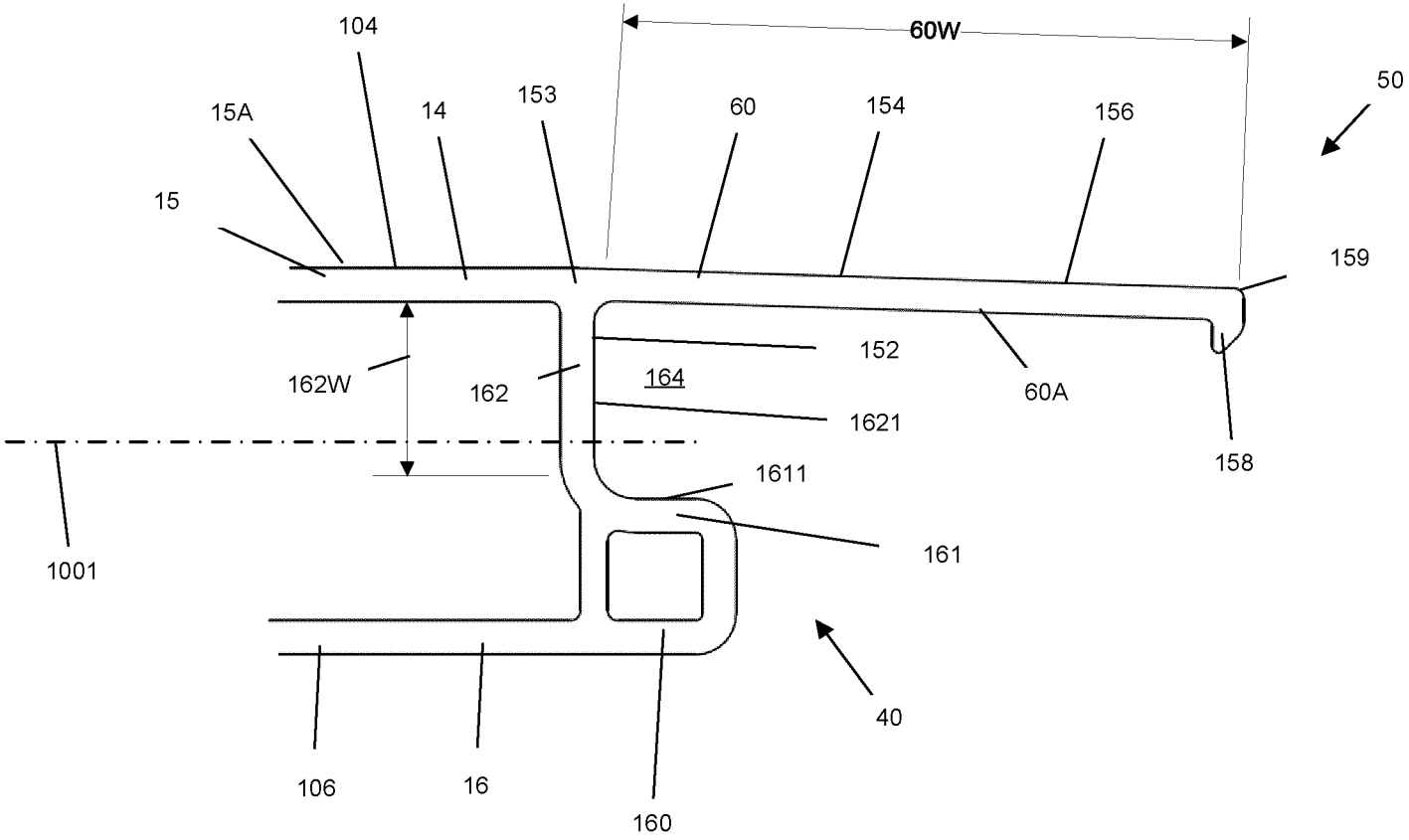
FIG. 3 is an enlarged view of a portion of the panel of FIG. 1, the portion of the panel identified by window 3 in FIG. 1.

As depicted in FIG. 1 and FIG. 3, the panel 100 includes, at the second end 102, the panel-defined configuration 40. The panel-defined configuration 40 includes the second connection system counterpart configuration 50.

The second connection system counterpart configuration 50 includes an interacting portion 60. The front facing wall 14 includes the interacting portion 60, the interacting portion 60, having a terminal end that is, in some embodiments, a free end, and extending from a joint 153. In this respect, in some embodiments, for example, the front facing wall 14 is defined by the interacting portion 60 and a residual front facing wall portion 15, wherein the interacting portion 60 is connected to the residual front facing wall portion 15 at the joint 153. The interacting portion 60 includes a fastener receiver-covering portion 154 and a second connection system counterpart 158 of the first connection system 32. In some embodiments, for example, the second connection system counterpart 158 of the first connection system 32 includes a projection 158. In some embodiments, for example, the projection 158 extends perpendicularly, in a rearwardly direction, from the covering portion 154. In some embodiments, for example, the second connection system counterpart 158 of the first connection system 32 is disposed at the terminal end of the interacting portion 60. The projection 158 is configured to interact with the notch 124 of another panel 100, with effect that the projection 158 and the notch 124 are co-operatively disposed in a relative movement interference relationship, as explained in further detail below.

In some embodiments, for example, as depicted in FIG. 3, the interacting portion 60 has a width 60W having a minimum value of at least 0.375 inches.

In some embodiments, for example, while the panel 100 is connected to an adjacent panel 100, the covering portion 154 conceals at least a portion of, for example, the entirety of, the first connection system counterpart configuration 30 of the adjacent panel 100. In some embodiments, for example, while the panel 100 is connected to an adjacent panel 100 from view, the covering portion 154 conceals at least a portion of, for example, the entirety of, the fastener receiving portion 116 of the adjacent panel 100 from view. In some embodiments, for example, while the panel 100 is connected to an adjacent panel 100, and the adjacent panel 100 is secured to the wall 1 by a fastener, the covering portion 154 conceals at least a portion of, for example, the entirety of, the fastener from view.

The covering portion 154 includes an outermost surface 156 configured for being visible while the panel 100 is connected to another panel 100, and while the connected panel 100 and the another panel 100 are secured to the wall 1. In some embodiments, for example, the outermost surface 156 including a continuous surface that extends along the length of the covering portion 154.

In some embodiments, for example, the visible surface of the covering portion 154 has a minimum surface area of at least 1.125 inches squared. In some embodiments, for example, the visible surface of the covering portion 154 has a minimum width of at least ⅜ inches. In some embodiments, for example, the visible surface of the covering portion 154 has a minimum length of at least 3 inches.

The concealing of the fastener of the another panel by the panel 100, while the connection is established between the panel 100 and the another panel via the connection system counterpart configurations 30, 50, is effectuated by the covering portion 154. In this respect, in some embodiments, for example, the first panel 100 is co-operable with the second panel 100 such that, while the connection between the first and second panels is established via the connection system counterpart configuration 30 of the first panel and the connection system counterpart configuration 50 of the second panel, the covering portion 154 is covering (e.g. concealing) the fastener, which is effectuating the connection of the first panel 100 to the wall 1.

Figure 6:
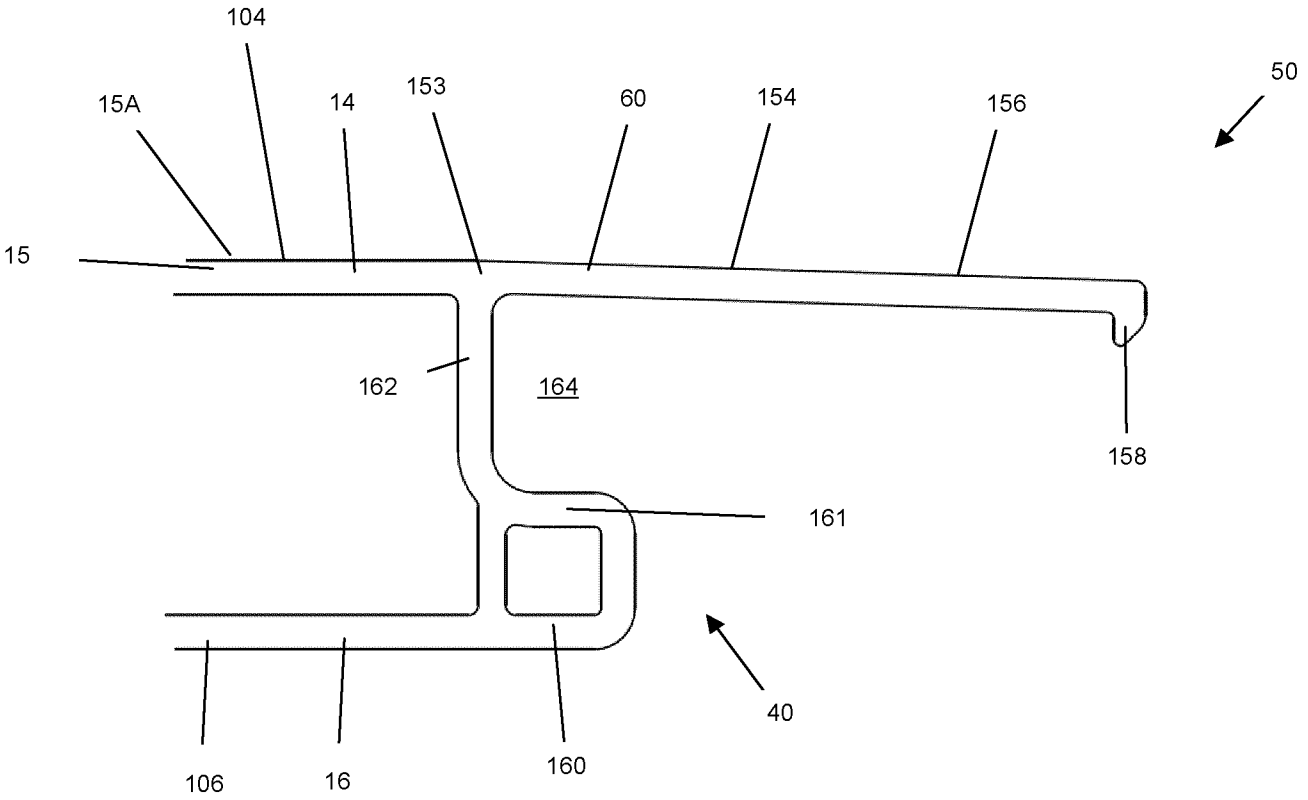
FIG. 6 is another enlarged view of a portion of the panel of FIG. 1, the portion of the panel identified by window 3 in FIG. 1, wherein an interacting portion is disposed in a pre-deformation configuration.

In some embodiments, for example, the interacting portion 60 is configurable in a pre-deformation configuration, as depicted in FIG. 3 and FIG. 6. In some embodiments, for example, the interacting portion 60 is disposed in the pre-deformation while there is an absence of interaction (e.g. absence of connection or engagement) between the panel 100 and an adjacent panel 100.

In some embodiments, for example, in the pre-deformation configuration, the extending of the interacting portion 60 from the joint 153 is with effect that the interacting portion 60 is tapering rearwardly, from the residual front facing wall portion 15, in a direction towards the central longitudinal axis 1001 of the panel 100. In some of these embodiments, for example, in the pre-deformation configuration, a normal axis of the outermost surface 156 of the covering portion 154 is disposed at an acute angle relative to the normal axis of an outermost surface 15A of the residual front facing wall portion 15, and in some of these embodiments, for example, the acute angle has a minimum value of at least 3 degrees.

Figure 7:
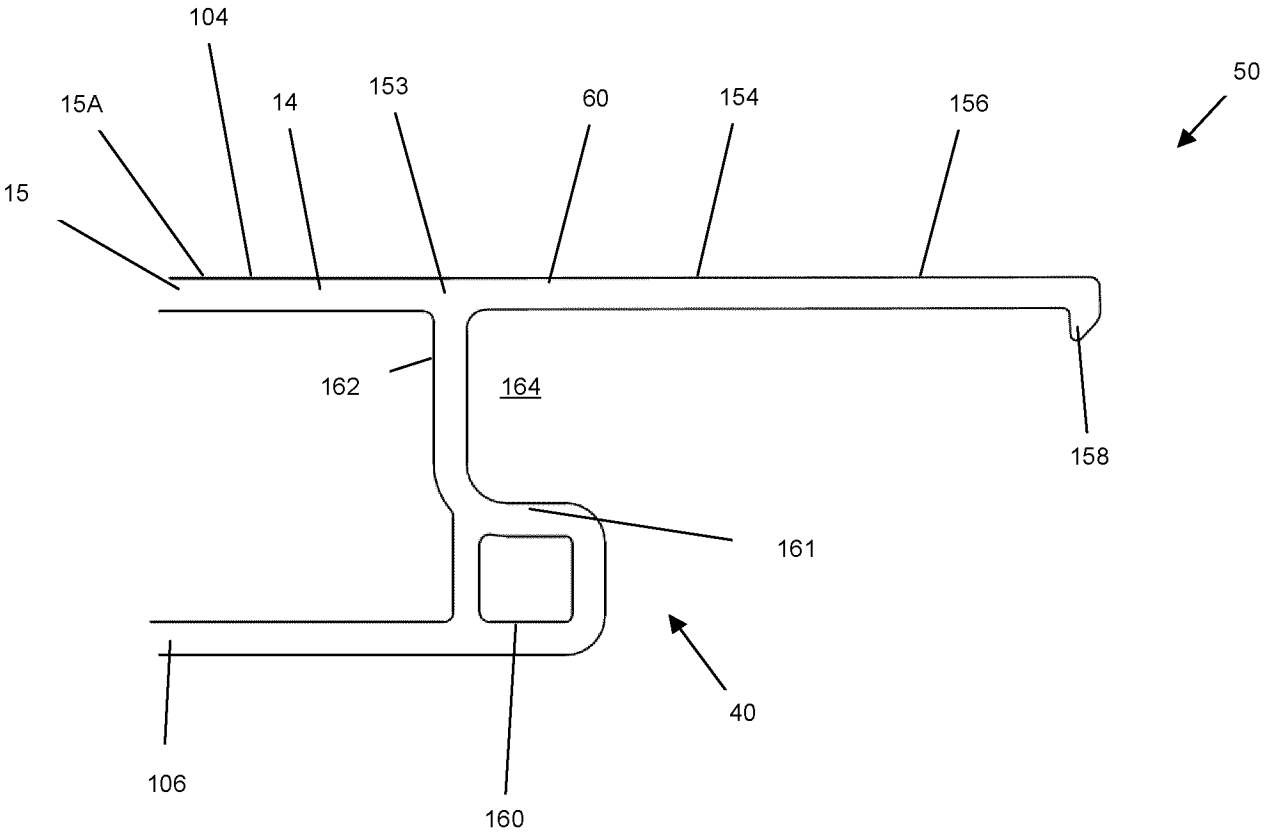
FIG. 7 is an enlarged view of the portion of the panel of FIG. 1, the portion of the panel identified by window 3 in FIG. 1, wherein the interacting portion is disposed in an interference effective configuration.

In some embodiments, for example, the interacting portion 60 is configurable in an interference effective configuration, as depicted in FIG. 7. In some embodiments, for example, the interacting portion 60 is disposed in the interference effective configuration while the panel 100 is connected to the adjacent panel 100 via the connection system counterpart configurations 30, 50.

In the interference-effective configuration, the extending of the interacting portion 60 from the joint 153 is with effect that the outermost surface 104 of the front facing wall 14 is a planar surface (e.g. outermost surface 156 of the covering portion 154 is co-planar with the outermost surface 15A of the residual front facing wall portion 15).

While the interacting portion 60 is disposed in the interference-effective configuration, the second connection system counterpart 158 (e.g. the projection 158) of the panel 100 is receivable in the notch 124 of the adjacent panel 100, such that the projection 158 and the notch 124 of the adjacent panel 100 are co-operable to interfere with relative movement between the panel 100 and the adjacent panel 100. In some embodiments, for example, while the panel 100 and the adjacent panel 100 are disposed in abutting engagement with a wall 1, and the projection 158 of the panel 100 is disposed in or received in the notch 124 of the adjacent panel 100, the projection 158 and the notch 124 are co-operatively configured to interference with displacement of the one of the panel 100 and the adjacent panel 100, relative to the other one of the panel 100 and the adjacent panel 100, within a plane that is parallel to the surface of the wall 1, and in a direction away from the other one of the panel 100 and the adjacent panel 100.

The interacting portion 60 is deformable for effectuating transitioning of the interacting portion 60 from the pre-deformation configuration to the interference-effective configuration. In some embodiments, for example, the transitioning of the interacting portion 60 from the pre-deformation configuration to the interference-effective configuration includes a forwardly displacement of the second connection system counterpart 158 of the first connection system 32.

In some embodiments, for example, the forwardly displacement of the second connection system counterpart 158 of the first connection system 32, for transitioning of the interacting portion 60 from the pre-deformation configuration to the interference-effective configuration, includes a displacement of the second connection system counterpart 158 of the first connection system 32 by a distance of at least 0.030 inches in a forwardly direction.

In some embodiments, for example, the transition of the interacting portion 60 from the pre-deformation configuration to the interference-effective configuration includes rotation of the interacting portion 60. In some embodiments, for example, the interacting portion 60 is rotatable about the joint 153, as depicted in FIG. 3. In some embodiments, for example, the angle of rotation of the covering portion 60 from the pre-deformation configuration to the interference-effective configuration has a minimum value of at least 3 degrees.

Figure 8:
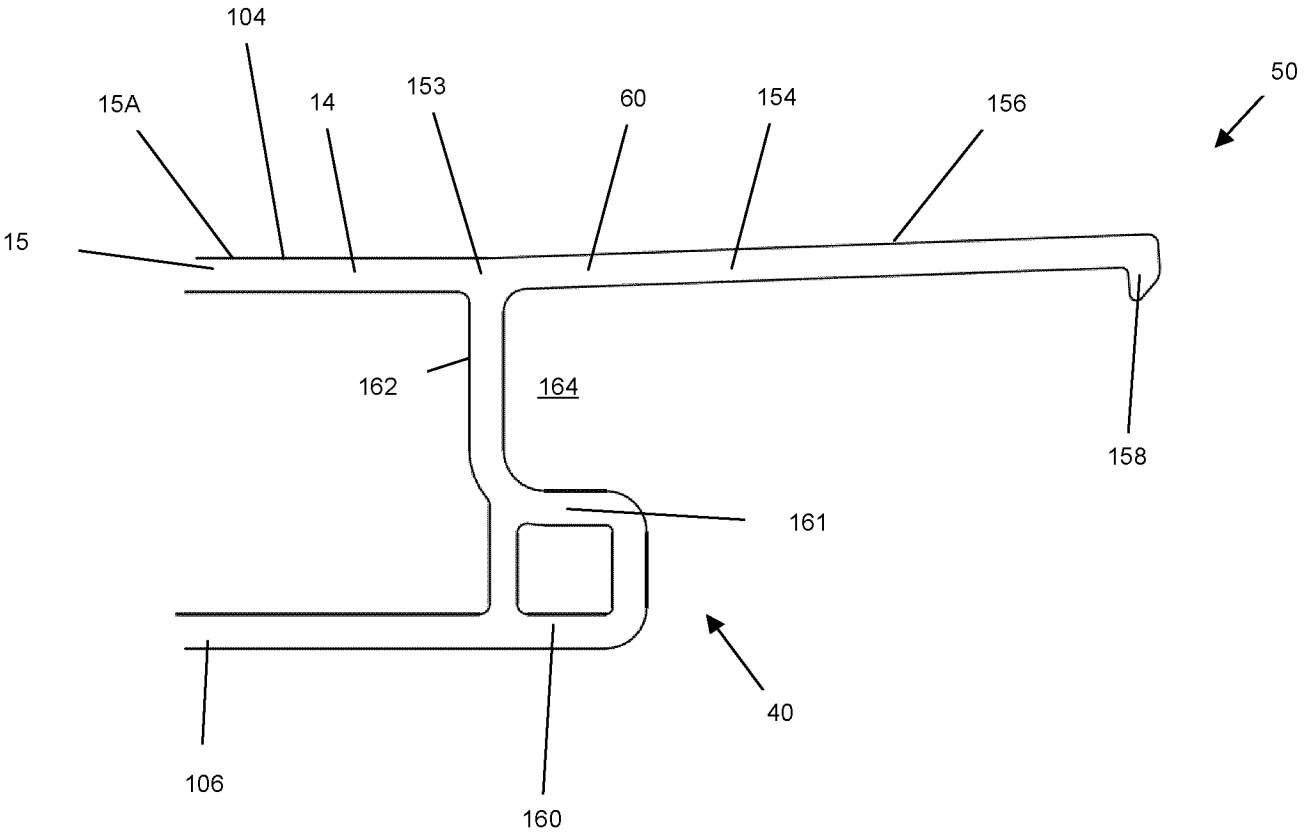
FIG. 8 is enlarged view of a portion of the panel of FIG. 1, the portion of the panel identified by window 3 in FIG. 1, wherein the interacting portion is disposed in an interference ineffective configuration.
Figure 9:
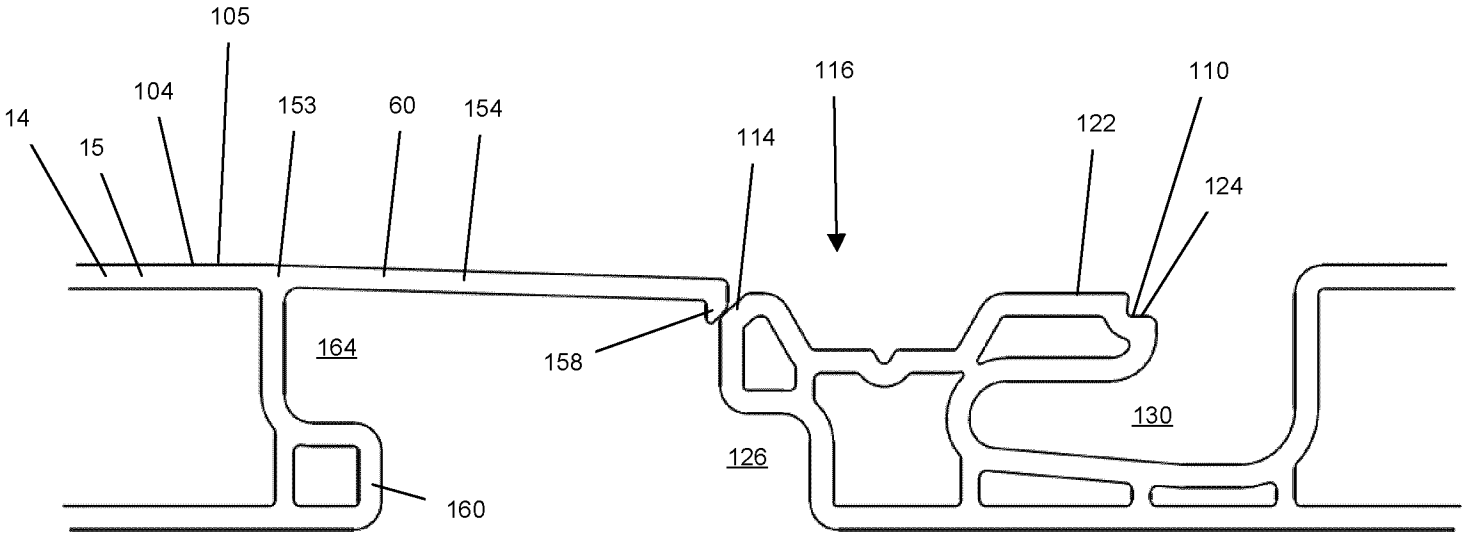
FIG. 9 is a cross-sectional view of a panel-defined configuration disposed at a first end of the panel of FIG. 1, and a panel-defined configuration disposed at a second end of another panel, wherein an interacting portion of the panel-defined configuration disposed at the second end of the another panel is disposed in a pre-deformation configuration.

In some embodiments, for example, the interacting portion 60 is configurable in an interference ineffective configuration, as depicted in FIG. 8. In some embodiments, for example, the interacting portion 60 is disposed in the interference ineffective configuration while: 1) the panel 100 is engaged with the adjacent panel 100 and being displaced towards the adjacent panel 100 to effect the connection between the panel 100 and the adjacent panel 100, or 2) the connection between a connected panel 100 and adjacent panel 100 is to be defeated.

In some embodiments, for example, in the interference ineffective configuration, the extending of the interacting portion 60 from the joint 153 is with effect that the interacting portion 60 is tapering forwardly from the residual front facing wall portion 15, in a direction away from the central longitudinal axis 1001 of the panel 100. In some of these embodiments, for example, in the interference ineffective configuration, a normal axis of the outermost surface 156 of the covering portion 154 is disposed at an acute angle relative to the normal axis of the outermost surface 15A of the residual front facing wall portion 15, and in some of these embodiments, for example, the acute angle has a minimum value of at least 3 degrees.

While the interacting portion 60 is disposed in the interference-ineffective configuration, the panel 100 is displaceable towards, or away from, the adjacent panel 100, while the second connection system counterpart configuration 50 is disposed in an interacting relationship (e.g. contact engagement) with the first connection system counterpart configuration 30 of the adjacent panel 100, for example, to effect the connection between the panel 100 and the adjacent panel 100, or to defeat the connection between the connected panel 100 and the adjacent panel 100.

The interacting portion 60 is deformable for effectuating transitioning of the interacting portion 60 from the interference-effective configuration to the interference ineffective configuration. In some embodiments, for example, the transitioning of the interacting portion 60 from the interference-effective configuration to the interference-ineffective configuration includes a forwardly displacement of the second connection system counterpart 158 of the first connection system 32.

In some embodiments, for example, the forwardly displacement of the second connection system counterpart 158 of the first connection system 32, for transitioning of the interacting portion 60 from the interference-effective configuration to the interference-ineffective configuration, includes a displacement of the second connection system counterpart 158 of the first connection system 32 by a distance of at least 0.030 inches in a forwardly direction.

In some embodiments, for example, the transition of the interacting portion 60 from the interference-effective configuration to the interference-ineffective configuration includes rotation of the interacting portion 60 about the joint 153, as depicted in FIG. 3. In some embodiments, for example, the angle of rotation of the covering portion 60 from the interference-effective configuration to the interference-ineffective configuration has a minimum value of at least 3 degrees.

In some embodiments, for example, the interacting portion 60 is urged by a bias to the pre-deformation configuration. In some embodiments, for example, the bias is a material bias of the interacting portion 60. In some embodiments, for example, the bias of the interacting portion 60 is effected by the extension of the interacting portion 60 towards the central longitudinal axis 1001 of the panel 100 while there is an absence of connection between the panel 100 and another panel 100. In this respect, in some embodiments, for example, the interacting portion 154 is resilient.

In some embodiments, for example, the interacting portion 60 is resiliently deformable or resiliently displaceable between: 1) the pre-deformation configuration, 2) the interference effective configuration, and 3) the interference ineffective configuration.

In some embodiments, for example, the interacting portion 60 is transitionable between two of: 1) the pre-deformation configuration, 2) the interference effective configuration, and 3) the interference ineffective configuration. In some embodiments, for example, the interacting portion 60 is resiliently deformable or resiliently displaceable between two of: 1) the pre-deformation configuration, 2) the interference effective configuration, and 3) the interference ineffective configuration.

In some embodiments, for example, the second connection system counterpart configuration 50 includes a second connection system counterpart 160 of the second connection system 34. The second connection system counterpart 160 of the second connection system 34 includes a wall member 161 disposed rearwardly of the interacting portion 60. As depicted in FIG. 3, the second connection system counterpart 160 of the second connection system 34 has a square cross-section. In some embodiments, for example, the second connection system counterpart 160 of the second connection system 34 is defined by the member 161, wherein the member 161 is extending from the rear facing wall 16. The second connection system counterpart 160 of the second connection system 34 of the panel 100 is configured to be received in the recess 126 of the panel-defined configuration 20 of the adjacent panel 100 to effect the connection between the panel 100 and the adjacent panel 100. As described in greater detail herein, the second connection system counterpart 160 of the panel 100 and the projection 114 of the adjacent panel 110 are co-operatively configured such that, while the panel 100 and the adjacent panel 100 are connected, displacement of the panel 100, relative to the adjacent panel 100, in a direction that is parallel to a normal axis of a wall 1, on which the panel 100 and the adjacent panel 100 are disposed in abutting relationship, is resisted.

As depicted in FIG. 3, the panel defined configuration 40 includes an intermediate wall 162. The intermediate wall 162 is disposed intermediate the front facing wall 14 and the rear facing wall 16. The intermediate wall 162 is connected to the front facing wall 14 at the joint 153, and extends from the joint 153. In some embodiments, for example, the intermediate wall 162 extends from the joint 153 to the wall member 161. In some embodiments, for example, the intermediate wall 162 and the residual front facing wall portion 15 are disposed in a perpendicular relationship. In some embodiments, for example, while the panel 100 is connected to an adjacent panel via the first connection system counterpart configuration 30 and the second connection system counterpart configuration 50, the intermediate wall 162 and the front facing wall 14 are disposed in a perpendicular relationship. In some embodiments, for example, while the panel 100 is connected to an adjacent panel via the first connection system counterpart configuration 30 and the second connection system counterpart configuration 50, the intermediate wall 162 and the covering portion 154 are disposed in a perpendicular relationship. In some embodiments, for example, the intermediate wall 162 and the wall member 161 are disposed in a perpendicular relationship.

In some embodiments, for example, the panel-define configuration 40 includes a recess 164. The recess 164 of the panel 100 is configured to receive the projection 114 of the adjacent panel 100 for connecting the panel 100 and the adjacent panel 100. The recess 164 is defined by: 1) an inner surface 60A of the interacting portion 60, an inner surface 1611 of the wall member 161, and 3) the intermediate wall 162, for example, an intermediate wall surface 1621 of the intermediate wall 162. The recess 164 is disposed intermediate the front facing wall 14 and the rear facing wall 16.

In some embodiments, for example, the panel 100 is configured for defining a first panel 100 which is connectible with a second panel 100, for example, via the first connection system counterpart configuration 30 of the first panel 100 and the second connection system counterpart configuration 50 of the second panel 100. The connection of the first and second panels is effected by: 1) snap fit engagement between the first connection system counterpart 110 (e.g. the notch 124) of the first connection system 32, of the first panel 100, and the second connection system counterpart 158 (e.g. the rearward projection 158) of the first connection system 32, of the second panel 100, and 2) disposition of the first connection system counterpart 114 (e.g. the projection 114) of the second connection system 34, of the first panel 100, in the recess 164 of the second panel 100, and disposition of the second connection system counterpart 160 of the second connection system 34, of the second panel 100, in the recess 126 of the first panel 100, such that the first connection system counterpart 114 (e.g. the projection 114) of the second connection system 34, of the first panel 100, is disposed forwardly of the second connection system counterpart 114 (e.g. the projection 114) of the second connection system 34, of the second panel 100.

In some embodiments, for example, the snap-fit engagement between the first connection system counterpart 110 (e.g. the notch 124) of the first connection system 32, of the first panel 100, and the second connection system counterpart 158 (e.g. the rearward projection 158) of the first connection system 32, of the second panel 100 is effected by the displacement of the interacting portion 60 from the interference ineffective configuration to the interference effective configuration.

Figure 11:
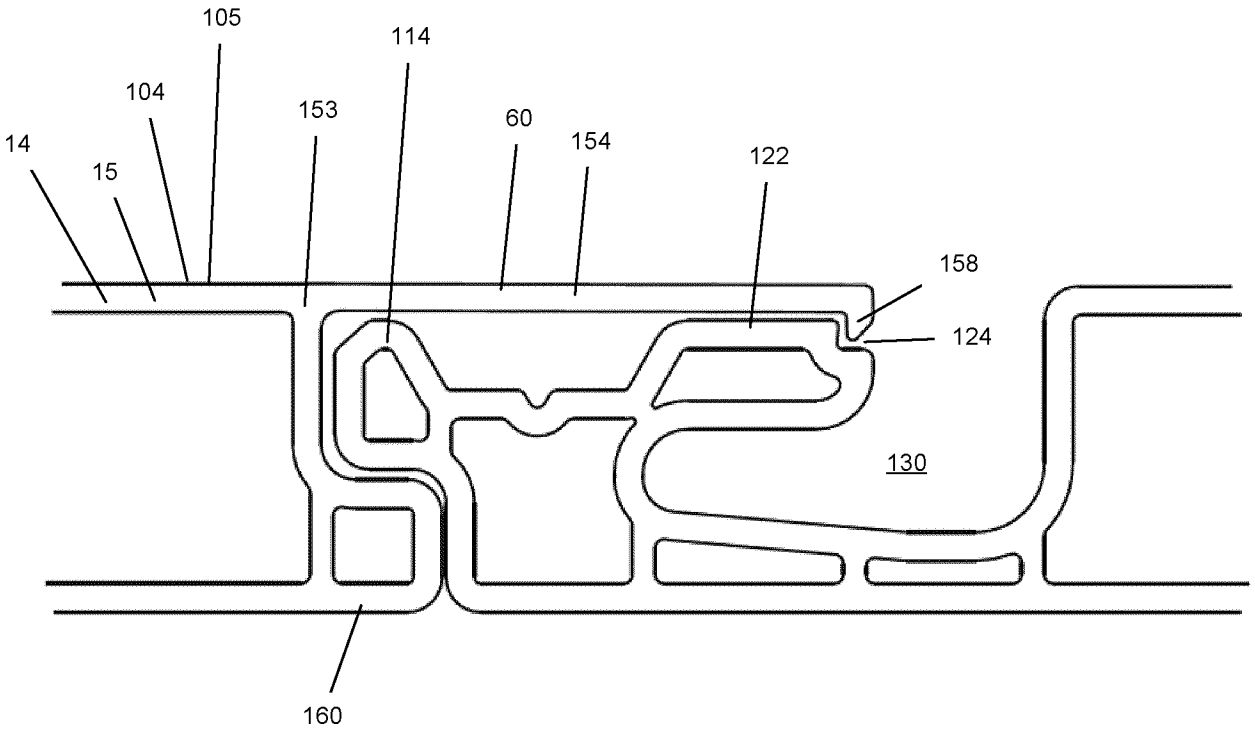
FIG. 11 is an enlarged view of a portion of the wall panel assembly of FIG. 4, the portion of the panel identified by window 11 in FIG. 4.

In some embodiments, for example, while the first and second panels are connected, the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in a relative movement interference relationship, as depicted in FIG. 11, wherein, in the relative movement interference relationship: 1) the interacting portion 60 is disposed in the interference-effective configuration, as depicted in FIG. 7, and 2) the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, in a direction that is perpendicular to a normal axis of the front-facing wall of the second panel, is resisted (e.g. the notch 124 and the projection 158 co-operate to resist pulling apart of the first and second panels), such that defeating of the connection of the first and second panels is resisted. In this respect, in some embodiments, for example, the snap fit connection between the first connection system counterpart 110 (e.g. the notch 124) of the first connection system 32, of the first panel 100, and the second connection system counterpart 158 (e.g. the rearward projection 158) of the first connection system 32, of the second panel 100 is with effect that displacement of the second panel 100, away from to the first panel 100, in a direction that is perpendicular to a normal axis of the front-facing wall of the second panel, is resisted.

In some embodiments, for example, while the first and second panels are connected, and the panels are abutting against a wall 1, the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in a relative movement interference relationship, wherein, in the relative movement interference relationship: 1) the interacting portion 60 is disposed in the interference-effective configuration, as depicted in FIG. 7, and 2) the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, within a plane that is parallel to the surface of the wall, is resisted, such that defeating of the connection of the first and second panels is resisted.

In some embodiments, for example, while the first and second panels are connected, and the first panel is secured to a wall 1, for example, by a fastener, the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in a relative movement interference relationship, wherein, in the relative movement interference relationship: 1) the interacting portion 60 is disposed in the interference-effective configuration, as depicted in FIG. 7, and 2) the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, in a direction that is perpendicular to a normal axis of the surface of the wall, is resisted, such that defeating of the connection of the first and second panels is resisted.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, the second connection system counterpart 158 (e.g. the rearward projection 158) of the first connection system 32, of the second panel 100, is received in the first connection system counterpart 110 (e.g. the notch 124) of the first connection system 32, of the first panel 100, such that the interference, to relative movement, between the first and second panels, is established, and that defeating of the connection of the first and second panels is resisted.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, the second connection system counterpart 158 (e.g. the rearward projection 158) of the first connection system 32, of the second panel 100 is engaging the first connection system counterpart 110 (e.g. the notch 124) of the first connection system 32, of the first panel 100, such that the interference, to relative movement, between the first and second panels, is established, and that defeating of the connection of the first and second panels is resisted.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, the second connection system counterpart 158 (e.g. the rearward projection 158) of the first connection system 32, of the second panel 100 is bearing against the first connection system counterpart 110 (e.g. the notch 124) of the first connection system 32, of the first panel 100, such that the interference, to relative movement, between the first and second panels, is established, and that defeating of the connection of the first and second panels is resisted.

In some embodiments, for example, the bias of the interacting portion 60 resists defeating of the relative movement interference relationship between the first connection system counterpart 110 (e.g. the notch 124) of the first connection system 32, of the first panel 100, and the second connection system counterpart 158 (e.g. the rearward projection 158) of the first connection system 32, of the second panel 100.

In some embodiments, for example, while the first and second panels are connected, the first connection system counterpart 114 (e.g. the projection 114) of the second connection system 34, of the first panel 100, and the second connection system counterpart 160, for example, the wall member 161, of the second connection system 34, of the second panel 100, are configured for disposition in a relative movement interference relationship, as depicted in FIG. 11, wherein, in the relative movement interference relationship, the first connection system counterpart 114 (e.g. the projection 114) of the second connection system 34, of the first panel 100, and the second connection system counterpart 160, for example, the wall member 161, of the second connection system 34, of the second panel 100, are co-operatively configured such that displacement of the second panel 100, away from to the first panel 100, in a direction that is parallel to a normal axis of the front-facing wall 104 of the second panel, is resisted (e.g. the projection 114 and the wall member 161 co-operate to resist lifting of the second panel away from the first panel), such that defeating of the connection of the first and second panels is resisted.

In some embodiments, for example, while the first and second panels are connected, and the panels are abutting against a wall 1, the first connection system counterpart 114 (e.g. the projection 114) of the second connection system 34, of the first panel 100, and the second connection system counterpart 160, for example, the wall member 161, of the second connection system 34, of the second panel 100, are configured for disposition in a relative movement interference relationship, wherein, in the relative movement interference relationship, the first connection system counterpart 114 (e.g. the projection 114) of the second connection system 34, of the first panel 100, and the second connection system counterpart 160, for example, the wall member 161, of the second connection system 34, of the second panel 100, are co-operatively configured such that displacement of the second panel 100, away from to the first panel 100, within a plane that is perpendicular to the surface of the wall, is resisted, such that defeating of the connection of the first and second panels is resisted.

In some embodiments, for example, while the first and second panels are connected, and the and the first panel is secured to a wall 1, for example, by a fastener, the first connection system counterpart 114 (e.g. the projection 114) of the second connection system 34, of the first panel 100, and the second connection system counterpart 160, for example, the wall member 161, of the second connection system 34, of the second panel 100 are configured for disposition in a relative movement interference relationship, wherein, in the relative movement interference relationship, the first connection system counterpart 114 (e.g. the projection 114) of the second connection system 34, of the first panel 100, and the second connection system counterpart 160, for example, the wall member 161, of the second connection system 34, of the second panel 100 are co-operatively configured such that displacement of the second panel 100, away from to the first panel 100, in a direction that is parallel to a normal axis of the surface of the wall, is resisted, such that defeating of the connection of the first and second panels is resisted.

In some embodiments, for example, while the first panel 100 is connected to the second panel 100, the projection 114 of the first panel is received in the recess 164 of the second panel 100, and the second connection system counterpart 160 of the second connection system 34 of the second panel 100 is received in the recess 126 of the first panel 100. In some embodiments, for example, while the projection 114 is received in the recess 164, the shoulder 114 is disposed in opposing relationship with the intermediate wall 162, the covering portion 154, and the second connection system counterpart 160 of the second connection system 34.

In some embodiments, for example, while the projection 114 is received in the recess 164, the intermediate wall 162 is configured to resist relative displacement of the first connection system counterpart configuration 30 of the first panel 100 and the second connection system counterpart configuration 50 of the second panel 100 towards each other, with effect that defeating of the connection of the connected first panel 100 and the second panel 100 is resisted.

In some embodiments, for example, while the projection 114 is received in the recess 164, the covering portion 154 is disposed forwardly of the projection 114, and is configured to resist displacement of the first connection system counterpart configuration 30 of the first panel 100, relative to the second connection system counterpart configuration 50 of the second panel 100, in a direction perpendicular to the outermost surface 104 of the first panel 100, with effect that defeating of the connection of the connected first panel 100 and the second panel 100 is resisted.

In some embodiments, for example, while the projection 114 is received in the recess 164, the second connection system counterpart 160 of the second connection system 34 of the second panel 100 is disposed rearwardly of the projection 114, and is configured to resist displacement of the first connection system counterpart configuration 30 of the first panel 100, relative to the second connection system counterpart configuration 50 of the second panel 100, away from covering portion 154, in a direction perpendicular to the wall-opposing surface 106, with effect that defeating of the connection of the connected first panel 100 and the second panel 100 is resisted.

In some embodiments, for example, while the second connection system counterpart 160 of the second connection system 34 of the second panel 100 is received in the recess 126 of the first panel 100, the second connection system 34 of the second panel 100 is disposed in opposing relationship with the fastener receiving portion 116 of the first panel 100, and co-operate to resist relative displacement of the first panel 100 and the second panel 100 towards each other, with effect that defeating of the connection of the connected first panel 100 and the second panel 100 is resisted.

In some embodiments, for example, while the first panel 100 is connected to the second panel 100, the second connection system counterpart 160 of the second connection system 34 of the second panel 100 is disposed in abutting relationship with the fastener receiving portion 116 of the first panel 100.

In some embodiments, for example, while the first and second panels are connected, the first connection system counterpart 110 (e.g. the notch 124) of the first connection system 32, of the first panel 100, the second connection system counterpart 158 (e.g. the rearward projection 158) of the first connection system 32, of the second panel 100, the first connection system counterpart 114 (e.g. the projection 114) of the second connection system 34, of the first panel 100, and the second connection system counterpart 160, for example, the wall member 161, of the second connection system 34, of the second panel 100 are configured for disposition in a relative movement interference relationship, as depicted in FIG. 11, wherein, in the relative movement interference relationship: 1) the interacting portion 60 is disposed in the interference-effective configuration, and the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, in a direction that is perpendicular to a normal axis of the front-facing wall of the second panel, is resisted (e.g. the notch 124 and the projection 158 co-operate to resist pulling apart of the first and second panels), and 2) the first connection system counterpart 114 (e.g. the projection 114) of the second connection system 34, of the first panel 100, and the second connection system counterpart 160, for example, the wall member 161, of the second connection system 34, of the second panel 100 are co-operatively configured such that displacement of the second panel 100, away from to the first panel 100, in a direction that is parallel to a normal axis of the front-facing wall 104 of the second panel, is resisted (e.g. the projection 114 and the wall member 161 co-operate to resist lifting of the second panel away from the first panel), such that defeating of the connection of the first and second panels is resisted.

In some embodiments, for example, while the first and second panels are connected, and the panels are abutting against a wall 1, the first connection system counterpart 110 (e.g. the notch 124) of the first connection system 32, of the first panel 100, the second connection system counterpart 158 (e.g. the rearward projection 158) of the first connection system 32, of the second panel 100, the first connection system counterpart 114 (e.g. the projection 114) of the second connection system 34, of the first panel 100, and the second connection system counterpart 160, for example, the wall member 161, of the second connection system 34, of the second panel 100 are configured for disposition in a relative movement interference relationship, wherein, in the relative movement interference relationship: 1) the interacting portion 60 is disposed in the interference-effective configuration, and the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, within a plane that is parallel to the surface of the wall, is resisted, and 2) the first connection system counterpart 114 (e.g. the projection 114) of the second connection system 34, of the first panel 100, and the second connection system counterpart 160, for example, the wall member 161, of the second connection system 34, of the second panel 100 are co-operatively configured such that displacement of the second panel 100, away from to the first panel 100, within a plane that is perpendicular to the surface of the wall, is resisted, such that defeating of the connection of the first and second panels is resisted.

In some embodiments, for example, while the first and second panels are connected, and the first panel is secured to a wall 1, for example, by a fastener, the first connection system counterpart 110 (e.g. the notch 124) of the first connection system 32, of the first panel 100, the second connection system counterpart 158 (e.g. the rearward projection 158) of the first connection system 32, of the second panel 100, the first connection system counterpart 114 (e.g. the projection 114) of the second connection system 34, of the first panel 100, and the second connection system counterpart 160, for example, the wall member 161, of the second connection system 34, of the second panel 100 are configured for disposition in a relative movement interference relationship, wherein, in the relative movement interference relationship: 1) the interacting portion 60 is disposed in the interference-effective configuration, and the first connection system counterpart 110 (e.g. the notch 124) of the first connection system 32, of the first panel 100, and the second connection system counterpart 158 (e.g. the rearward projection 158) of the first connection system 32, of the second panel 100 are co-operatively configured such that displacement of the second panel 100, away from to the first panel 100, in a direction that is perpendicular to a normal axis of the surface of the wall, is resisted, and 2) the first connection system counterpart 114 (e.g. the projection 114) of the second connection system 34, of the first panel 100, and the second connection system counterpart 160, for example, the wall member 161, of the second connection system 34, of the second panel 100 are co-operatively configured such that displacement of the second panel 100, away from to the first panel 100, in a direction that is parallel to a normal axis of the surface of the wall, is resisted, such that defeating of the connection of the first and second panels is resisted.

Figure 10:
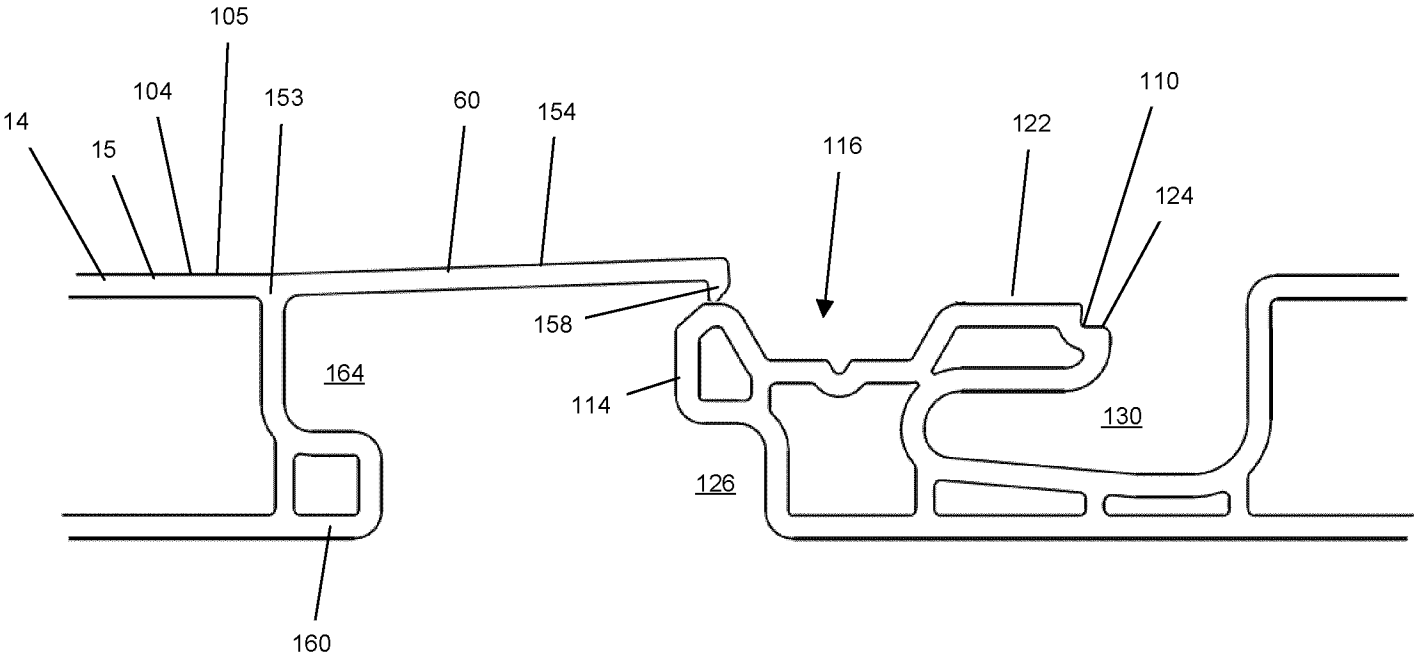
FIG. 10 is a cross-sectional view of a panel-defined configuration disposed at a first end of the panel of FIG. 1, and a panel-defined configuration disposed at a second end of another panel, wherein an interacting portion of the panel-defined configuration disposed at the second end of the another panel is disposed in an interference ineffective configuration.

In some embodiments, for example, the first panel 100 and the second panel 100 are co-operable such that the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in a relative movement effectible relationship, as depicted in FIG. 10. In the relative movement effectible relationship, the interacting portion 60 is disposed in the interference-ineffective configuration, as depicted in FIG. 8, and there is an absence of interference, to relative movement, between the first and second panels. In some embodiments, for example, the absence of the interference, to relative movement, between the first panel and the second panel, is the absence of interference, to relative movement, of the second panel, relative to the first panel, in a direction that is perpendicular to a normal axis of the front-facing wall 104 and away from the first panel.

In some embodiments, for example, while the first and second panels are abutting against a wall 1, and the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in the relative movement effectible relationship, the absence of the interference, to relative movement, between the first panel and the second panel, is the absence of interference, to relative movement, of the second panel, relative to the first panel, within a plane that is parallel to the surface of the wall and away from the first panel.

In some embodiments, for example, while the first and second panels are abutting against a wall 1, and the first connection system counterpart 110 (e.g. the notch 124) of the first connection system 32, of the first panel 100, and the second connection system counterpart 158 (e.g. the rearward projection 158) of the first connection system 32, of the second panel 100 are configured for disposition in the relative movement effectible relationship, the absence of the interference, to relative movement, between the first panel and the second panel, is the absence of interference, to relative movement, of the second panel, relative to the first panel, in a direction that is perpendicular to a normal axis of the surface of the wall and away from the first panel.

In some embodiments, for example, the first connection system counterpart 110 (e.g. the notch 124) of the first connection system 32, of the first panel 100, and the second connection system counterpart 158 (e.g. the rearward projection 158) of the first connection system 32, of the second panel 100 are disposed in a relative movement effectible relationship, as depicted in FIG. 10, while: 1) the first and second panels are being displaced towards each other to effect the connection between the first and second panels, or 2) the first and second panels are being displaced away from each other to defeat the connection between connected first and second panels.

In some embodiments, for example, the transition of the first connection system counterpart 110 (e.g. the notch 124) of the first connection system 32, of the first panel 100, and the second connection system counterpart 158 (e.g. the rearward projection 158) of the first connection system 32, of the second panel 100 from the relative movement interference relationship to the relative movement effectible relationship is effected by transitioning of the interacting portion 60 from the interference-effective configuration to the interference-ineffective configuration. In some embodiments, for example, the transitioning of the interacting portion 60 from the interference-effective configuration to the interference-ineffective configuration is with effect that the interference, to relative movement, between the first panel and the second panel, is defeated (e.g. the interference to pulling the first and second panels away from each other is defeated).

In some embodiments, for example, while the first panel 100 is connected to the second panel 100 via the first connection system counterpart configuration 30 of the first panel 100 and the second connection system counterpart configuration 50 of the second panel 100, the covering portion 154 of the second panel 100 conceals at least a portion of the first connection system counterpart configuration 30 of the first panel 100. In some embodiments, for example, while the first panel 100 is connected to the second panel 100 via the first connection system counterpart configuration 30 of the first panel 100 and the second connection system counterpart configuration 50 of the second panel 100, the covering portion 154 of the second panel 100 conceals the entirety of the first connection system counterpart configuration 30 of the first panel 100. In some embodiments, for example, while the first panel 100 is connected to the second panel 100 via the first connection system counterpart configuration 30 of the first panel 100 and the second connection system counterpart configuration 50 of the second panel 100, the covering portion 154 of the second panel 100 conceals the fastener-receiving portion 116 of the first panel 100, such that a fastener extending through the fastener-receiving portion 116 for securing the first panel 100 to a wall 1 is concealed by the covering portion 154. Such concealment of the of the first connection system counterpart configuration 30, the fastener-receiving portion 116, and the fastener extending through the fastener-receiving portion 116, provides an aesthetically pleasing appearance to the connected first panel 100 and second panel 100.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, and the first panel 100 is connected to a wall with a fastener, the covering portion 154 of the second panel 100 is covering the fastener.

In some embodiments, for example, while the first connection system counterpart 110 (e.g. the notch 124) of the first connection system 32, of the first panel 100, the second connection system counterpart 158 (e.g. the rearward projection 158) of the first connection system 32, of the second panel 100, the first connection system counterpart 114 (e.g. the projection 114) of the second connection system 34, of the first panel 100, and the second connection system counterpart 160, for example, the wall member 161, of the second connection system 34, of the second panel 100 are disposed in the relative movement interference relationship, and the first panel 100 is connected to a wall with a fastener, the covering portion 154 of the second panel 100 is covering the fastener.

In some embodiments, for example, while the first panel 100 and the second panel 100 are connected together, and while at least one of the first and second panels is connected to the wall 1, for example, via a fastener, the visible portion of the outermost surface 156 of the covering portion 154 is parallel to the surface of the wall 1 on which the connected first panel 100 and second panel 100 is mounted.

In some embodiments, for example, the visible surfaces of the wall covering portion 12 and the covering portion 154 of the second panel 100 are co-planar when the first and second panels are connected to provide an aesthetically pleasing appearance.

In some embodiments, for example, to connect the first and second panels via the first connection system counterpart configuration 30 of the first panel 100 and the second connection system counterpart configuration 50 of the second panel 100, the second connection system counterpart 158 (e.g. the rearward projection 158) of the first connection system counterpart 32, of the second panel 100, is to be displaced past the first connection system counterpart 114 (e.g. the projection 114) of the second connection system 34, of the first panel 100, to effect: 1) snap fit engagement between the first connection system counterpart 110 (e.g. the notch 124) of the first connection system 32, of the first panel 100, and the second connection system counterpart 158 (e.g. the rearward projection 158) of the first connection system 32, of the second panel 100, and 2) disposition of the first connection system counterpart 114 (e.g. the projection 114) of the second connection system 34, of the first panel 100, in the recess 164 of the second panel 100, and disposition of the second connection system counterpart 160 of the second connection system 34, of the second panel 100, in the recess 126 of the first panel 100.

Figure 12:
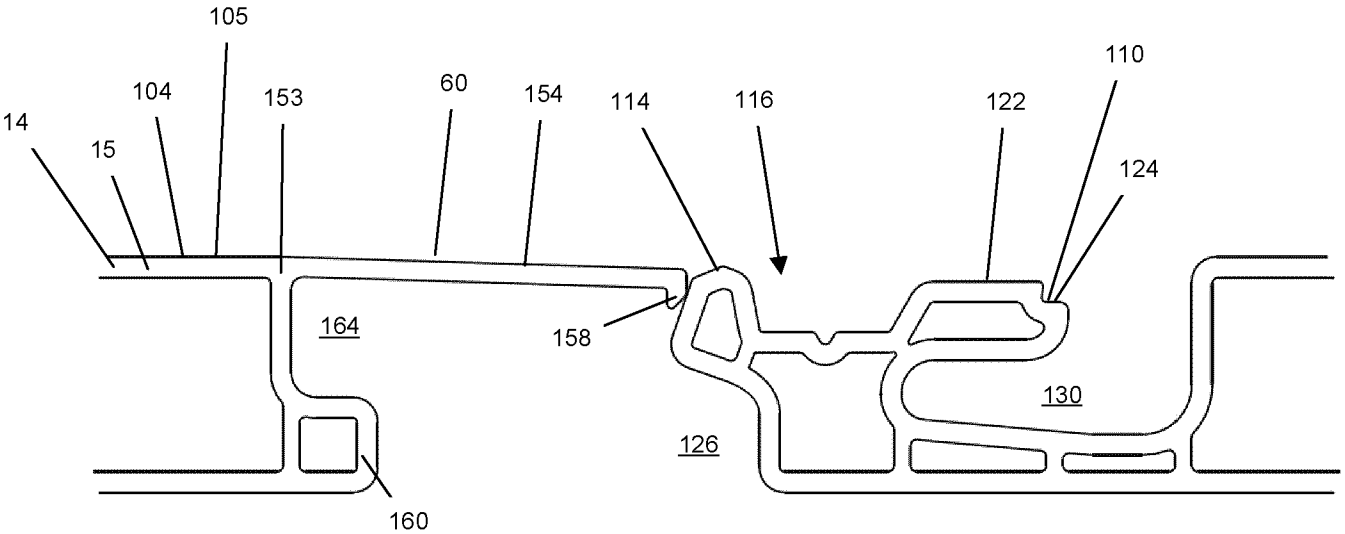
FIG. 12 is a cross-sectional view of a panel-defined configuration disposed at a first end of the panel of FIG. 1, and a panel-defined configuration disposed at a second end of another panel, wherein an insertable projection of the panel of FIG. 1 is disposed in a connection prevention configuration.

In this respect, in some embodiments, for example, the co-operability of the first and second panels is such that the projection 114 of the first panel 100 and the interacting portion 60 of the second panel 100 are configurable for disposition in a relative movement effectible relationship, as depicted in FIG. 10, and a relative movement interference relationship, as depicted in FIG. 12.

In the relative movement effectible relationship, the projection 114 of the first panel 100 is disposed in the relative movement-effective configuration, the interacting portion 60 of the second panel 100 is disposed in the interference-ineffective configuration, and the second panel 100 is displaceable towards the first panel 100, such that the second connection system counterpart 158 (e.g. the rearward projection 158) of the first connection system counterpart 32, of the second panel 100 is displaceable, past the projection 114 of the first panel 100 and towards the first connection system counterpart 110 (e.g. the notch 124) of the first connection system 32, of the first panel 100, for aligning the second connection system counterpart 158 (e.g. the rearward projection 158) and the first connection system counterpart 110 (e.g. the notch 124) of the first connection system 32, to effect the snap fit connection between the first connection system counterpart 110 (e.g. the notch 124) of the first connection system 32, of the first panel 100, and the second connection system counterpart 158 (e.g. the rearward projection 158) of the first connection system 32, of the second panel 100.

In the relative movement interference relationship, the projection 114 of the first panel 100 is disposed in the connection-prevention configuration, and interference, to relative movement, of the second panel 100 towards the first panel 100, by the projection 114 of the first panel 100, is established, such that the displaceability of the second connection system counterpart 158 (e.g. the rearward projection 158) of the first connection system counterpart 32, of the second panel 100, past the projection 114 of the first panel and towards the first connection system counterpart 110 (e.g. the notch 124) of the first connection system 32, of the first panel 100, for aligning the second connection system counterpart 158 (e.g. the rearward projection 158) and the first connection system counterpart 110 (e.g. the notch 124) of the first connection system 32, to effect the snap fit connection between the first connection system counterpart 110 (e.g. the notch 124) of the first connection system 32, of the first panel 100, and the second connection system counterpart 158 (e.g. the rearward projection 158) of the first connection system 32, of the second panel 100, is resisted.

In some embodiments, for example, to couple the first panel 100 and the second panel 100 via the first connection system counterpart configuration 30 of the first panel 100 and the second connection system counterpart configuration 50 of the second panel 100, the first connection system counterpart configuration 30 of the first panel 100 and the second connection system counterpart configuration 50 of the second panel 100 are disposed in alignment. In some embodiments, for example, while the first connection system counterpart configuration 30 of the first panel 100 and the second connection system counterpart configuration 50 of the second panel 100 are disposed in alignment, the first connection system counterpart configuration 30 of the first panel 100 and the second connection system counterpart configuration 50 of the second panel 100 are disposed in opposing relationship. In some embodiments, for example, to align the first connection system counterpart configuration 30 of the first panel 100 and the second connection system counterpart configuration 50 of the second panel 100, the first and second panels are disposed in abutting engagement with a wall 1 and the first connection system counterpart configuration 30 of the first panel 100 and the second connection system counterpart configuration 50 of the second panel 100 are disposed in opposing relationship. At this point, the projection 114 of the first panel 100 is disposed in the relative movement-effective configuration, and the interacting portion 60 is disposed in the pre-deformation configuration. The first panel 100 and the second panel 100 are displaced towards each other, for example, the second panel 100 is displaced towards the first panel 100, until the interacting portion 60 of the second panel 100 becomes disposed in contact engagement with the projection 114 of the first panel 100, for example, the urging surface 115 of the projection 114. In response to further displacement of the second panel 100 towards the first panel 100, a force is applied, by the interacting portion 60 of the second panel 100, to the projection 114 of the first panel. In response to the force, applied by the interacting portion 60 of the second panel 100 to the projection 114 of the first panel 100, a reaction force is applied by the projection 114, for example, the urging surface 115, of the first panel 100 to the interacting portion 60 of the second panel 100, the reaction force having a direction oriented away from the axis 1001, with effect that the interacting portion 60 of the second panel 100 is deformed or deflected, such that: 1) the interacting portion 60 of the second panel 100 is transitioned from the pre-deformation configuration to the interference-ineffective configuration, and 2) the projection 114 of the first panel 100 and the interacting portion 60 of the second panel 100 become disposed in the relative movement effective relationship. At this point, the second panel 100 continues to be displaced towards the first panel 100, such that the second connection system counterpart 158 (e.g. the rearward projection 158) of the first connection system 32, of the second panel 100, is displaced past the projection 114 of the first panel 110, until the second connection system counterpart 158 (e.g. the rearward projection 158) of the first connection system 32, of the second panel 100 becomes disposed in alignment with the first connection system counterpart 110 (e.g. the notch 124) of the first connection system 32, of the first panel 100. At this point, in response to the material bias of the interacting portion 60, the interacting portion is transitioned from the interference-ineffective configuration to the interference-effective configuration, and the and the projection 158 becomes disposed in the notch 124, to effect the snap fit engagement between the second connection system counterpart 158 (e.g. the rearward projection 158) of the first connection system 32, of the second panel 100, and the first connection system counterpart 110 (e.g. the notch 124) of the first connection system 32. Simultaneously, while the second connection system counterpart 158 (e.g. the rearward projection 158) of the first connection system 32, of the second panel 100, is displaced past the projection 114 of the first panel 110 and becomes disposed in the first connection system counterpart 110 (e.g. the notch 124) of the first connection system 32, of the first panel 100, the first connection system counterpart 114 (e.g. the projection 114) of the second connection system 34, of the first panel 100, becomes disposed in the recess 164 of the second panel 100, and the second connection system counterpart 160 of the second connection system 34, of the second panel 100, becomes disposed in the recess 126 of the first panel 100, thereby establishing connection between the first panel 100 and the second panel 100. Additional like panels can be, successively, added to this assembly, in similar manner, such that the wall panel assembly, established by the connection of the panels, is defined by disposition of the panels in adjacent relationship to one another, for example, in a vertical series. In this respect, each one of the panels of wall panel assembly, independently, is elongated and is defined by a longitudinal axis, such that the disposition of the wall panels in adjacent relationship to one another, in a vertical series, is such that, for each one of the walls panels, independently, the longitudinal axis is horizontally oriented.

In some embodiments, for example, the first panel 100 can be displaced towards the second panel 100 to effect the connection between the first and second panels, similar to the manner by which the second panel is displaced towards the first panel 100 to effect the connection between the first and second panels.

In some embodiments, for example, the first panel 100 is first connected to the wall 1 via a fastener configuration (e.g. one or more mechanical fasteners) that is penetrated through the fastener-receiving portion 116 of the first panel 100, and then the second panel 100 is connected to the first panel 100. Then, the second panel 100 is connected to the wall 1 via a fastener configuration that is penetrated through the fastener-receiving portion 116 of the second panel 100.

In some embodiments, for example, the first and second panels are connected via the via the second connection system counterpart configuration 50 of the first panel 100 and the first connection system counterpart configuration 30 of the second panel 100, similar to the manner by which the first and second panels are connected via the via the first connection system counterpart configuration 30 of the first panel 100 and the second connection system counterpart configuration 50 of the second panel 100.

In some embodiments, for example, to defeat or release the connection between connected first and second panels, the interacting portion 60 of the second panel 100 is transitioned from the interference-effective configuration to the interference-ineffective configuration. At this point, the second panel 100 is displaceable away from the first panel 100, within a plane that is parallel to the surface of the wall, to effect the defeating of the connection between the first and second panels.

Figure 41:
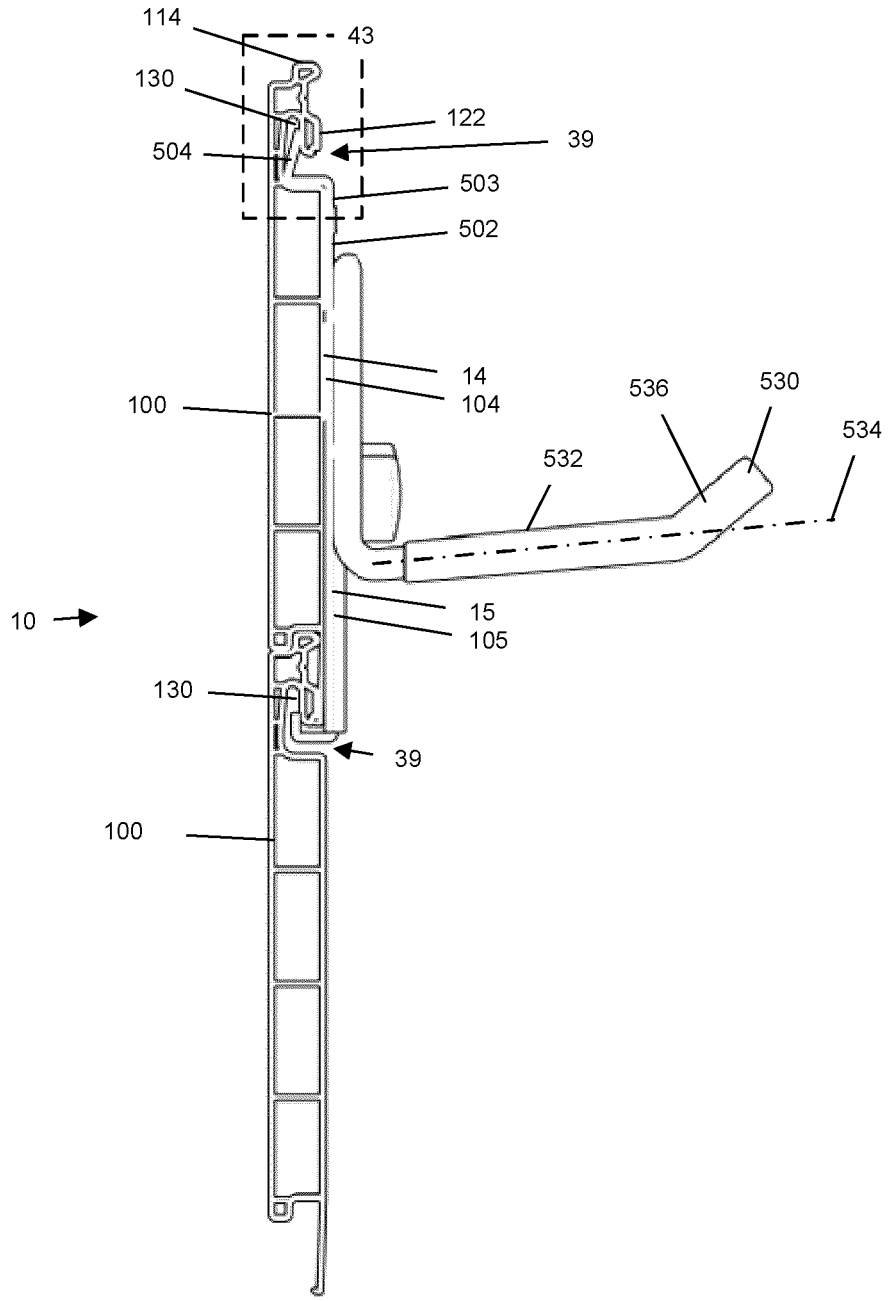
FIG. 41 is a cross-sectional view of the mounting assembly of FIG. 39 retained to a wall panel assembly.

In some embodiments, for example, the panel 100 is configured to receive and retain a mounting bracket 502. The panel 100 defines a bracket connector receiving cavity 130, as depicted in FIG. 2, for receiving a bracket connector 504 of a mounting bracket 502, and for hanging of the mounting bracket from the panel 100, as depicted in FIG. 41 and FIG. 43. In some embodiments, for example, the cavity 130 is defined by a cavity defining surface 132. In some embodiments, for example, the cavity defining surface 132 includes the outer surface 72A of the first wall 72 of the rear wall configuration 70. In some embodiments, for example, the cavity defining surface 132 includes the retaining surface 134. An example of a mounting bracket 502, that is configured for hanging from, and retention to, the panel 100 or a wall panel assembly 10, is depicted in FIG. 39 to FIG. 50. The mounting bracket 502 includes the connector 504 that is configured to co-operate with the panel 100 for retention of the bracket 502 to the panel 100, for example, the first connection counterpart 504 as depicted in FIG. 39 to FIG. 44.

As depicted in FIG. 41, the cavity 130 and the retaining surface 134, defined by the retaining surface defining configuration 122 of the panel-defined configuration 20 at the first end 101, are co-operatively configured such that, while the panel 100 is secured to a wall 1, insertion of the bracket connector 504 into the cavity 130 is with effect that the bracket connector 504 is rotated, relative to the panel 100, with effect that a retained configuration is established. In the retained configuration: 1) the bracket 502 is vertically supported by the panel 100, and the retaining surface 134 is opposing displacement of the bracket 502, relative to the panel 100, away from the wall 1, for example, in a direction that is normal to the wall 1.

As depicted in FIG. 2, in some embodiments, for example, the cavity 130 is an L-shaped cavity.

In some embodiments, for example, the connection between the first panel 100 and the second panel 100, for example, via the first connection system counterpart configuration 30 of the first panel 100 and the second connection system counterpart configuration 50 of the second panel 100, is audibly discernible. In some embodiments, for example, the snap fit engagement between the first panel 100, for example, the first connection system counterpart 110 of the first connection system 32, and the second panel 100, for example, the second connection system counterpart 158 of the first connection system 32, is audibly discernible. In some embodiments, for example, the audibly discernible sound of the connection between the first panel 100 and the second panel is effected by the displacement of the interacting portion 60 from the interference ineffective configuration to the interference ineffective configuration. In some embodiments, for example, the audibly discernible sound of the connection between the first panel 100 and the second panel is effected by impact of the first connection system counterpart configuration 30, of the first panel 100, by the second connection system counterpart configuration 50, of the second panel 100. In some embodiments, for example, the audibly discernible sound of the connection between the first panel 100 and the second panel is effected by the impact of the retaining surface defining configuration 122 by the interacting portion 60. In some embodiments, for example, the audibly discernible sound of the connection between the first panel 100 and the second panel 100 is effected by the impact of the first connection system counterpart 110 (e.g. the notch 124) of the first connection system 32, of the first panel 100, by the second connection system counterpart 158 (e.g. the projection 158) of the first connection system 32, of the second panel 100.

In some embodiments, for example, the connection of the first panel 100 and the second panel 100 is with effect that an internal space 302 is defined between the panel defined configuration 20, at the first end 101 of the first panel 100, and the panel defined configuration 40, at the second end 102 of the second panel 100. In some embodiments, for example, the panel defined configuration 20, of the first panel 100, includes a first end-defined space-defining counterpart 112, and the panel defined configuration 40, of the second panel 100, includes a second end-defined space-defining counterpart 152. While the first and second panels are connected, the first end-defined space-defining counterpart 112 and the second end-defined space-defining counterpart 152 are co-operatively configured to define the internal space 302.

The first panel 100 and the second panel 100 are co-operatively configured such that, while the first panel 100 and the second panel 100 are connected, for each one of the first panel 100 and the second panel 100, independently, the panel is secured to the wall such that displacement of the panel, relative to the wall, is resisted, and a stress is applied to the connected panels such that relative displacement between the first panel 100 and the second panel 100 (e.g. relative displacement of one of the first panel 100 the second panel 100 towards the other of the first panel 100 the second panel 100) is being urged, the internal space 302 receives deformation of at least one of the first panel 100 and the second panel 100, for example, the internal space 302 receives deformation of at least one of the second end-defined space-defining counterpart 152 of the first panel 100 and the first end-defined space-defining counterpart 112 of the second panel 100.

The receiving of the deformation of at least one of the first panel 100 and the second panel 100 in the internal space 302 is with effect that bowing of at least one of the first and second panels is mitigated.

In some embodiments, for example, the stress applied to the connected panels is effected via thermal expansion of the first panel 100 or the second panel 100.

In some embodiments, for example, the stress applied to the connected panels is effected in response to supporting of a load by the first panel 100 or the second panel 100.

In some embodiments, for example, the internal space 302 has a minimum cross-sectional area of at least 0.00097656 inches squared In some embodiments, for example, the panel defined configuration 20 of the panel 100 includes the first end-defined space-defining counterpart 112, and the panel defined configuration 40 of the panel 100 includes the second end-defined space-defining counterpart 152. In some embodiments, for example, at least a portion of the first end-defined space-defining counterpart 112 is defined by the first connection system counterpart configuration 30, and at least a portion of the second end-defined space-defining counterpart 152 is defined by the second connection system counterpart configuration 50. An end-defined space-defining counterpart of a first panel 100 and an end-defined space-defining counterpart of an adjacent panel 100 are co-operatively configured to define an internal space 302 while the first panel 100 and the adjacent panel 100 are connected. In some embodiments, for example, at least one of the plurality of ribs 108 defines the first end-defined space-defining counterpart 112. In some embodiments, for example, at least one of the plurality of ribs 108 defines the second end-defined space-defining counterpart 152.

As depicted in FIG. 2, in some embodiments, for example, the first end-defined space-defining counterpart 112 is defined by at least a portion of the projection 114.

In some embodiments, for example, the inner surface 60A of the interacting portion 60 defines at least a portion of the space-defining counterpart 152.

In some embodiments, for example, a rib 108, defining the intermediate wall 162, defines at least a portion of the second end-defined space-defining counterpart 152.

In some embodiments, for example, the second connection system counterpart 160 of the second connection system 34, for example, the wall member 161, defines at least a portion of the space-defining counterpart 152.

In some embodiments, for example, similar to the first panel 100, the second panel 100 includes a plurality of ribs 108, connecting the first side 103 to the second side 1031, and defines, at the first end 101, a first end-defined space-defining counterpart 112 of the second panel 100, and at the second end 102, a second end-defined space-defining counterpart 152 of the second panel.

In some embodiments, for example, the receiving of the deformation of at least one of the first panel 100 and the second panel 100 in the internal space 302, for example, at least one of the first end-defined space-defining counterpart 112 of the first panel 100 and the second end-defined space-defining counterpart 152 of the second panel 100 in the internal space 302, is with effect that bowing of at least one of the first and second panels is mitigated.

In some embodiments, for example, at least a portion of the first end-defined space-defining counterpart 112 is arcuate, at least a portion of the second end-defined space-defining counterpart 152 is arcuate, and, while the first and second panels are connected, the internal space 302 is defined between the arcuate portion of the first end-defined space-defining counterpart 112 of the first panel 100 and the arcuate portion of the second end-defined space-defining counterpart 152 of the second panel 100.

In some embodiments, for example, while the first panel 100 is connected to the second panel 100, there is an absence of engagement between the first end-defined space-defining counterpart 112 of the first panel and the second end-defined space-defining counterpart 152 of the second panel 100.

In some embodiments, for example, while the first panel 100 is connected to the second panel 100, at least a portion of the first end-defined space-defining counterpart 112 of the first panel 110 is engaged to at least a portion of the second end-defined space-defining counterpart 152 of the second panel 100.

In some embodiments, for example, the panel 100 comprises a guide surface 136. The guide surface 136 is configured to facilitate retention the bracket to the panel 100, for example, by facilitating rotation of the bracket connector relative to the panel 100 while the bracket connector is disposed in the cavity 130. In some embodiments, for example, as depicted in FIG. 2, the panel 100 includes a wall member 141 that extends rearwardly from the front facing wall 14, and connecting the front facing wall 14 and the first wall 72 of the rear wall configuration 70. The wall member 141 includes a wall portion 143 that has an arcuate wall surface 145. In some embodiments, for example, the guiding surface 136 is defined by the arcuate wall surface 145.

The cavity 130, the guide surface 136, and the retaining surface 134 are co-operatively configured such that, while the panel 100 is secured to the mounting wall 1 and the bracket connector 504 is being inserted into the cavity 130, the guide surface 136 engages the bracket connector 504 with effect that the connector 504 is rotated, relative to the panel 100, such that movement of the bracket connector 504, within the cavity 130, is directed, with effect that the retained configuration is established.

In some embodiments, for example, the bracket 500 is displaced towards the panel 100 to insert the bracket connector into the cavity 130.

In some embodiments, for example, the minimum rotation of the connector 504 effected by the guide surface 136 is at least 30 degrees.

In some embodiments, for example, while the connector 504 is engaged with the guide surface 136, in response to further displacement of the mounting bracket towards the panel 100, a force is applied by the guide surface 136 to the connector 504, with effect that the connector 504 is rotated, relative to the panel 100, such that movement of the bracket connector, within the cavity 130, is directed, with effect that the retained configuration is established.

In some embodiments, for example, the rotation of the connector 504, relative to the panel 100, that is effected by the guide surface 136, is such that movement of the bracket connector 504, within the cavity 130, is directed further into the cavity 130.

In some embodiments, for example, the guide surface 136 has an arcuate surface portion. The arcuate surface portion of the guide surface 136 has a minimum radius of curvature of at least 1/16 inches.

In some embodiments, for example, as depicted in FIG. 2, the cavity 130 is defined by the cavity-defining surface 132, and the cavity-defining surface 132 includes the guide surface 136.

In some embodiments, for example, the cavity-defining surface 132 includes an end surface 138 (defined by the outermost surface 72A of the first wall 72 of the rear wall configuration 70), a rounded surface 140 extending between the retaining surface 134 and the end surface 138, and a supporting surface 142.

In some embodiments, for example, the rounded surface 140 is disposed between the retaining surface 134 and the end surface 138, to facilitate extrusion of the panel 100 and to improve strength of the cavity 130. In some embodiments, for example, the rounded surface 140 has a minimum radius of curvature of at least 1/16 inches.

In some embodiments, for example, the supporting surface 142 is configured to vertically support the bracket while the bracket connector is disposed in the cavity 130. In some embodiments, for example, the supporting surface 142 is defined by the outer surface of the wall member 141. In some embodiments, for example, while the panel 100 is connected to the wall and the bracket is retained to the panel 100, the bracket connector 504 is engaged with the supporting surface 142, for example, seated against the supporting surface 142, while the supporting surface 142 is vertically supporting the bracket.

In some embodiments, for example, the end surface 138 is angled relative to the supporting surface 142, for example, to facilitate extrusion of the panel 100, and to increase strength of the cavity 130. The end surface 138 defines a perpendicular axis 138A, the supporting surface defines a perpendicular axis 142A, and the acute angle defined between the perpendicular axis 138A and the perpendicular axis 142A has a maximum value of 87 degrees.

In some embodiments, for example, the cavity 130 includes a counterpart receiving portion 144 and a counterpart retaining portion 146. The counterpart-receiving portion 144 is configured to receive the bracket connector 504, and to enable rotation of the bracket while the bracket connector 504 is disposed in the counterpart-receiving portion 144.

In some embodiments, for example, the counterpart-receiving portion 144 is defined by at least a portion of the end surface 138, the guide surface 136, and the supporting surface 142. The counterpart-retaining portion 146 is configured to retain the mounting bracket 502 to the panel 100 while the bracket connector 504 is disposed in the counterpart-retaining portion 146. In some embodiments, for example, the counterpart-retaining portion 146 is defined by at least a portion of the end surface 138, the rounded surface 140, and the retaining surface 134. While the bracket connector 504 is disposed in the counterpart-retaining portion 146, the bracket connector 504 is bearing against the guiding surface 136 and the retaining surface 134, as depicted in FIG. 43, such that the tolerance between the bracket connector 504, the end surface 138, the rounded surface 140, and the retaining surface 134 is such that displacement of the bracket connector 504, and thus, the bracket 502, is substantially limited. The substantially limited displacement of the bracket connector 504, and thus, the bracket 502, results in less wear and tear on the bracket 502, and less displacement of a load that is supported by the bracket.

In some embodiments, for example, the counterpart-receiving portion 144 is wider than the counterpart-retaining portion 146, such that the bracket connector 504 is rotatable while disposed in the counterpart-receiving portion 144, and that displacement of the bracket connector 504 is limited, such that the bracket connector 504 is retainable to the panel 100, while disposed in the counterpart-retaining portion 146.

In some embodiments, for example, the spacing distance between the rounded surface 140 and the supporting surface 142 is such that the bracket connector is receivable and retainable in the cavity 130. In some embodiments, for example, the minimum spacing distance between the rounded surface 140 and the supporting surface 142 is at least 5/8 inches.

Figure 42:
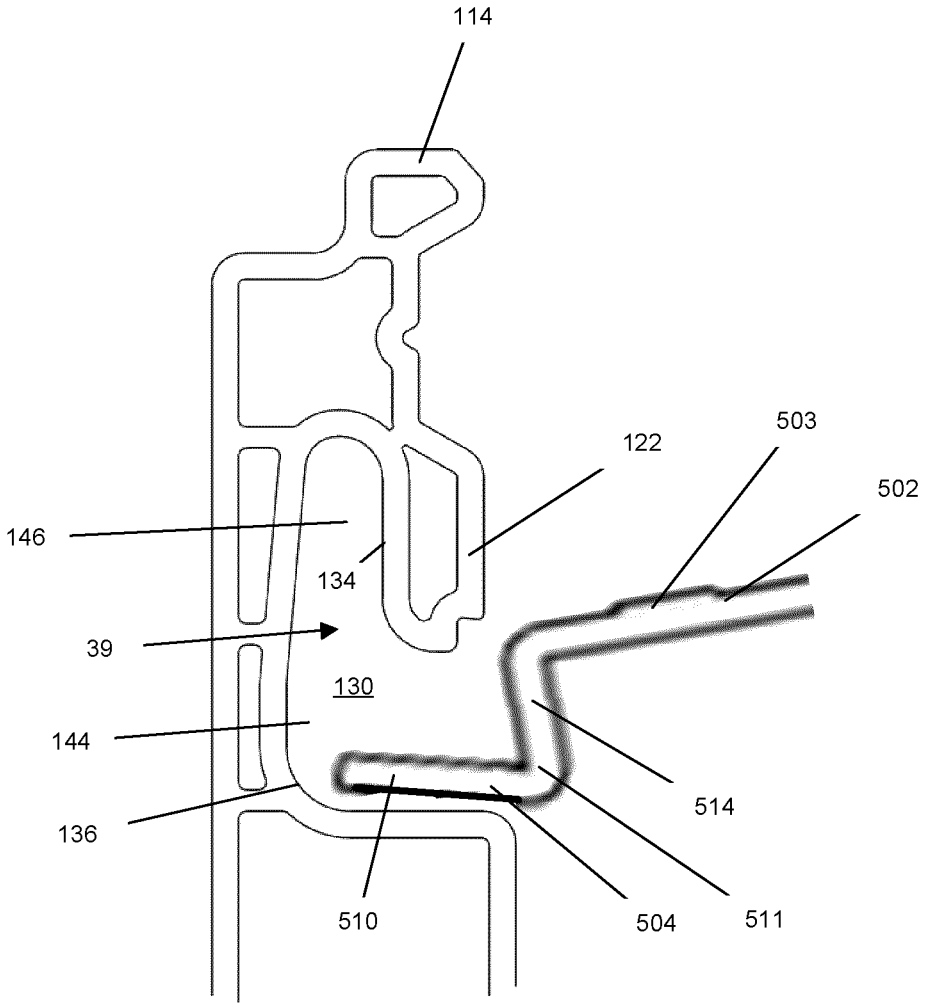
FIG. 42 is a cross-sectional view of a bracket connector of a bracket being inserted into a cavity of a wall panel assembly.
Figure 43:
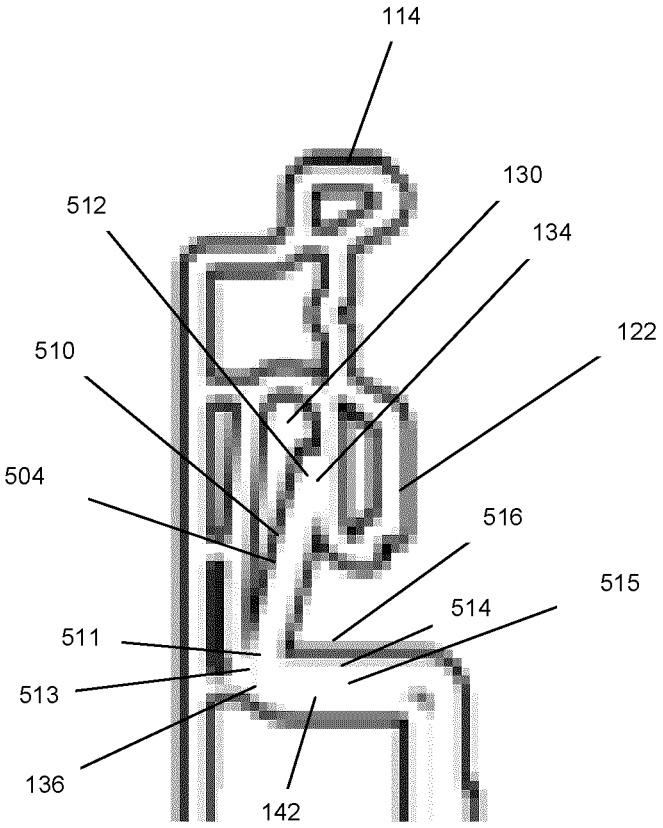
FIG. 43 is an enlarged view of the mounting assembly and wall panel assembly of FIG. 41, the portion identified by window 43 in FIG. 41.

To retain the bracket to the panel 100, the bracket connector 504 is inserted into the counterpart-receiving portion 144 of the cavity 130, as depicted in FIG. 42. In some embodiments, for example, the direction of insertion of the bracket connector 504 into the counterpart-receiving portion 144 is parallel to the perpendicular axis of the outermost surface 104. The bracket connector 504 is displaced further into the counterpart-receiving portion 144 until the bracket connector 504 is engaged with the guide surface 136, as depicted in FIG. 42. In response to a force applied to the bracket connector 504 to further displace the bracket connector 504 into the counterpart-receiving portion 144, the guide surface 136 applies a reaction force to the bracket connector 504, with effect that the connector 504 is rotated relative to the panel 100, such that the connector 504 is disposed further in the cavity 130, for example, in the counterpart retaining portion 146, and disposed in opposing relationship to the retaining surface 134. At this point, the bracket 502 is disposed in the retained configuration, as depicted in FIG. 41 and FIG. 43. In some embodiments, for example, at this point, the bracket 502 is hanging from the panel 100. In some embodiments, for example, the retaining and hanging of the bracket 502 from the panel 100 is effected without the use of fasteners, for example, mechanical fasteners. In some embodiments, for example, while the bracket 502 is hung from the panel 100, the bracket is vertically supported by the panel 100, and displacement of the bracket, relative to the panel 100, in a direction that is normal to the an outermost surface of the panel 100, is opposed.

To release the bracket 502 from retention of the panel 100, the bracket connector 504 is rotated in a direction opposite the direction for retaining the bracket 502 to the panel 100, such that there is an absence of disposition of the bracket connector 504 in opposing relationship to the retaining surface 134. At this point, the bracket connector 504 is displaced away from the panel 100 until the bracket connector 504 is disposed outside the cavity 130.

In some embodiments, for example, the structure of the cavity 130 is configured such that the panel 100 is able to support a heavier load that is mounted to a bracket 502 that is retained to the panel 100 via the cavity 130. In this respect, the load bearing capacity of the cavity 130 is increased.

In some embodiments, for example, as depicted in FIG. 2, to increase the load bearing capacity of the cavity 130, the panel 100 includes a wall member 141 that extends rearwardly from the front facing wall 14, and connecting the front facing wall 14 and the first wall 72 of the rear wall configuration 70. The wall member 141 includes a wall portion 143 that has an arcuate wall surface 145. The arcuate wall surface 145 has a radius of curvature having a minimum value of at least 1/16 inches. In some embodiments, for example the cavity defining surface 132 includes the arcuate wall surface 145 of the wall member 141.

In some embodiments, for example, while the retained configuration is established, in response to mounting of a load to the bracket 502, a displacement-urging force is applied by the bracket connector 504 to the retaining surface 134, with effect that rotation of a rotation-urgable portion of the panel 100, in a direction away from the rear facing wall 16, is urged. In some embodiments, for example, the rotation of a rotation-urgable portion of the panel 100, in a direction away from the rear facing wall 16, is resisted, by the wall portion 143. In some embodiments, for example, the resistance to the rotation of a rotation-urgable portion of the panel 100, in a direction away from the rear facing wall 16, is due to the arcuate wall surface 145 having a radius of curvature having a minimum value of at least 1/16 inches.

In some embodiments, for example, the rotation-urgable portion includes the retaining surface defining configuration 122.

In some embodiments, for example, the displacement-urging force has a maximum value of 300 pounds. In some embodiments, for example, the displacement-urging force has a maximum value of 300 pounds per linear foot of the panel 100 (e.g. measured along the axis 2).

In some embodiments, for example, as depicted in FIG. 2, to increase the load bearing capacity of the cavity 130, the first wall 72 and the second wall 74 of the rear wall configuration 70 are configured such that the first wall 72 and the second wall 74 are disposed in a non-parallel relationship.

In some embodiments, for example, while the retained configuration is established, in response to mounting of a load to the bracket 502, a displacement-urging force is applied by the bracket connector 504 to the retaining surface 134, with effect that displacement of the retaining surface-defining configuration 122, in the direction away from the mounting wall, is urged, In some embodiments, for example, the first wall 72 and the second wall 74 of the rear wall configuration 70 are co-operatively configured such that the displacement of the retaining surface-defining configuration 122, in the direction away from the mounting wall 1, is resisted. In some embodiments, for example, relative to a rear wall configuration wherein a first wall and a second wall are disposed in a parallel relationship, the ability of the first wall 72 and the second wall 74, of the rear wall configuration 70, wherein the first wall 72 and the second wall 74 are disposed in the non-parallel relationship, to resist the displacement of the retaining surface-defining configuration 122, in the direction away from the mounting wall, is increased, due to the non-parallel relationship between the first wall 72 and the second wall 74.

In some embodiments, for example, while the retained configuration is established, in response to mounting of the load to the bracket 502, the displacement-urging force is applied by the bracket connector 504 to the retaining surface 122, with effect that bending of the rear wall configuration 70, in a direction away from the mounting wall 1, is urged. In some embodiments, for example, the first wall 72 and the second wall 74 of the rear wall configuration 70 are co-operatively configured such that the bending of the rear wall configuration 70, in the direction away from the mounting wall 1, is resisted. In some embodiments, for example, relative to a rear wall configuration wherein a first wall and a second wall are disposed in a parallel relationship, the ability of the first wall 72 and the second wall 74, of the rear wall configuration 70, wherein the first wall 72 and the second wall 74 are disposed in the non-parallel relationship, to resist the bending of the rear wall configuration 70, in the direction away from the mounting wall 1, is increased, due to the non-parallel relationship between the first wall 72 and the second wall 74.

In some embodiments, for example, the front-facing surface 72A defines a normal axis 138A, the rear-facing surface 74A defines a normal axis 138B, as depicted in FIG. 2, and an acute angle defined between the normal axis 138A of the front-facing surface 72A and the normal axis 138B of the rear-facing surface 74A has a minimum value of at least 3 degrees.

In some embodiments, for example, the displacement-urging force has a maximum value of 300 pounds. In some embodiments, for example, the displacement-urging force has a maximum value of 300 pounds per linear foot of the panel 100 (e.g. measured along the axis 2).

In some embodiments, for example, as depicted in FIG. 2, the disposition of the first wall 72 and the rear wall 74 of the rear wall configuration 70 in the non-parallel relationship is such that the first wall 72 extends from the wall covering portion 12 towards the fastener receiving portion 116 in a direction away from the second wall 74. In some embodiments, for example, as depicted in FIG. 2, the disposition of the first wall 72 and the rear wall 74 of the rear wall configuration 70 in the non-parallel relationship is such that the first wall 72 extends from the wall covering portion 12 in a direction towards the front side of the panel 100.

In some embodiments, for example, as depicted in FIG. 2, to increase the load bearing capacity of the cavity 130, the panel 100 includes a wall member 147, connecting the retaining surface-defining wall 123 of the retaining surface defining configuration 122 and the first wall 72 of the rearwall configuration 70. The wall 147 member includes a wall portion 148 including an arcuate wall surface 149. In some embodiments, for example, the cavity defining surface 132 includes the arcuate wall surface 149 of the wall portion 148. In some embodiments, for example, the arcuate wall surface 149 defines the rounded surface 140.

In some embodiments, for example, while the retained configuration is established, in response to mounting of a load to the bracket 502, a displacement-urging force is applied by the bracket connector 504 to the retaining surface 134, with effect that displacement of the retaining surface-defining configuration 122, in the direction away from the mounting wall 1, is urged. In some embodiments, for example, the displacement of the retaining surface-defining configuration 122, away from the mounting wall 1, is resisted, by the wall portion 148. In some embodiments, for example, relative to a wall member that extends between the retaining surface defining wall 123 and the first wall 72 of the rear wall configuration that is absent an arcuate wall surface (e.g. a planar wall member), the ability of the wall portion 148, wherein the wall portion 148 includes the arcuate wall surface 149, to resist the displacement of the retaining surface-defining configuration 122, in the direction away from the mounting wall 1, is increased, due to the arcuate wall surface 149.

In some embodiments, for example, the displacement-urging force has a maximum value of 300 pounds. In some embodiments, for example, the displacement-urging force has a maximum value of 300 pounds per linear foot of the panel 100 (e.g. measured along the axis 2).

In some embodiments, for example, as depicted in FIG. 2, the retaining surface-defining configuration 122 is connected to the fastener-receiving portion 116. In some embodiments, for example, while the retained configuration is established, in response to mounting of the load to the bracket 502, the displacement-urging force is applied by the bracket connector 504 to the retaining surface 134, with effect that rotation of the retaining surface-defining configuration 122, relative to the fastener-receiving portion 116, in a direction away from the wall 1, is urged. In some embodiments, for example, the rotation of the retaining surface-defining configuration 122, relative to the fastener-receiving portion 116, in the direction away from the wall 1, is resisted by the wall portion 148. In some embodiments, for example, relative to a wall member that extends between the retaining surface defining wall 123 and the first wall 72 of the rear wall configuration that is absent an arcuate wall surface (e.g. a planar wall member), the ability of the wall portion 148, wherein the wall portion 148 includes the arcuate wall surface 149, to resist the rotation of the retaining surface-defining configuration 122, relative to the fastener-receiving portion 116, in the direction away from the mounting wall 1, is increased, due to the arcuate wall surface 149.

In some embodiments, for example, as depicted in FIG. 2, the wall member 147 is an arcuate wall member, the wall portion 148 is defined by a portion of the arcuate wall member, and the arcuate wall surface 147 of the wall portion 148 is defined by an arcuate wall surface of the arcuate wall member.

In some embodiments, for example, the wall member 147 defines a terminal end of the cavity 130.

In some embodiments, for example, with respect to existing slat wall panels, said slat wall panels are secured to a mounting wall 1 via fasteners that is received through a fastener receiving portion, and also via fasteners that are received through a cavity for receiving a bracket connector to retain a bracket to the panel. The additional fasteners through the cavity are needed to secure the panel to the wall while a bracket is retained to the panel and a load is mounted to the bracket. In some embodiments, for example, the industry standard width of an opening of the cavity of existing slat wall panels is 0.390 inches. The industry standard width is based on the width of the head of common fasteners (e.g. No. 8 or No. 10 head fasteners) used to secure existing slat wall panels to the wall. The width of the opening of the cavity of existing slat wall panels has to be sufficiently wide to provide clearance for the head of the fastener. In some embodiments, for example, due to the structural features of the cavity 130 that increase the load bearing capacity of the cavity 130, the width of the opening of the cavity 130 can be reduced from the industry standard of 0.390 inches to, for example, 0.300 inches. By reducing the width of the opening of the cavity 130, the minimum spacing distance from the fastener receiving portion 116 and the cavity 130, for example, between the fastener locator 120 and the wall member 141, is reduced, which is desirable, as the minimum spacing distance from the fastener, while the fastener is received in the fastener receiving portion 116, and the bracket 502, is reduced, while the retained configuration is established. By reducing the distance between the fastener and the bracket 502, the panel 100 is less susceptible to deformation, for example, bending, while the bracket 502 is loaded, as the fastener opposes more of the load that is supported by the bracket 502.

In some embodiments, for example, the minimum spacing distance between the fastener locator 120 and the wall member 141 is 0.750 inches.

In some embodiments, for example, it is desirable to resist the transition of the projection 114 from the relative movement-effective configuration, as depicted in FIG. 5A, to the connection prevention configuration, as depicted in FIG. 5B, because, while the projection 114 is disposed in the connection prevention configuration, the projection 114 of the first panel 100 and the interacting portion 60 of the second panel 100 are disposed in the relative movement interference relationship, as depicted in FIG. 12, wherein interference, to relative movement, of the second panel 100 towards the first panel 100, by the projection 114 of the first panel 100, is established, such that the displaceability of the second connection system counterpart 158 (e.g. the rearward projection 158) of the first connection system counterpart 32, of the second panel 100, past the projection 114 of the first panel and towards the first connection system counterpart 110 (e.g. the notch 124) of the first connection system 32, of the first panel 100, to effect the snap fit connection between the first connection system counterpart 110 (e.g. the notch 124) of the first connection system 32, of the first panel 100, and the second connection system counterpart 158 (e.g. the rearward projection 158) of the first connection system 32, of the second panel 100, is resisted.

In this respect, in some embodiments, for example, the projection 114 is connected to the residual panel portion about a first joint 170 and a second joint 172, as depicted in FIG. 2, and the panel 100 further includes a wall member 174 that extends between the first joint 170 and the second joint 172. In some embodiments, for example, the first joint 170 is disposed forwardly of the second joint 172, In some embodiments, for example, the projection 114 includes a wall member 1141 and a wall member 1142. As depicted in FIG. 2, the wall member 1141 is disposed forwardly of the wall member 1142. In some embodiments, for example, the wall member 1141 is connected to a wall member of the residual panel portion, for example, the wall member 119, at the joint 170. In some embodiments, for example, the wall member 1142 is connected to another wall member of the residual panel portion, for example, a wall member 1191, which is a wall member of the fastener receiving portion 116 that is disposed rearwardly of the wall member 119, at the joint 172.

In some embodiments, for example, while: (i) the projection 114 of the first panel 100 is disposed in the relative movement-effective configuration, as depicted in FIG. 5A, (ii) the interacting portion 60 of the second panel 100 is disposed in the pre-deformation configuration, and (iii) the projection 114 and the interacting portion 60 are disposed in contact engagement, in response to displacement of the second panel 100 towards the first panel 100, a force is applied, by the interacting portion 60, with effect that deflection or deformation to the projection 114, is urged. In some embodiments, for example, said deflection or deformation being urged is effectible for the transitioning the projection 114 to the connection prevention configuration.

In some embodiments, for example, the first joint 170, the second joint 172, and the wall member 174 are co-operatively configured such that deformation or deflection of the projection 114, to the connection prevention configuration, is resisted, such that, in response to the force, applied by the interacting portion 60, to the projection 114, a reaction force is applied by the projection to the interacting portion 60, with effect that the interacting portion 60 is deformed or deflected, such that that:

- the interacting portion 60 is transitioned from the pre-deformation configuration to the interference-ineffective configuration; and
- the projection 114 and the interacting portion 60 become disposed in the relative movement effectible relationship.

At this point, in response to further displacement of the second panel 100 to towards the first panel 100, the connection system counterpart 158 of the first connection system 32, of the second panel 100, is displaced, past the projection 114 and towards the connection system counterpart 110 of the first connection system 32, of the first panel 100, to align the connection system counterpart 158 and the connection system counterpart 110 of the first connection system 32, with effect that the snap fit connection between the connection system counterpart 110 and the connection system counterpart 158 of the first connection system 32, is established.

In some embodiments, for example, the force applied by the interacting portion 60, to the projection 114, urges the projection 114 to deform or deflect for effecting transitioning of the projection 114 from the relative movement effective configuration to the connection prevention configuration, wherein the transitioning includes a forwardly displacement of the projection 114, relative to the residual panel portion, about the first joint 170 and the second joint 172. In some embodiments, for example, the forwardly displacement of the projection 114, relative to the residual panel portion, about the first and second joints 170, 172, for effecting transitioning of the projection 114 from the relative movement-effective configuration to the connection prevention configuration, includes rotation of the projection 114, relative to the residual panel portion, about the first and second joints 170, 172.

In some embodiments, for example, the wall member 174 has a width 174W having a minimum value of at least 0.030 inches.

In some embodiments, for example, a minimum spacing distance between the first joint 170 and the second joint 172 has a minimum value of at least 0.030 inches.

In some embodiments, for example, it is desirable to have a rear wall configuration 70 with a first wall 72 and a second wall 74, rather than just one wall, as it improves the strength of the rear wall configuration 70. It is also easier to manufacture, as two vacuums, disposed in opposing relationship, can be used for manufacturing the rear wall configuration 70, for example, via extrusion.

Figure 14:
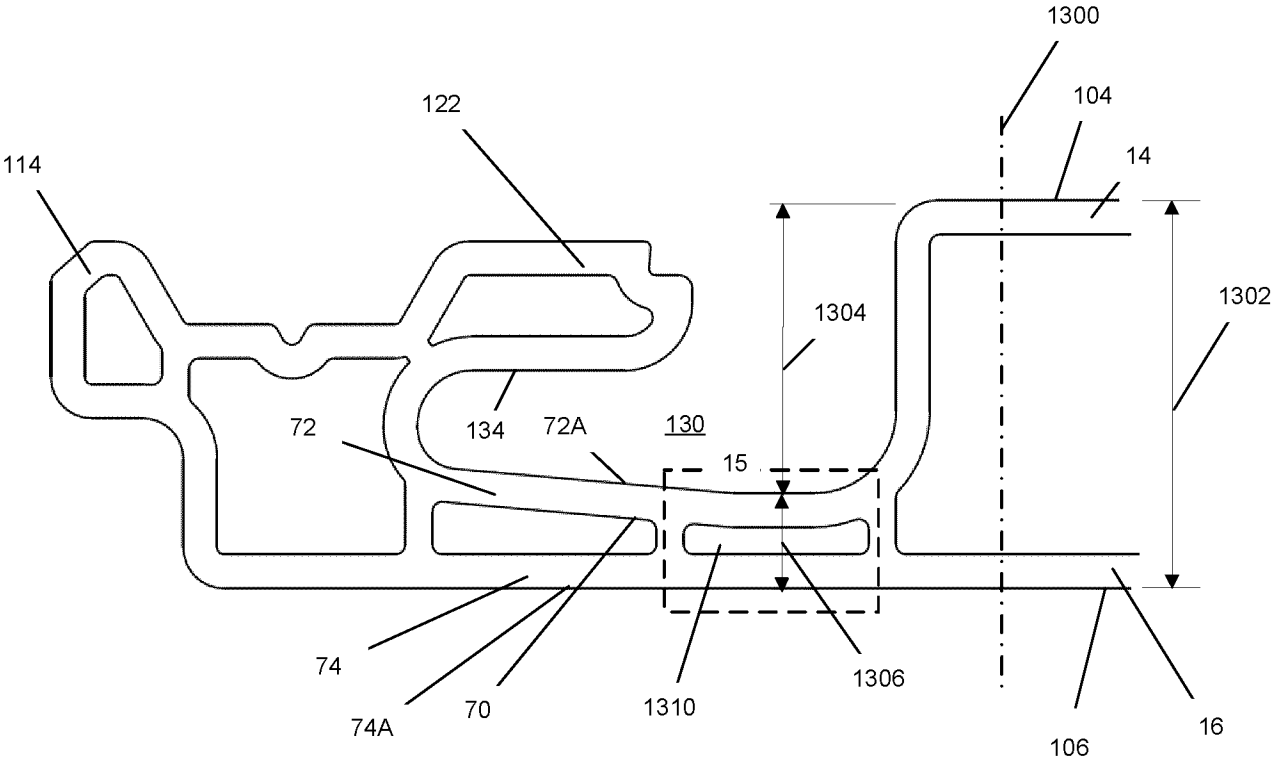
FIG. 14 is another enlarged view of a portion of the panel of FIG. 1, the portion of the panel identified by window 2 in FIG. 1.

The thickness of the panel 100 is defined along a thickness axis 1300. As depicted in FIG. 14, the thickness axis 1300 is perpendicular to the rear facing surface 16 of the panel 100. It is desirable to reduce to the thickness of the panel 100, as it reduces the amount of material required to manufacture the panel 100, and increases the number of panels 100 that can be transported within a shipping unit (e.g. a box, shipping container, and the like). In some embodiments, for example, the thickness of the panel 100 is defined by the thickness of the wall covering portion 12, which is defined by the minimum spacing distance between the front facing surface 104 and the rear facing surface 106 taken along the axis 1300. As depicted in FIG. 14, the thickness 1302 of the wall covering portion 12 is defined by the sum of: 1) the depth 1304 of the cavity 130, defined along an axis that is parallel to the thickness axis 1300, and 2) the minimum spacing distance 1306 between the outer surface 72A of the first wall 72 and the outer surface 74A of the second wall 74 of the rear wall configuration 70, defined along an axis that is parallel to the thickness axis 1300. The depth 1304 of the cavity 130 is a set value that is based on the configuration of the bracket connector 504. In some embodiments, for example, the depth 1304 of the cavity 130 is defined by the depth of the counterpart receiving portion 144 of the cavity 130. Accordingly, in some embodiments, for example, it is desirable to reduce the minimum spacing distance 1306 between the first and second walls 72, 74, such that the thickness 1302 of the wall covering portion 12 is reduced, such that the While it is desirable to reduce the thickness 1302 of the panel 100, it is also desirable to be able to manufacture said panel 100 efficiently, for example, via extrusion, without damage to the manufacturing tools.

Figure 15:
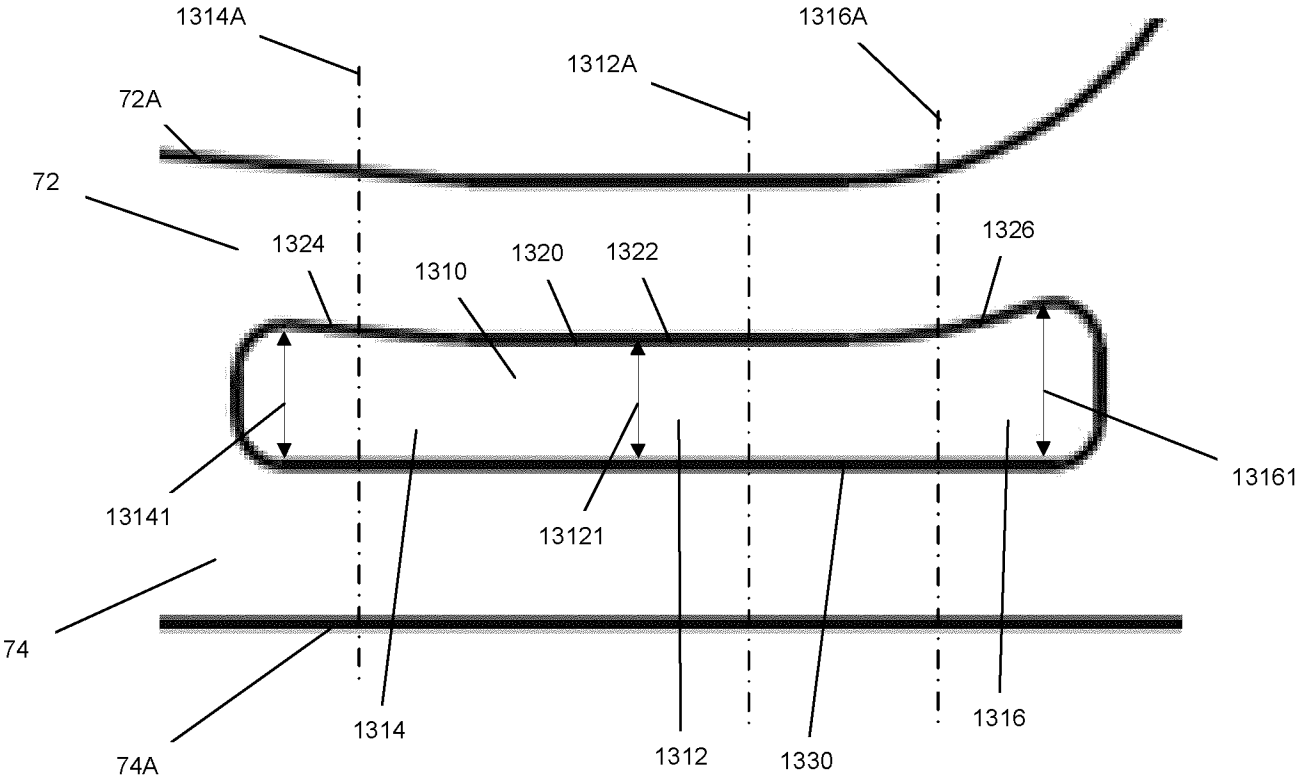
FIG. 15 is an enlarged view of a portion of the panel of FIG. 14, the portion of the panel identified by window 15 in FIG. 14.

In this respect, in some embodiments, for example, as depicted in FIG. 14 and FIG. 15, the rear wall configuration 70 is configured such that an internal cavity 1310 is defined between the first wall 72 and the second wall 74 of the rear wall configuration 70. In some embodiments, for example, the internal cavity 1310 includes an intermediate narrow portion 1312 disposed between a first wider end portion 1314 and a second wider end portion 1316.

In some embodiments, for example, the cross-section of the internal cavity 1310 corresponds to the cross-section of a metal block of a die used to define the internal cavity 1310 while the panel 100 is manufactured, for example, via extrusion. Accordingly, similar to the internal cavity 1310, the metal block includes an intermediate narrow portion disposed between a first wider end portion and a second wider end portion. By having wider first and second end portions, the structure of the metal block is stronger, relative to, for example, a metal block that has a rectangular cross-section, such that the metal block requires less maintenance, repair, or replacement, while still having a an intermediate narrow portion that defines a minimum thickness of the metal block.

In some embodiments, for example, a width 13121 of the intermediate narrow portion 1312 of the internal cavity 1310, measured along an axis 1312A that is parallel to the thickness axis 1300, is less than a width 13141 of the first wider end portion 1314, measured along an axis 1314A that is parallel to the thickness axis 1300, and also less than a width 13161 of the second wider end portion 1316, measured along an axis 1316A that is parallel to the thickness axis 1300.

In some embodiments, for example, the width 13121 of the intermediate narrow portion 1312 has a minimum value of at least 0.030 inches.

In some embodiments, for example, the width 13141 of the first wider end portion 1314 is greater than the width 13121 of the intermediate portion 1312. The width 13141 of the depicted first end portion 1314 has a maximum value of 0.065 inches, but can be greater than 0.065 inches.

In some embodiments, for example, the width 13161 of the second wider end portion 1316 is greater than the width 13121 of the intermediate portion 1312. The width 13161 of the depicted second end portion 1316 has a maximum value of 0.080 inches, but can be greater than 0.080 inches.

In some embodiments, for example, the first wall 72 of the rear wall configuration 70 includes a first wall-defined cavity defining surface 1320, which is an inner surface of the first wall 72, which is disposed on an opposite side of the first wall 72 relative to the outer surface 72A. In some embodiments, for example, the second wall 74 of the rear wall configuration 70 includes a second wall-defined cavity defining surface 1330, which is an inner surface of the second wall 74, which is disposed on an opposite of the second wall 74 relative to the outer surface 74A. As depicted in FIG. 15, the internal cavity 1310 is defined between the first wall-defined cavity defining surface 1320 and the second wall-defined cavity defining surface 1330.

In some embodiments, for example, the first wall-defined cavity defining surface 1320 includes: 1), a first surface portion 1324, a second surface portion 1326, and a minimum spacing-defining surface portion 1322 disposed between the first surface portion 1324 and the surface portion 1326. In some embodiments, for example, the intermediate portion 1312 of the internal cavity is defined between the minimum spacing-defining surface portion 1322 and the second wall-defined cavity defining surface 1330. In some embodiments, for example, the first end portion 1314 of the internal cavity 1310 is defined between the first surface portion 1324 of the first wall-defined cavity defining surface 1320 and the second wall-defined cavity defining surface 1330. In some embodiments, for example, the second end portion 1316 of the internal cavity 1310 is defined between the second surface portion 1326 of the first wall-defined cavity defining surface 1320 and the second wall-defined cavity defining surface 1330.

In some embodiments, for example, a minimum spacing distance between the first and second walls 72, 74 of the rear wall configuration 70 is defined between the minimum spacing-defining surface portion 1322 and the rear wall-defined cavity defining surface 1330.

In some embodiments, for example, the minimum spacing distance between the first and second walls 72, 74 of the rear wall configuration 70, defined between the minimum spacing-defining surface portion 1322 and the second wall-defined cavity defining surface 1330, has a minimum value of at least 0.030 inches.

In some embodiments, for example, at last one of the first surface portion 1324 and the second surface portion 1326 of the first wall-defined cavity defining surface 1320 is a planar surface. In some embodiments, for example, each one of the first surface portion 1324 and the second surface portion 1326 of the first wall-defined cavity defining surface 1320, independently, is a planar surface.

In some embodiments, for example, at last one of the first surface portion 1324 and the second surface portion 1326 of the front wall-defined cavity defining surface 1320 is an arcuate surface. In some embodiments, for example, each one of the first surface portion 1324 and the second surface portion 1326 of the first wall-defined cavity defining surface 1320, independently, is an arcuate surface.

In some embodiments, for example, the first surface portion 1324 is a planar surface, and the second surface portion 1326 is an arcuate surface.

In some embodiments, for example, the second wall-defined cavity defining surface 1330 is a planar surface.

In some embodiments, for example, the second wall-defined cavity-defining surface 1330 and the minimum spacing-defining surface portion 1322 of the first wall-defined cavity defining surface 1320 are disposed in a parallel relationship.

In some embodiments, for example, the configuration of the internal cavity 1310 minimizes the thickness of the panel, for example, minimizes the thickness 1302 of the wall covering portion 12, which reduces the amount of material required to manufacture the panel 100, and increases the number of panels 100 that can be transported within a shipping unit.

In some embodiments, for example, the configuration of the internal cavity 1310 minimizes the thickness of the fastener-receiving portion 116. By reducing the thickness of the fastener-receiving portion 116, the securing of the panel 100 by a fastener that penetrates through the fastener-receiving portion 116 is improved.

In some embodiments, for example, it is desirable for the interacting portion 60 to be resiliently deformable or resiliently displaceable between: 1) the pre-deformation configuration, 2) the interference effective configuration, and 3) the interference ineffective configuration. In this respect, in some embodiments, for example, the intermediate wall 162 has to have sufficient width, such that the intermediate wall 162 has sufficient material to extend and retract for effectuating the transition of the interacting portion 60 between the configurations. Otherwise, the intermediate wall of insufficient width has insufficient material for extension or retraction, such that the intermediate wall interferes with the transition of the interacting portion 60 between the configurations.

In this respect, in some embodiments, for example, as depicted in FIG. 2, the intermediate wall 162 has a width 162W having a minimum value of at least 0.080 inches.

In some embodiments, for example, a ratio of the width 60W of the interacting portion 60 and the width 162W of the intermediate wall 162 has a value of 4.6875:1.

In some embodiments, for example, the resilience of the interacting portion 60, for effecting the resilient deformation of the interacting portion 60 between: 1) the pre-deformation configuration, 2) the interference effective configuration, and 3) the interference ineffective configuration, is effected by the width of the intermediate wall 162 having the minimum value of at least 0.080 inches.

Figure 16:
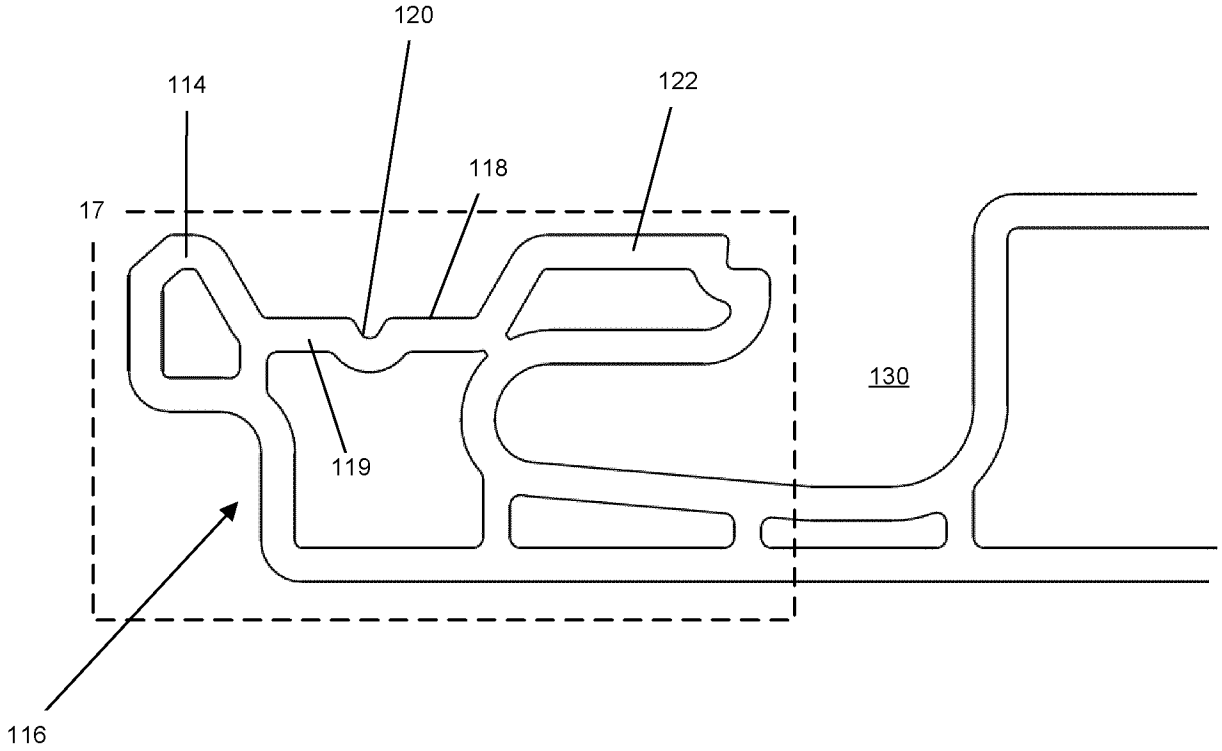
FIG. 16 is another enlarged view of a portion of the panel of FIG. 1, the portion of the panel identified by window 2 in FIG. 1.

As described herein, to secure the panel 100 to a mounting wall 1 via a fastener, the panel 100 is disposed in abutting engagement with the wall 1, the fastener is emplaced in the fastener effective position by the fastener locator 120, which is defined by the panel member 119, as depicted in FIG. 16, and then is penetrated through the fastener receiving portion 116, and into the wall 1. It is desirable for the fastener to be gripped and retained by the panel member 119 while the fastener is penetrated through the fastener retaining portion 116, to increase the reliability of the securing of the panel 100 to the wall 1.

Figure 17:
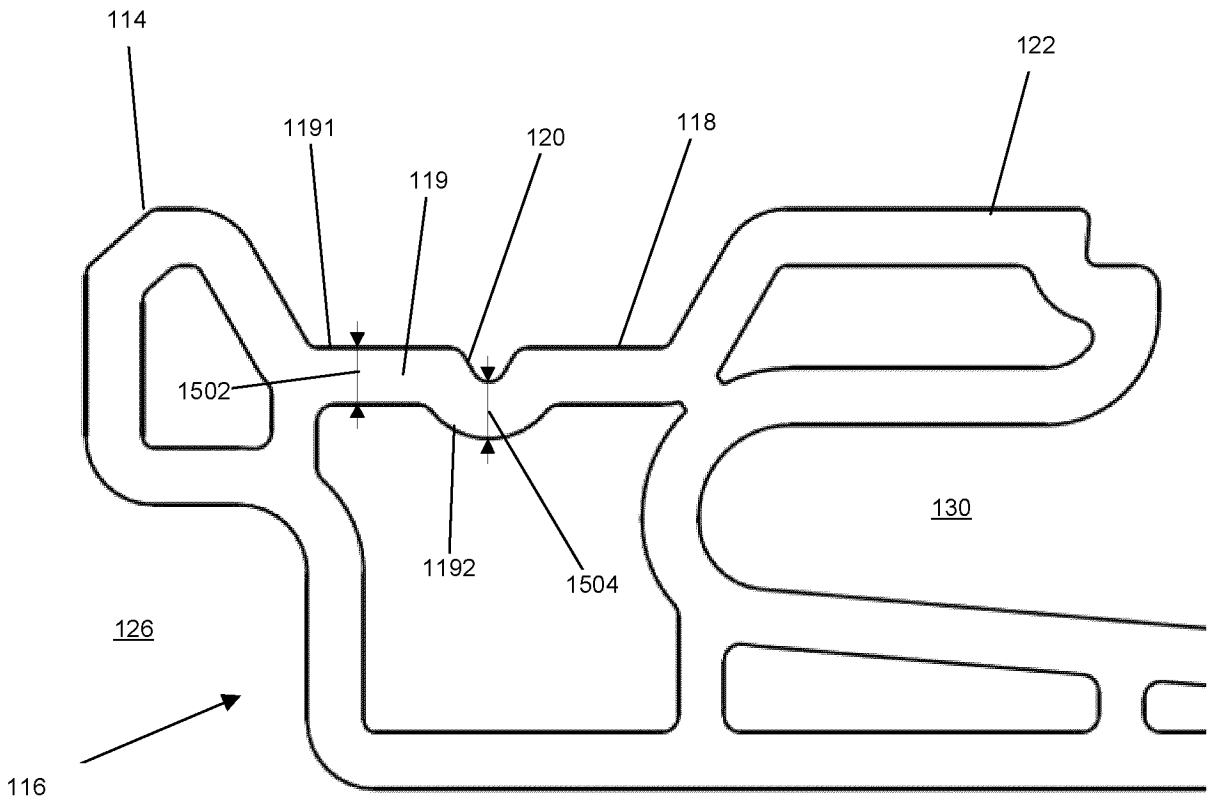
FIG. 17 is an enlarged view of a portion of the panel of FIG. 16, the portion of the panel identified by window 17 in FIG. 16.

In this respect, in some embodiments, for example, as depicted in FIG. 17, the panel member 119 includes a first side surface 1191 and a second side surface 1192 that is disposed on an opposite side of the panel member 119, relative to the first side surface 1191. In some embodiments, for example, the thickness 1502 of the panel member 119 is defined by the minimum spacing distance between the first side surface 1191 and the second side surface 1192. In some embodiments, for example, the thickness 1502 of the panel member 119 is defined along an axis that is parallel to the thickness axis 1300. In some embodiments, for example, the fastener guide 120 is defined by a groove defined within the first side surface 1191 of the panel member 119.

In some embodiments, for example, a minimum spacing distance 1504 between the groove 120 and the second side surface 1192 has a minimum value of at least 90% of the thickness 1502 of the panel member 119. In some embodiments, for example, the minimum spacing distance 1504 between the groove 120 and the second side surface 1192 is defined along an axis that is parallel to the thickness axis 1300. In some embodiments, for example, the minimum spacing distance 1504 between the groove 120 and the second side surface 1192 is defined along an axis that is non-parallel relative to the thickness axis 1300. In some embodiments, for example, due to the minimum spacing distance 1504 between the groove 120 and the second side surface 1192 having a minimum value of at least 90% of the thickness 1502 of the panel member 119, the fastener is gripped and retained by the panel member 119 while the fastener is penetrated through the fastener retaining portion 116, to increase the reliability of the securing of the panel 100 to the wall 1.

In some embodiments, for example, the thickness 1502 of the panel member 119 has a minimum value of at least 0.030 inches.

In some embodiments, for example, the minimum spacing distance 1504 between the groove 120 and the second side surface 1192 has a minimum value of at least 0.027 inches. In some embodiments, for example, the minimum spacing distance between the groove 120 and the second side surface 1192 has a value of 0.030 inches.

In some embodiments, for example, the minimum spacing distance 1504 between the groove 120 and the second side surface 1192 is the same as the thickness 1502 of the panel member 119.

In some embodiments, for example, the minimum spacing distance 1504 between the groove 120 and the second side surface 1192 is greater than the thickness 1502 of the panel member 119.

In some embodiments, for example, while the first and second panels 100 are connected, it is desirable for the connection to be defeatable, such that, for example, the panels 100 may be transported to a different location and the panel assembly 10 may be installed at the different location, or that another panel can be connected to the first panel. In some embodiments, for example, it is also desirable for the connection between the first and second panels to be defeatable in a manner other than sliding one of the first panel and the second panel, relative to the other of the first panel and the second panel, in a direction along the length of the first and second panels (e.g. in a direction along the axis 2), as such sliding of one of the first panel and the second panel, relative to the other of the first panel and the second panel, to defeat the connection between the first and second panel, may require space that is not available (e.g. the length of the space needed is approximately the sum of the length of the first panel and the length of second panel), which may make the separation of the panels cumbersome.

In some embodiments, for example, while the first and second panels are connected via the first connection system counterpart configuration 30 of the first panel 100 and the second connection system counterpart configuration 50 of the second panel 100, to defeat the connection between connected panels, one of the first panel 100 and the second panel 100 is rotatable relative to the other of the first panel 100 and the second panel 100 to defeat the connection between the first connect system counterpart configuration 30 of the first panel 100 and the second connection system counterpart configuration 50 of the second panel 100. In some embodiments, for example, while the first panel 100 is secured to the wall 1, and the first and second panels are connected, the second panel 100 is rotatable, relative to the first panel 100, in a direction away from the wall, to defeat the connection between the first and second panels.

Figure 18:
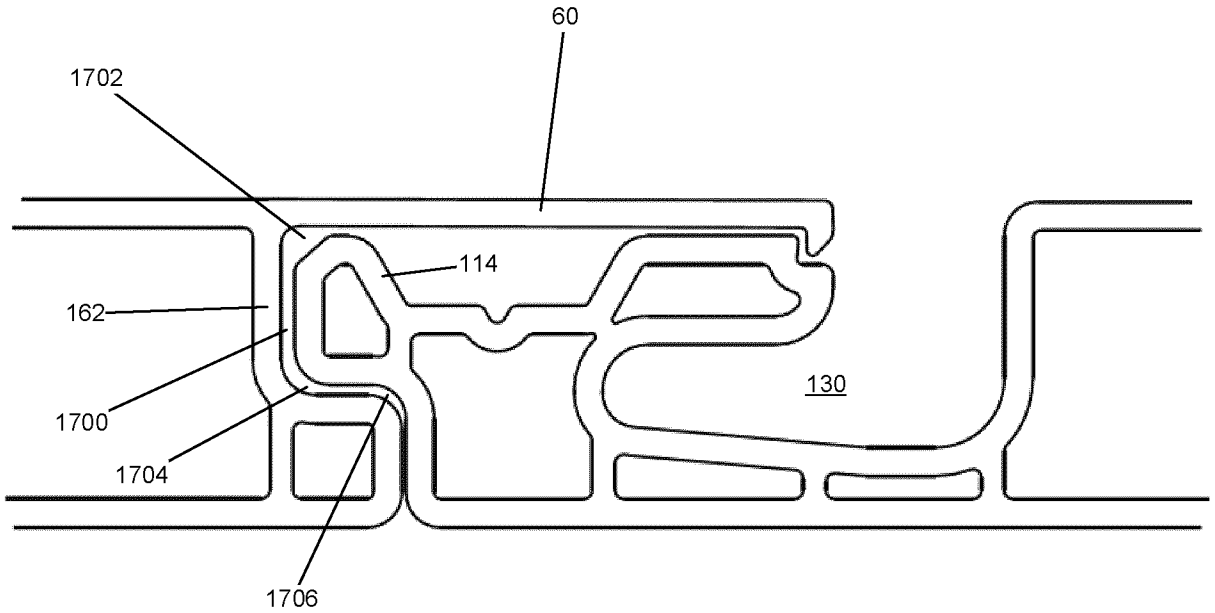
FIG. 18 is an enlarged view of a portion of the wall panel assembly of FIG. 4, the portion of the panel identified by window 11 in FIG. 4.

As described herein, while the first and second panels are connected, the projection 114 is received in the recess 164. As depicted in FIG. 18, the receiving of the projection in the recess is with effect that an internal space 1700 is defined. The internal space 1700 is configured such that the rotation of the first panel 100, relative to the second panel 100, for defeating of the connection between the first and second panels, is effectible. In some embodiments, for example, the internal space 1700 is defined between: 1) the inner surface 60A of the interacting portion 60, the inner surface 1611 of the wall member 161, the intermediate wall 162, for example, an intermediate wall surface 1621 of the intermediate wall 162, and 2) the outer surface of the projection 114. The internal space 1700 provides sufficient clearance between the first and second panels 100 for rotation of one of the first and second panels relative to the other one of the first and second panels.

Figure 19:
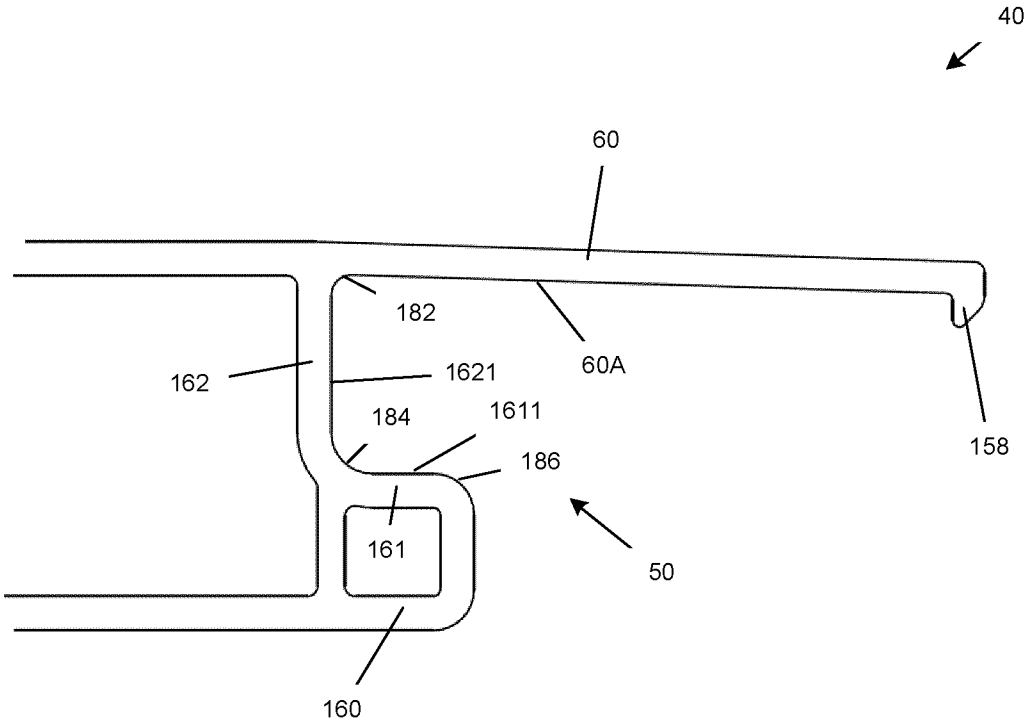
FIG. 19 is another enlarged view of a portion of the panel of FIG. 1, the portion of the panel identified by window 3 in FIG. 1.
Figure 20:
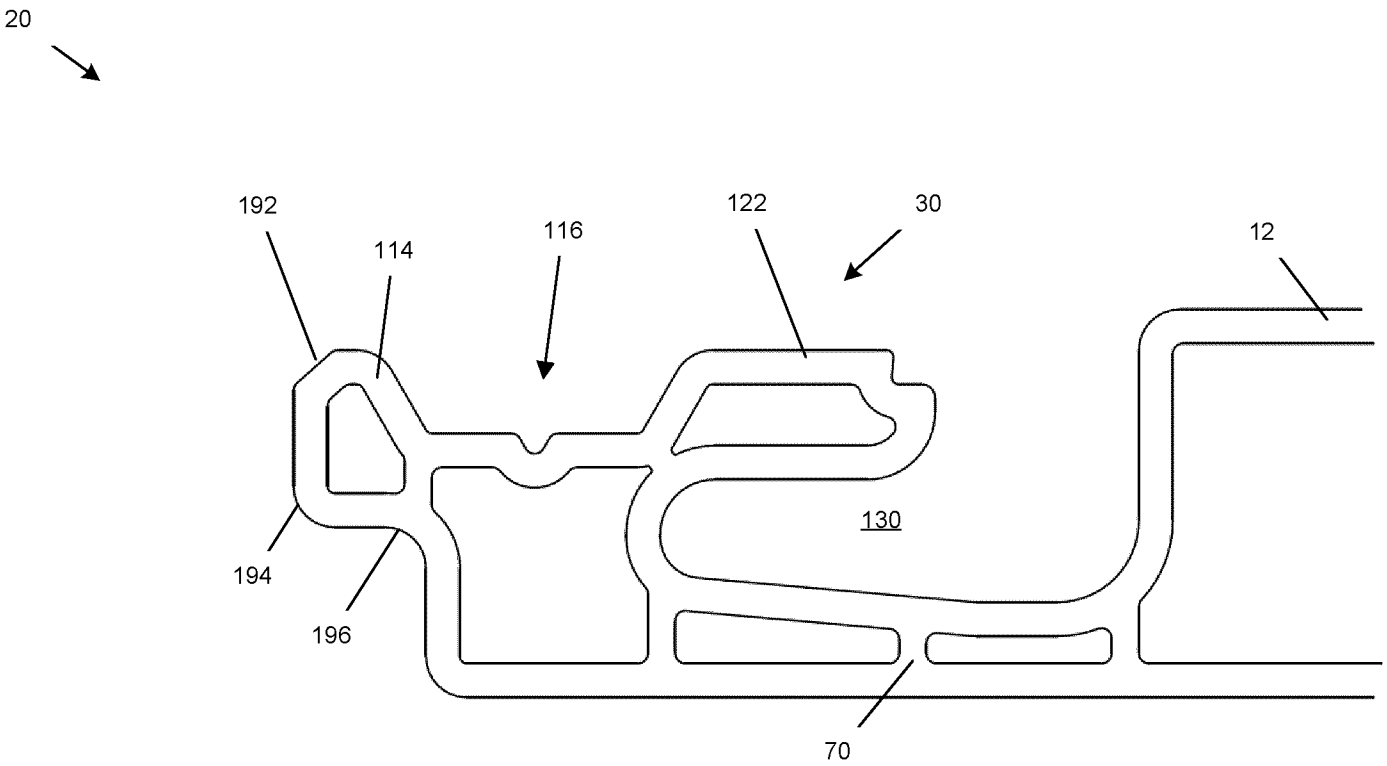
FIG. 20 is another enlarged view of a portion of the panel of FIG. 1, the portion of the panel identified by window 2 in FIG. 1.

In some embodiments, for example, the internal space 1700 is defined by a first internal space portion 1702, a second internal space portion 1704, and a third internal space portion 1706. In this respect, in some embodiments, for example, as depicted in FIG. 18, the panel 100 comprises a first space-defining surface 182, extending between the inner surface 60A of the interacting portion 60 and the intermediate wall surface 1621, a second space-defining surface 184, extending between the inner surface 1611 of the wall member 161 and the intermediate wall surface 1621, and a third space-defining surface 186, defined by the wall member 161, and, as depicted in FIG. 19, the projection 114 of the panel 100 defines a first space-defining surface 192, a second space-defining surface 194, and a third space-defining surface 196. The first and second panels are co-operatively configured such that, while the first and second panels are connected via the first connection system counterpart configuration 30 of the first panel 100 and the second connection system counterpart configuration 50 of the second panel 100, the projection 114 of the first panel is received in the recess 164 of the second panel 100, with effect that:

- the first internal space portion 1702 is defined between the first space-defining surface 182 of the second panel and the first space-defining surface 192 of the projection 114 of the first panel;
- the second internal space portion 1704 is defined between the second space-defining surface 184 of the second panel and the second space-defining surface 194 of the projection 114 of the first panel; and
- the third internal space portion 1706 is defined between the third space-defining surface 186 of the second panel and the third space-defining surface 196 of the projection 114 of the first panel.

In some embodiments, for example, at least one of the first space-defining surface 182, the second space-defining surface 184, and the third space-defining surface 186 is an arcuate surface. In some embodiments, for example, each one of the first space-defining surface 182, the second space-defining surface 184, and the third space-defining surface 186, independently, is an arcuate surface.

In some embodiments, for example, at least one of the first space-defining surface 192, the second space-defining surface 194, and the third space-defining surface 196 is an arcuate surface. In some embodiments, for example, each one of the first space-defining surface 192, the second space-defining surface 194, and the third space-defining surface 196, independently, is an arcuate surface.

In some embodiments, for example, at least one of the first space-defining surface 182, the second space-defining surface 184, and the third space-defining surface 186 is a planar surface. In some embodiments, for example, each one of the first space-defining surface 182, the second space-defining surface 184, and the third space-defining surface 186, independently, is a planar surface.

In some embodiments, for example, at least one of the first space-defining surface 192, the second space-defining surface 194, and the third space-defining surface 196 is a planar surface. In some embodiments, for example, each one of the first space-defining surface 192, the second space-defining surface 194, and the third space-defining surface 196, independently, is a planar surface.

In some embodiments, for example, the first space-defining surface 192 is defined by the urging surface 115.

In some embodiments, for example, a degree of rotation of one of the first panel 100 and the second panel 100, relative to the other of the first panel 100 and the second panel 100, about a rotation axis, for effecting the defeating of the connection between the first and second panels, has a minimum value of at least 1 degree. In some embodiments, for example, the rotation axis is parallel to the axis 2.

In some embodiments, for example, the first and second panels are co-operatively configured such that, while the connection of the first and second panels is defeated, via the rotation of one of the first panel 100 and the second panel 100, relative to the other one of the first panel 100 and the second panel 100, the first panel 100 and the second panel 100 are separable.

As described herein, to defeat or release the connection between connected first and second panels, wherein the first and second panels are connected via the first connection system counterpart configuration 30 of the first panel 100 and the second connection system counterpart configuration 50 of the second panel 100, the interacting portion 60 of the second panel 100 is transitioned from the interference-effective configuration to the interference-ineffective configuration. While the interacting portion 60 of the second panel is disposed in the interference-effective configuration, it may be difficult or cumbersome to apply a force, having a direction away from the first connection system counterpart 110 of the first connection system 32, of the first panel 100, to the interacting portion 60 to effect the transition from the interference-effective configuration to the interference-ineffective configuration. It is desirable to increase the ease with which said force is applicable to the interacting portion 60 to effect the transition from the interference-effective configuration to the interference-ineffective configuration.

Figure 21:
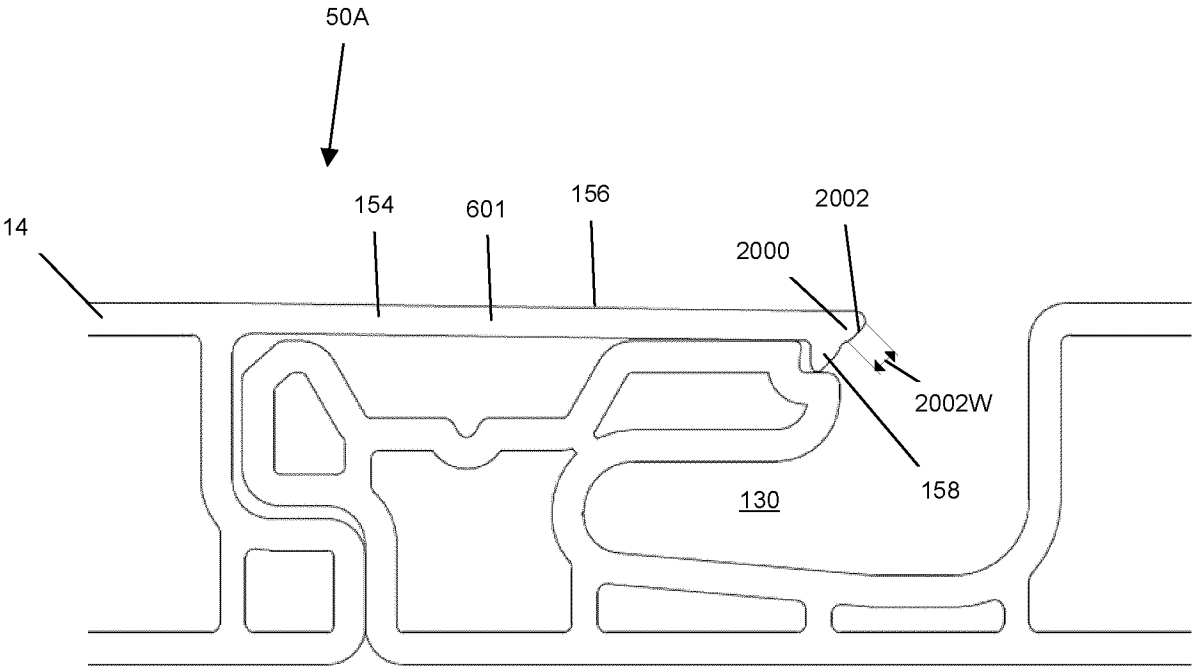
FIG. 21 is a cross-section view of a panel connected to another panel, the panel including a panel defined configuration at the second end, the panel defined configuration including an alternate embodiment of an interacting portion.

In this respect, in some embodiments, for example, as depicted in FIG. 21, the first panel 100 is connected to the second panel 100, via the first connection system counterpart configuration 30 of the first panel 100 and a second connection system counterpart configuration 50A of the second panel 100, wherein the second connection system counterpart configuration 50A is an alternate embodiment of the second connection system counterpart configuration 50. The second connection system counterpart configuration 50A substantially corresponds to the second connection system counterpart configuration 50, except the interacting portion 601 of the second connection system counterpart configuration 50A further includes an interference defeater 2000, which defines an urging force receiving surface 2002.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship:

the interference defeater 2000 is disposed, relative to the first connection system counterpart 110 (e.g. the notch 124) of the first connection system 32, of the first panel 100, such that the urging force receiving surface 2002 is unoccluded by the first connection system counterpart 110 (e.g. the notch 124) of the first connection system 32, of the first panel 100; and a deformation-urging force is applicable, by a deformation-urging force applicator (e.g. a tool such as a screw driver, scraper, wedge, or a hook, a finger of an operator, and the like), to the urging force-receivable surface 2002 of the interference defeater 2000, wherein the interacting portion 60 of the second panel 100 is deformable from the interference-effective configuration, by the deformation-urging force, for effecting transitioning of the interacting portion 60 to the interference-ineffective configuration.

Figure 22:
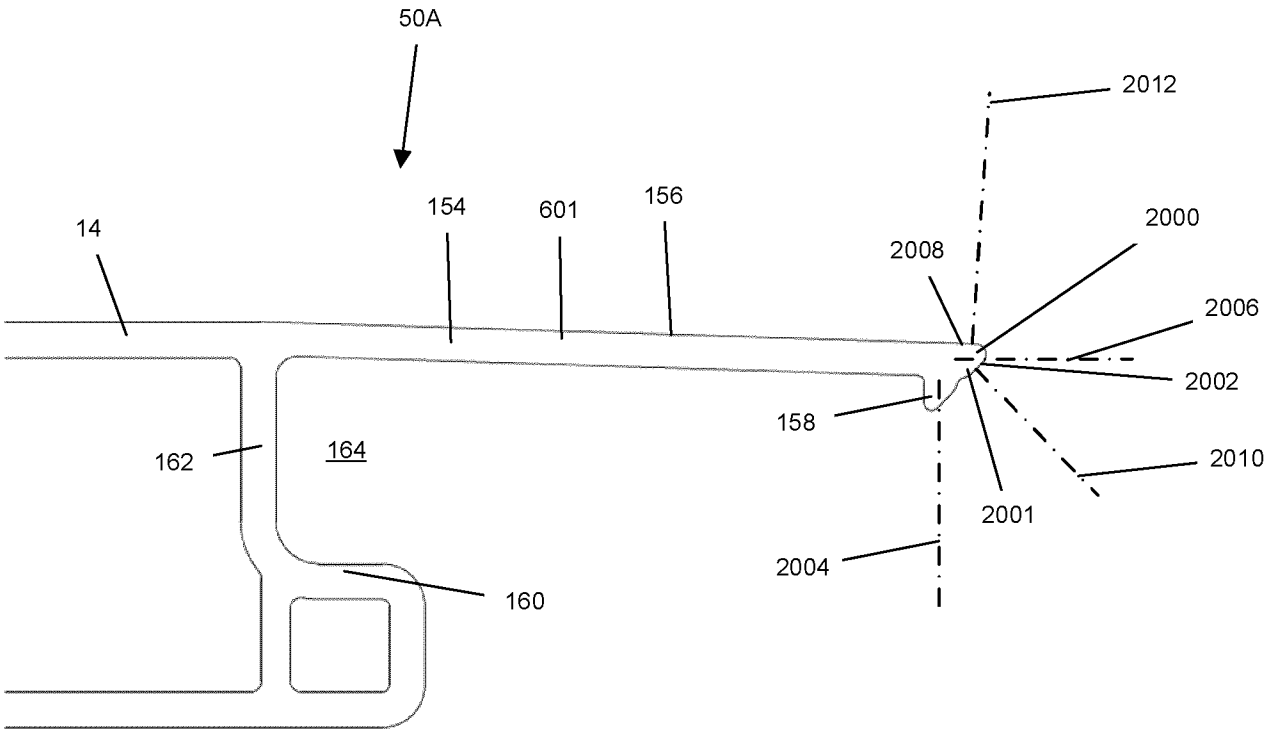
FIG. 22 is a cross-sectional view of the panel defined configuration of the panel of FIG. 21.

In some embodiments, for example, as depicted in FIG. 21 and FIG. 22, the interference defeater 2000 is disposed at a free end of the interacting portion 60. In some embodiments, for example, the second connection system counterpart 158 (e.g. the rearward projection 158) of the first connection system 32 is disposed between the covering portion 154 and the interference defeater 2000.

In some embodiments, for example, as depicted in FIG. 22, the second connection system counterpart 158 of the first connection system 32 comprises a connection system counterpart-defined projection 158, wherein the connection system counterpart-defined projection 158 extends in a direction parallel to a first axis 2004, the interference defeater 2000 comprises an interference defeater-defined projection 2001, wherein the interference defeater-defined projection 2001 extends in a direction parallel to a second axis 2006, wherein the first axis 2004 and the second axis 2006 are disposed in a non-parallel relationship. In some embodiments, for example, the first axis 2004 and the second axis 2006 are disposed in a perpendicular relationship.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, there is an absence of disposition of the urging force receiving surface 2002 of the interference defeater 2000 within the first connection system counterpart 110 (e.g. the notch 124) of the first connection system 32, of the first panel 100.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, there is an absence of engagement between the interference defeater 2000 and the first connection system counterpart 110 (e.g. the notch 124) of the first connection system 32, of the first panel 100.

In some embodiments, for example, while the first connection system counterpart 110 (e.g. the notch 124) of the first connection system 32, of the first panel 100, and the second connection system counterpart 158 (e.g. the rearward projection 158) of the first connection system 32, of the second panel 100 are disposed in the relative movement interference relationship, there is an absence of bearing of the interference defeater 2000 against the first connection system counterpart 110 (e.g. the notch 124) of the first connection system 32, of the first panel 100.

In some embodiments, for example, the interference defeater 2000 defines a front-facing interference defeater surface 2008 that is a planar surface, and outermost surface 156 of the covering portion 154 and the front-facing interference defeater surface 2008 are co-planar.

In some embodiments, for example, the urging force-receivable surface 2002 of the interference defeater 2000 is a planar surface, the urging force-receivable surface 2002 defining a normal axis 2010, the front-facing interference defeater surface 2008 defines a normal axis 2012, an angle defined between: (i) the normal axis 2010 of the urging force-receivable surface 2002, and (ii) the normal axis 2012 of the front-facing interference defeater surface 2008, has a minimum value of at least 5 degrees. In some embodiments, for example, the angle defined between: (i) the normal axis 2010 of the urging force-receivable surface 2002, and (ii) the normal axis 2012 of the front-facing interference defeater surface 2008, has a value of 45 degrees.

In some embodiments, for example, the urging force receiving surface 2002 has a width 2002W with a minimum value of at least 0.030 inches.

Figure 23:
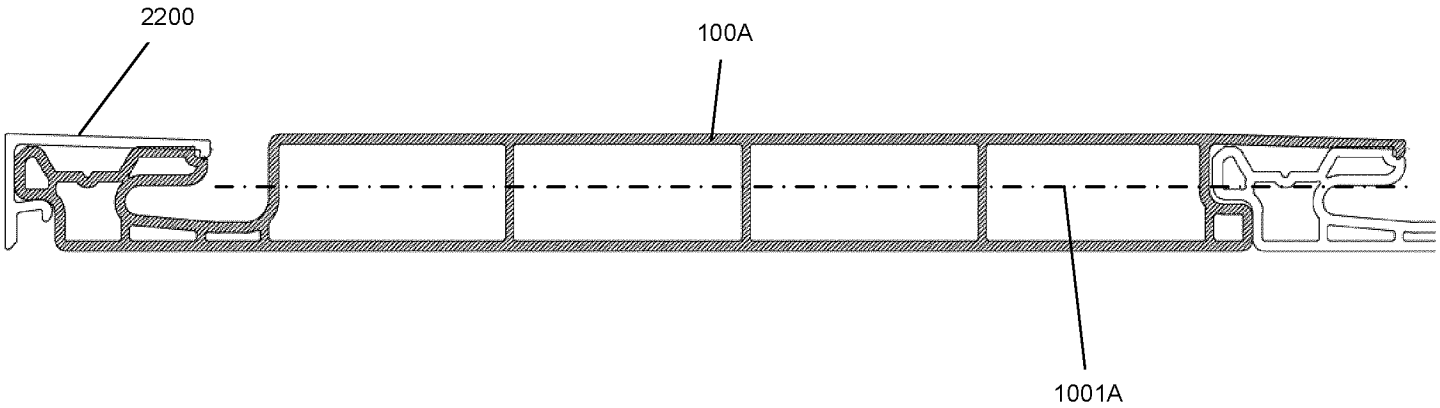
FIG. 23 is a cross-sectional of a wall panel assembly, the wall panel assembly including an alternate embodiment of the panel of FIG. 1.

FIG. 23 depicts a panel 100A that is an alternate embodiment of the panel 100 depicted in FIG. 1. Panel 100A substantially corresponds to the panel 100, except the width of the panel 100A, measured along the central longitudinal axis 1001A of the panel 100A, is different from the width of the panel 100, measured along the central longitudinal axis 1001 of the panel 100. In some embodiments, for example, the number of ribs 108 of the panel increases as the length of the panel increases. In some embodiments, for example, the number of ribs 108 of the panel decreases as the length of the panel decreases.

In some embodiments, for example, the panel 100 includes a plurality of cavities 130. Each one of the plurality of cavities 130, independently, includes the features described herein. Each one of the plurality of cavities 130, independently, is configured for retaining a bracket 502 to the panel 100. In some embodiments, for example, the panel 100 includes two cavities 130. In some embodiments, for example, the panel 100 includes three cavities 130. In some embodiments, for example, the panel 100 includes four cavities 130. In some embodiments, for example, the panel 100 includes more than four cavities 130.

In this respect, in some embodiments, for example, for each one of the plurality of cavities 130, independently, the panel 100 includes: 1) a wall member 141 includes a wall portion 143 that has an arcuate wall surface 145, 2) a rear wall configuration 70 wherein the first wall 72 and the second wall 74 are disposed in a non-parallel relationship, and 3) a wall member 147, connecting the retaining surface-defining wall 123 of the retaining surface defining configuration 122 and the first wall 72 of the rear wall configuration 70, to improve the load bearing capacity of the cavity 130. In some embodiments, for example, for each one of the plurality of cavities 130, independently, the panel 100 includes a guiding surface 136 for guiding the rotation of the bracket connector 504 into the cavity 130 to effect the retained configuration.

Figure 24:
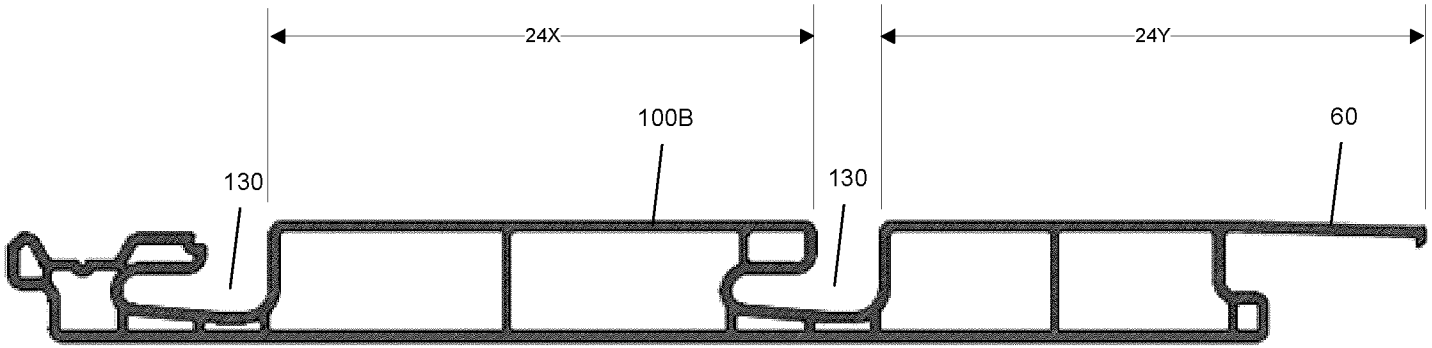
FIG. 24 is a cross-sectional view of an alternate embodiment of the panel of FIG. 1.
Figure 25:
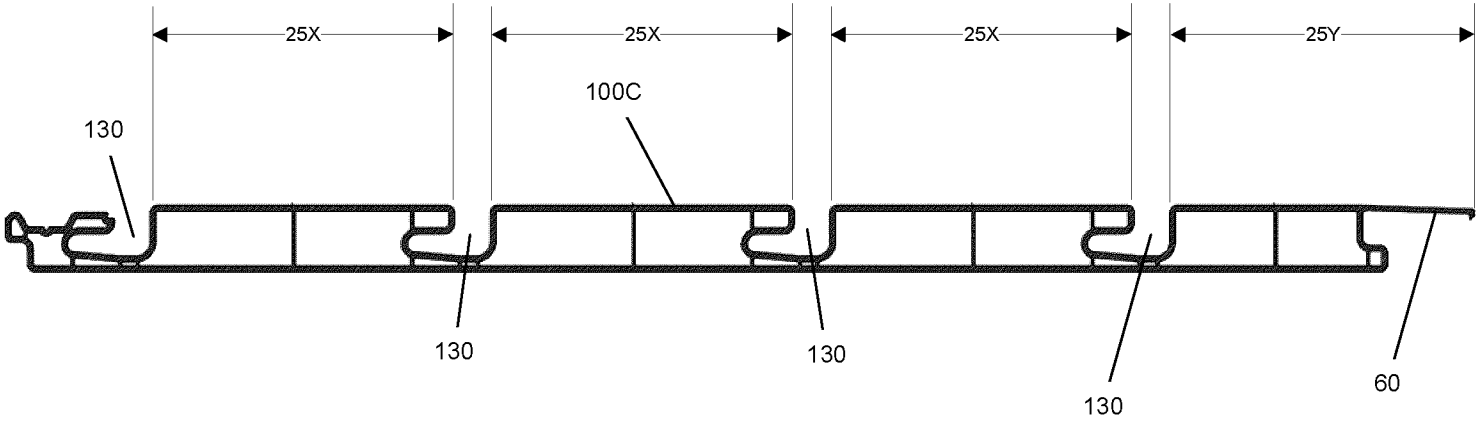
FIG. 25 is a cross-sectional view of an alternate embodiment of the panel of FIG. 1.

FIG. 24 depicts a panel 100B, and FIG. 25 depict a panel 1000. The panel 100B and the panel 1000 are alternate embodiments of the panel 100 depicted in FIG. 1. Panel 100B and panel 1000 substantially correspond to the panel 100, except the panel 100B the panel 1000 include more than one cavity 130. As depicted, in some embodiments, for example, the panel 100B includes two cavities 130. As depicted, in some embodiments, for example, the panel 1000 includes four cavities 130.

Figure 26:
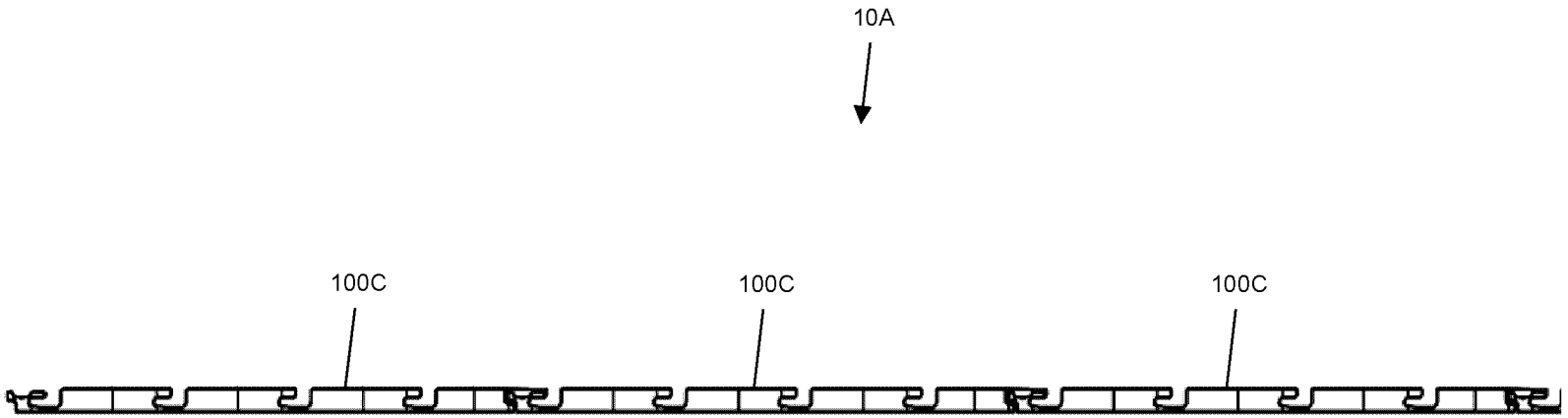
FIG. 26 is a cross-sectional view of a wall panel assembly comprising panels of FIG. 25.

FIG. 26 depicts a wall panel assembly 10A comprising three panels 1000.

In some embodiments, for example, as depicted in FIG. 24, for a two-cavity panel having a width of approximately 6 inches, wherein the width of a panel is measured along the axis 1001, the minimum spacing distance 24X between the opening of a first cavity and the opening of a second cavity is approximately 2.5 inches. In some embodiments, for example, as depicted in FIG. 24, for a two-cavity panel having a width of approximately 6 inches, the minimum spacing distance 24Y between the opening of a cavity and the terminal end of the interacting portion 60 is approximately 2.5 inches.

In some embodiments, for example, as depicted in FIG. 24, for a two-cavity panel having a width of approximately 8 inches, the minimum spacing distance 24X between the opening of a first cavity and the opening of a second cavity is approximately 3.5 inches. In some embodiments, for example, as depicted in FIG. 24, for a two-cavity panel having a width of approximately 8 inches, the minimum spacing distance 24Y between the opening of a cavity and the terminal end of the interacting portion 60 is approximately 3.5 inches.

In some embodiments, for example, as depicted in FIG. 24, for a two-cavity panel having a width of approximately 12 inches, the minimum spacing distance 24X between the opening of a first cavity and the opening of a second cavity is approximately 5.5 inches. In some embodiments, for example, as depicted in FIG. 24, for a two-cavity panel having a width of approximately 12 inches, the minimum spacing distance 24Y between the opening of a cavity and the terminal end of the interacting portion 60 is approximately 5.5 inches.

In some embodiments, for example, for a three-cavity panel having a width of approximately 12 inches, the minimum spacing distance between the opening of a first cavity and the opening of a second cavity is approximately 3.5 inches. In some embodiments, for example, for a three-cavity panel having a width of approximately 12 inches, the minimum spacing distance between the opening of a cavity and the terminal end of the interacting portion 60 is approximately 3.5 inches.

In some embodiments, for example, as depicted in FIG. 25, for a four-cavity panel having a width of approximately 12 inches, the minimum spacing distance 25X between the opening of a first cavity and the opening of a second cavity is approximately 2.5 inches. In some embodiments, for example, as depicted in FIG. 25, for a four-cavity panel having a width of approximately 12 inches, the minimum spacing distance 25Y between the opening of a cavity and the terminal end of the interacting portion 60 is approximately 2.5 inches.

Figure 27:
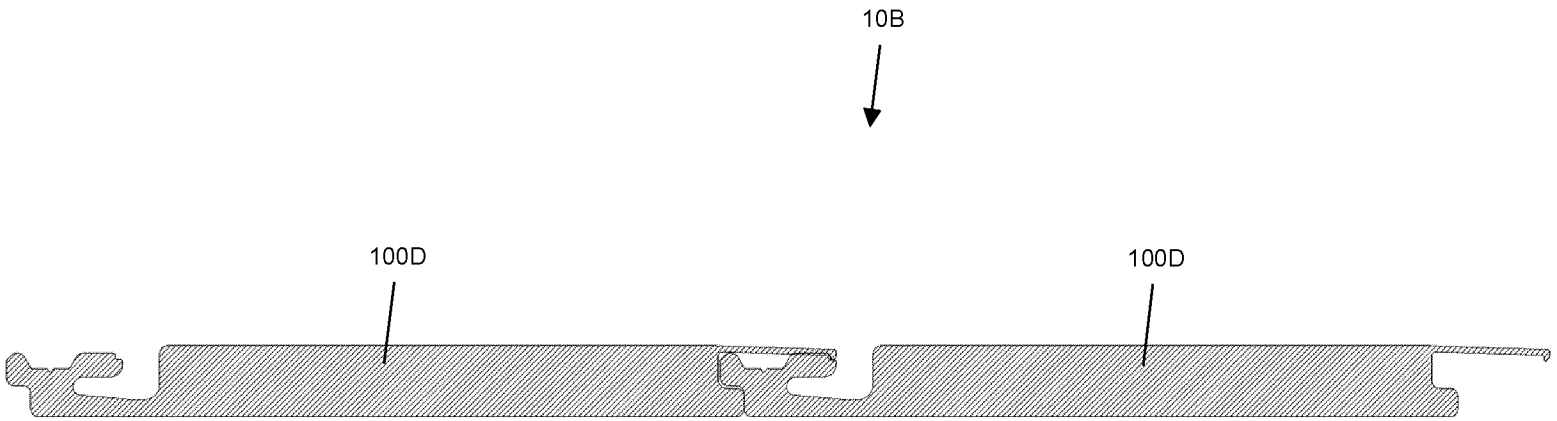
FIG. 27 is a cross-sectional view of a wall panel assembly comprising panels of an alternate embodiment of the panel of FIG. 1.

In some embodiments, for example, the material of the panel 100 includes plastic, for example, polyvinyl chloride (PVC), polypropylene, or recycled plastic. In some embodiments, for example, the material of the panel 100 includes a composite, such as, for example, wood fibre composite, recycled material, or cellular foam. In some embodiments, for example, the material of the panel 100 includes aluminum. In some embodiments, for example, the material of the panel 100 includes fibreglass. In some embodiments, for example, the material of the panel 100 includes wood. FIG. 27 depicts a wall panel assembly 10B comprising two panels 100D, the panel 100D being an alternate embodiment of the panel 100. The panel 100 and the panel 100D are substantially similar, except the panel 100D is solid wood. As depicted, in some embodiments, for example, where the panel 100D is solid wood, there is an absence of ribs 108 extending between the first side 103 and the second side 1031. As depicted, in some embodiments, for example, where the panel 100D is solid wood, there is an absence of hollow portions in the panel 100D.

In some embodiments, for example, the panel 100 is manufactured by extrusion. In such embodiments, for example, the panel 100 is an extruded lineal. In some embodiments, for example, the panel 100 is manufactured by molding. In some embodiments, for example, the panel 100 is manufactured by pultrusion. In some embodiments, for example, the panel 100 is manufactured by cutting a piece of wood.

In some embodiments, for example, the first panel 100 is connected to the second panel 100 that is the same as the first panel 100. For example, the first panel 100 and the second panel are both the panel 100 as depicted in FIG. 1. In some embodiments, for example, the first panel 100 is connected to the second panel that is different from the first panel 100. For example, the first panel 100 is the panel 100 depicted in FIG. 1, and the second panel is any one of the other panels described herein, for example, any one of the panel 100A to the panel 100F. In some embodiments, for example, a wall panel assembly 10 is assembled by connecting two of the same panels together, or connecting two different panels together. In some embodiments, for example, a first panel is connectible to a second panel, wherein the connection is effected by the first connection system counterpart configuration 30 of the first panel, and the second connection system counterpart configuration 50 of the second panel.

In some embodiments, for example, while the load bearing capacity of the cavity 130 is increased via structural changes to the cavity 130, it may be desirable to penetrate portions of the panel 100, in addition to the fastener receiving portion 116, to improve the securing of the panel 100 to the wall 1.

Figure 28:
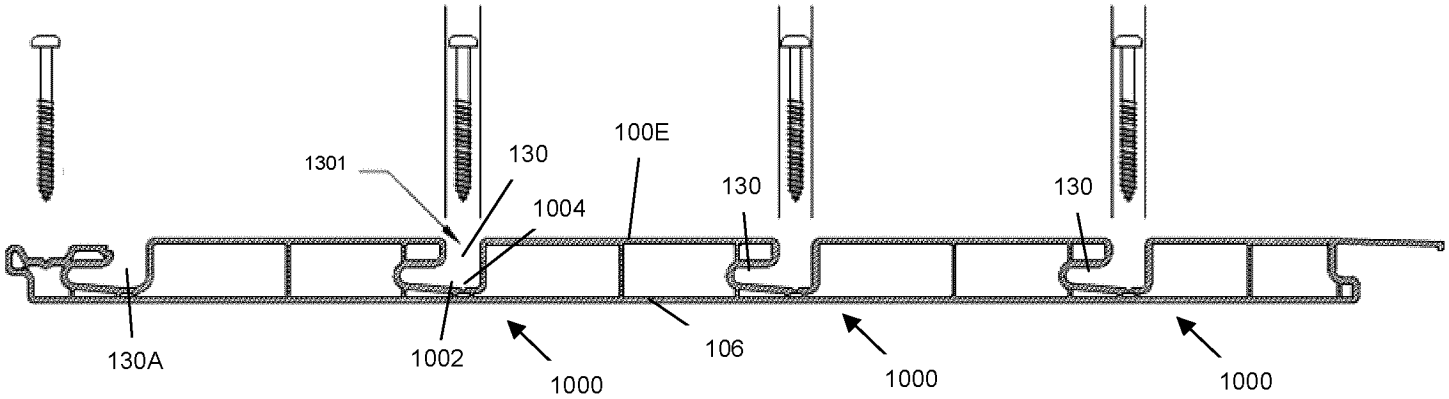
FIG. 28 is a cross-sectional view of an alternate embodiment of the panel of FIG. 1.

In this respect, in some embodiments, for example, FIG. 28 depicts a panel 100E that is an alternate embodiment of the panel 100. Panel 100E substantially corresponds to the panel 100, except the panel 100E includes more than one cavity 130, and further includes one or more fastener-receiving portions 1000. As depicted, the panel 100E includes three fastener-receiving portions 1000. In some embodiments, for example, the panel 100E is configured to be fastened to a wall 1 via a fastener that is received through a cavity 130 of the panel 100E. In some embodiments, for example, at least one of the cavities 130 of the panel 100E is configured to receive a fastener and engage the fastener for fastening the panel 100E to a wall 1.

In some embodiments, for example, the fastener-receiving portion 1000 of the panel 100E is configured to receive one or more mechanical fasteners, for example, screws, bolts, pins, and the like, to connect the panel 100E to a wall 1. In some embodiments, for example, the fastener-receiving portion 1000 is configured to co-operate with one or more mechanical fasteners, wherein at least a portion of the mechanical fastener is disposed in the cavity 130, to connect the panel 100E to a wall 1.

The fastener-receiving portion 1000 includes a fastener-engaging surface 1002. In some embodiments, for example, the fastener-engaging surface 1002 is defined by the outer surface 72A of the first wall 72 of the rear wall configuration 70. The fastener-engaging surface 1002 is configured to engage with a head of a fastener, and further configured to resist further displacement of the fastener through the panel 100E while the fastener-engaging surface 1002 is engaged to the head of the fastener. In some embodiments, for example, the cavity-defining surface 132 includes the fastener-engaging surface 1002.

In some embodiments, for example, the fastener-engaging surface 1002 is aligned with an opening 1301 of the cavity 130, such that the fastener is receivable through the opening 1301, and extending through the cavity 130, to engage the fastener-engaging surface 1002. In some embodiments, for example, the opening 1301 is sufficiently wide such that the head of the fastener is receivable in the opening 1301 and displaceable through the opening 1301.

In some embodiments, for example, the fastener-receiving portion 1000 includes a fastener locator 1004, similar to the fastener locator 120, for locating placement of a fastener in a fastener effective position, and for guiding the penetration of the panel 100 by the fastener. In some embodiments, for example, the fastener locator 1004 is defined by the first wall 72 of the rear wall configuration 70. In some embodiments, for example, the fastener locator 1004 includes a groove that is defined within the outer surface 72A of the first wall 72. In some embodiments, for example, the fastener locator 1004 is configured to receive the tip of a fastener. In some embodiments, for example, the fastener locator 1004 is sufficiently deep and wide to receive the tip of the fastener. In some embodiments, for example, the fastener locator 1004 and the tip of the fastener are co-operatively configured such that, while the tip of the fastener is received in the fastener locator 1004, the position of the fastener-receiving portion 1000 is identified for a user to fasten the panel 100E to a wall 1. In some embodiments, for example, the fastener locator 1004 and the tip of the fastener are co-operatively configured such that, while the tip of the fastener is received in the fastener locator 1004, the fastener is oriented such that the fastener is able to fasten the panel 100E to a wall 1. In some embodiments, for example, the fastener locator 1004 is defined on the fastener-engaging surface 1002.

To connect the panel 100E to a wall 1, the panel 100E is disposed against the wall 1, and the fastener is displaced relative to the panel 100E such that the fastener is received in the cavity 130, for example, the counterpart-receiving portion 144. At this point, the fastener continues to be displaced in the cavity 130 until the tip of the fastener is engaged with the fastener locator 1004, such that the fastener becomes oriented for fastening the panel 100E via the fastener locator 1004. At this point, the fastener is displaced through the fastener-engaging surface 1002 of the panel 100E and further displaced through the wall-opposing surface 106 until the fastener engages the wall 1, such that the panel 100E is coupled to the wall 1 via the fastener.

In some embodiments, for example, at least one of the cavities 130 of the panel 100E is configured to receive a fastener to fasten the panel 100E to the wall. In some embodiments, for example, for at least one of the cavities 130 of the panel 100E that is configured to receive a fastener to fasten the panel 100E to the wall, the cavity-defining surface 132 includes the fastener-engaging surface 1002. In some embodiments, for example, as depicted in FIG. 28, a fastener-engaging surface 1002 is absent from the cavity-defining surface 132 of a cavity 130A disposed at the first end 101 of the panel 100E, while the cavity-defining surface 132 of each other cavity 130 of the panel 100E includes a fastener-engaging surface 1002. In such embodiments, for example, the width of the opening of the cavity 130A is less than the width of the opening of the cavity 130, as the width of the opening of the cavity 130A does not have to be sufficient to provide clearance for receiving the head of the fastener.

In some embodiments, for example, a fastener, in addition to the fastener that connects the panel 100E to the wall 1 via the fastener-receiving portion 116, can connect the panel 100E to the wall 1 via the fastener-receiving portion 1000. The additional fasteners strengthens the connection of the panel 100E to the wall 1. Such additional connection strength is desirable if the load to be supported by a mounting bracket that is connected to the panel 100E is particularly heavy.

In some embodiments, for example, while the fastener is engaged with the fastener-engaging surface 1002 of the fastener-receiving portion 1000, the exposed portion of the head of the fastener is configured to guide the displacement of the bracket connector 504, for example, rotation of the bracket connector 504, for disposition of the bracket connector 504 further into the cavity 130. In some embodiments, for example, the exposed portion of the head of the fastener, which is configured to guide the displacement of the bracket connector 504 further into the cavity, includes a rounded portion.

In some embodiments, for example, while the fastener is engaged with the fastener-engaging surface 1002 of the fastener-receiving portion 1000, the bracket connector 504 can be received by the residual portion of the cavity 130 that is unobstructed by the head of the fastener that is securing the panel 100E to the wall 1, for effecting the retained configuration.

Figure 29:
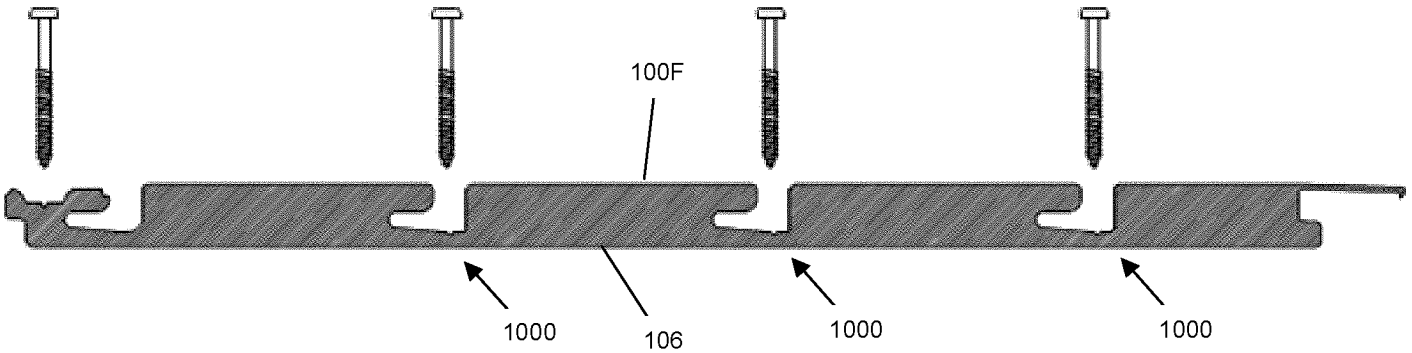
FIG. 29 is a cross-sectional view of an alternate embodiment of the panel of FIG. 28.

FIG. 29 depicts a panel 100F that is an alternate embodiment of the panel 100E. The panel 100F substantially corresponds to the panel 100E, except the panel 100F is solid wood.

In some embodiments, for example, a cavity 130 of a panel as described herein, for example, panel 100 to panel 100F, is configured to receive a fastener to fasten the panel to the wall 1. In some embodiments, for example, the cavity-defining surface 132 of said cavity 130 defines a fastener-engaging surface 1002 of a fastener-receiving portion to engage with a head of a fastener for connecting the panel to a wall 1.

Figure 30:
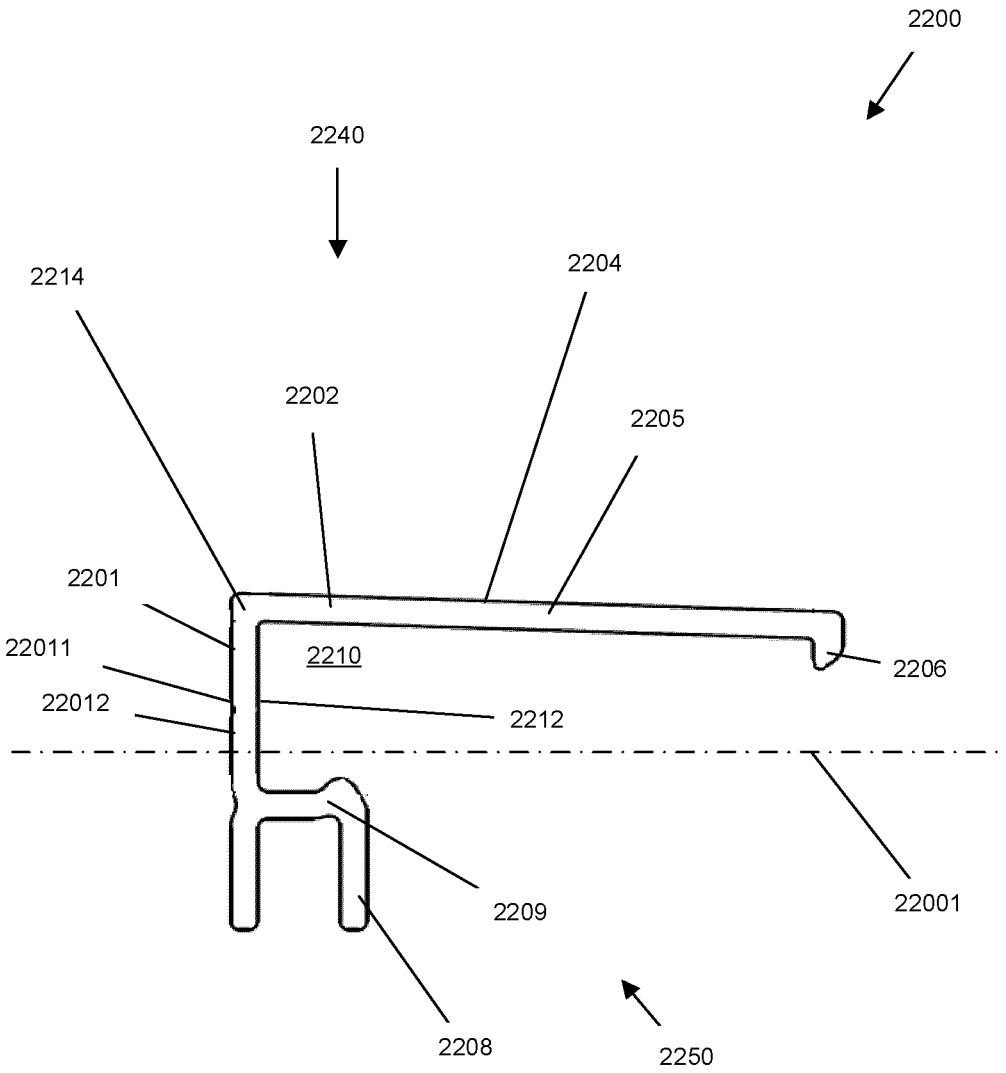
FIG. 30 is a cross-sectional view of a trim for connecting with a panel defined configuration disposed at a first end of the panel of FIG. 1.

FIG. 30 depicts an example embodiment for a trim 2200. In some embodiments, for example, the trim 2200 is configured to connect to a panel described herein, for example, the panel 100 to 100F, to conceal the first connection system counterpart configuration 30 of the panel 100, and provide a clean and aesthetic finish to a connected trim 2200 and panel. In some embodiments, for example, the trim 2200 is connectible to the panel 100, that is the uppermost panel 100 of the wall panel assembly, for concealing the fastener that is connecting the uppermost panel 100 to the wall 1.

In some embodiments, for example, the trim 2200 is connectible to the panel 100, such that connected trim and panel are established, for example, to define a wall panel assembly 10.

The trim 2200 defines a central longitudinal axis 22001. The trim 2200 includes a trim defined configuration 2240 that substantially corresponds to the panel defined configuration 40 at the second end 102 of the panel 100. In particular, the trim defined configuration 2240 includes a trim-defined connection system counterpart configuration 2250 that substantially corresponds to the second connection system counterpart configuration 50 of the panel 100. The trim 2200 and the panel 100 are connectible via the trim-defined connection system counterpart configuration 2250 and the first connection system counterpart configuration 30 of the panel 100. The trim 2200 is connectible to a panel 100 in a manner substantially similar to the manner by which the connection between adjacent panels, in the wall panel assembly, is established, as described herein.

As depicted, the trim defined configuration 2240 includes the trim-defined connection system counterpart configuration 2250, which includes an interacting portion 2202, which substantially corresponds to the interacting portion 60 of the panel 100. The interacting portion 2202 includes a covering portion 2205, for effectuating the concealment of the fastener in like manner as the effectuating of the concealment of the fastener, by co-operation between adjacent panels in the wall panel assembly, by the covering portion 154 of the interacting portion 60 of the panel 100. The covering portion 2205 includes an outermost surface 2204 configured for being visible while the trim 2200 is connected to the panel 100, the outermost surface 2204 including a continuous surface that extends along the length of the covering portion 2205. The interacting portion 2202 further includes a trim defined second connection system counterpart 2206 (e.g. a rearward projection 2206) of the first connection system 32, substantially corresponding to the second connection system counterpart 158 of the first connection system 32, of the panel 100, that is configured to co-operate with the first connection system counterpart 110 (e.g. the notch 124) of the first connection system 32 of the panel 100 for snap fit engagement.

The trim-defined connection system counterpart configuration 2250 further includes a trim defined second connection system counterpart 2208 of the second connection system 34, including a wall member 2209, disposed rearwardly of the interacting portion 2202, substantially corresponding to the second connection system counterpart 160 of the second connection system 34, of the panel 100, and is configured to co-operate with the first connection system counterpart 114 (e.g. the projection 114) of the second connection system 34 to resist lifting of the trim 2200 away from the panel 100.

The trim defined configuration 2240 further includes a trim wall 2201, that defines an intermediate wall 22012 that extends between the interacting portion 2202 and the trim defined second connection system counterpart 2208.

In some embodiments, for example, the interacting portion 2202 is pivotable about a joint 2214, for transitioning between the pre-deformation configuration, the interference effective configuration, and the interference ineffective configuration. The interacting portion 2202 is connected to the trim wall 2201 at the joint 2214, as depicted in FIG. 30.

In some embodiments, for example, the trim wall 2201 includes an outermost end surface 22011 configured for being visible while the trim 2200 is connected to the panel 100, the outermost end surface 22011 including a continuous surface that extends along the length of the trim 2200. In some embodiments, for example, the outermost end surface 22011 has a minimum surface area of at least 0.375 inches squared. In some embodiments, for example, the visible surface of the outermost end surface 22011 has a minimum width or height of at least ⅛ inches. In some embodiments, for example, the visible surface of the outermost end surface 22011 has a minimum length of at least 3 inches.

The trim defined configuration further defines a recess 2210, substantially corresponding to the recess 164, between an inner surface of the interacting portion 2202, an inner surface of the trim defined second connection system counterpart 2208, and the intermediate wall 22012, for receiving the projection 114 of the panel.

The trim 2200 and the panel 100 are co-operatively configured such that, while the connection between the trim 2200 and the panel 100 is established, the covering portion 2205 is concealing the fastener that is connecting the panel 100 to the wall 1.

In some embodiments, for example, the trim 2200 includes a trim defined space-defining counterpart 2212, substantially corresponding to the space defining counterpart 152. In some embodiments, for example, while the trim 2200 is connected to the panel 100, the trim defined space-defining counterpart 2212 and the first end-defined space-defining counterpart 112 of the panel 100 are co-operatively configured to define an internal space 2251 between the trim 2200 and the panel 100, as depicted in FIG. 4 and FIG. 13, similar to the manner by which the internal space 302 is defined via connection between first and second panels. The internal space 2251 is configured to receive deformation of at least one of the trim 2200 and the panel 100, for example, at least one of the trim defined space-defining counterpart 2212 and the first end-defined space-defining counterpart 112 of the panel 100, and functions in a manner similar to the internal space 302.

In some embodiments, for example, the wall member 2209 defines at least a portion of the trim defined space-defining counterpart 2212. In some embodiments, for example, the trim wall 2201, in particular, the intermediate wall 22012, defines at least a portion of the trim defined space-defining counterpart 2212. In some embodiments, for example, the interacting portion 2202 defines at least a portion of the trim defined space-defining counterpart 2212.

In some embodiments, for example, the internal space 2251 defined between the connected trim 2200 and panel 100 has a minimum cross-sectional area of at least 0.00097656 inches squared.

In some embodiments, for example, while the trim 2200 is connected to the panel 100, the covering portion 2205 of the trim conceals at least a portion of the first connection system counterpart configuration 30 of the panel 100. In some embodiments, for example, while the trim 2200 is connected to the panel 100, the covering portion 2205 of the trim 2200 conceals the entirety of the first connection system counterpart configuration 30 of the panel 100. In some embodiments, for example, while the trim 2200 is connected to the panel 100, the covering portion 2205 of the trim 2200 conceals the fastener-receiving portion 116 of the panel 100, such that a fastener extending through the fastener-receiving portion 116 is concealed by the covering portion 2205. Such concealment of the of the first connection system counterpart configuration 30, for example, the fastener-receiving portion 116, and a fastener extending through the fastener-receiving portion 116, provides an aesthetically pleasing appearance to the connected trim 2200 and the panel 100.

In some embodiments, for example, while the trim 2200 is connected to the panel 100, the outermost surface 2204 of the covering portion 2205 of the trim 2200 is perpendicular to the outermost end surface 22011 of the trim wall 2201.

In some embodiments, for example, while the trim 2200 is connected to the panel 100, the shoulder 114 of the panel 100 is received in the recess 2210, and the second connection system counterpart 2208 of the second connection system 34 is received in the recess 126 of the panel 100, similar to the manner in which the shoulder 114 is received in the recess 164, and the second connection system counterpart 160 of the second connection system 34 is received in the recess 126, while two panels are connected.

In some embodiments, for example, while the connected trim 2200 and panel 100 is connected to the wall 1, for example, via a fastener, the visible portion of the outermost surface 2204 of the covering portion 2205 is parallel to the surface of the wall 1 on which the connected trim 2200 and panel 100 is mounted.

In some embodiments, for example, the outermost surfaces of the trim 2200 and the panel 100 are co-planar while the trim 2200 and the panel 100 are connected, to provide an aesthetically pleasing appearance.

In some embodiments, for example, the visible surface of the covering portion 2205 has a minimum surface area of at least 1.125 inches squared. In some embodiments, for example, the visible surface of the covering portion 2205 has a minimum width of at least ⅜ inches. In some embodiments, for example, the visible surface of the covering portion 2205 has a minimum length of at least 3 inches.

In some embodiments, for example, the connection between the trim 2200 and the panel 100 is audibly discernible. In some embodiments, for example, the snap fit engagement between the trim 2200 and the panel 100 is audibly discernible. In some embodiments, for example, the audibly discernible sound of the connection between the trim 2200 and the panel 100 is effected by the displacement of the interacting portion 2202 from the interference ineffective configuration to the interference effective configuration. In some embodiments, for example, the audibly discernible sound of the connection between the trim 2200 and the panel 100 is effected by impact of the first connection system counterpart configuration 30, of the panel 100, by the trim defined connection system counterpart configuration 2250. In some embodiments, for example, the audibly discernible sound of the connection between the trim 2200 and the panel 100 is effected by the impact of the retaining surface defining configuration 122 by the covering portion 2205. In some embodiments, for example, the audibly discernible sound of the connection between the trim 2200 and the panel 100 is effected by the impact of the first connection system counterpart 110 (e.g. the notch 124) of the first connection system 32, of the panel 100, by the trim defined second connection system counterpart 2206 (e.g. a rearward projection 2206) of the first connection system 32.

In some embodiments, for example, to defeat or release the connection between connected trim 2200 and panel 100, the interacting portion 2202 is transitioned from the interference effective configuration to the interference ineffective configuration. At this point, the trim 2200 is displaceable away from the panel 100 in a direction perpendicular to the surface 22011.

In some embodiments, for example, the interacting portion 2202 includes the interference defeater 2000 disposed at the terminal end of the interacting portion 2202 for facilitating the transition of the interacting portion 2202 from the interference effective configuration to the interference ineffective configuration.

In some embodiments, for example, to defeat or release the connection between connected trim 2200 and panel 100, one of the trim 2200 and the panel 100 is rotated relative to the other of the trim 2200 and the panel 100.

In some embodiments, for example, the material of the trim 2200 includes plastic, for example, PVC, polypropylene, or recycled plastic. In some embodiments, for example, the material of the trim 2200 includes a composite, such as, for example, wood fibre composite, recycled material, or cellular foam. In some embodiments, for example, the material of the trim 2200 includes aluminum. In some embodiments, for example, the material of the trim 2200 includes fibreglass. In some embodiments, for example, the material of the trim 2200 includes wood. In some embodiments, for example, the trim 2200 is solid wood.

In some embodiments, for example, the trim 2200 is manufactured by extrusion. In some embodiments, for example, the trim 2200 is manufactured by molding. In some embodiments, for example, the trim 2200 is manufactured by pultrusion. In some embodiments, for example, the trim 2200 is manufactured by cutting a piece of wood.

Figure 31:
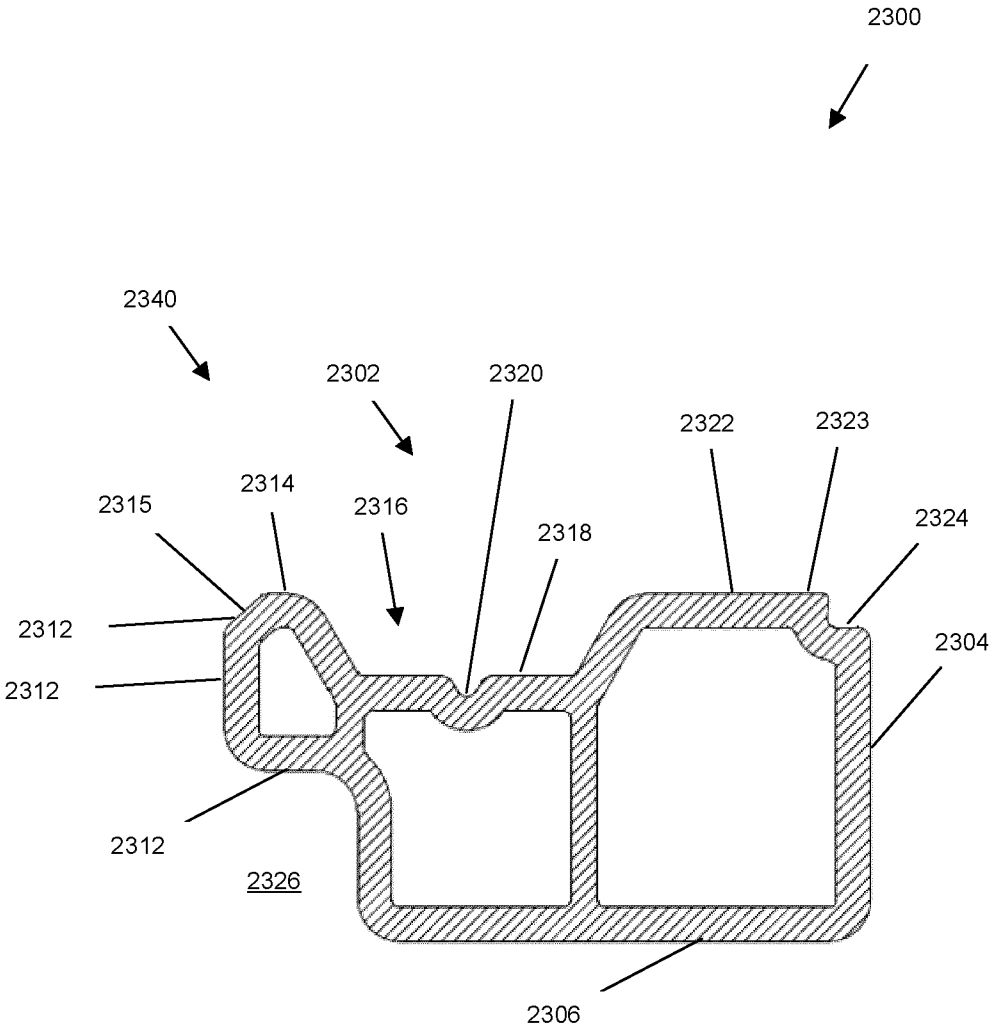
FIG. 31 is a cross-sectional view of a trim for connecting with a panel defined configuration disposed at a second end of the panel of FIG. 1.

FIG. 31 depicts an example embodiment for a trim 2300. In some embodiments, for example, the trim 2300 is configured to connect to a panel described herein, for example, the panel 100 to 100F, to conceal the trim defined configuration 2340 of the trim 2300, and provide a clean and aesthetic finish to a connected trim 2300 and panel. In some embodiments, for example, the trim 2300 is connectible to the panel 100 that is the lowermost panel 100 of the wall panel assembly, for concealing the fastener that is connecting the trim 2300 to the wall 1.

In some embodiments, for example, the trim 2300 is connectible to the panel 100, such that connected trim and panel are established, for example, to define a wall panel assembly 10.

In some embodiments, for example, the trim 2300 includes a wall-opposing surface 2306 that is configured for opposing the wall while the trim 2300 is secured to the wall 1.

The trim 2300 includes a trim defined configuration 2340 that substantially corresponds to the panel defined configuration 20 at the first end 101 of the panel 100. In particular, the trim defined configuration 2340 includes a trim-defined connection system counterpart configuration 2302 that substantially corresponds to the first connection system counterpart configuration 30 of the panel 100. The trim 2300 and the panel 100 are connectible via the trim-defined connection system counterpart configuration 2302 and the second connection system counterpart configuration 50 of the panel 100. The trim 2300 is connectible to a panel 100 in a manner substantially similar to the manner by which the connection between adjacent panels, in the wall panel assembly, is established, as described herein.

As depicted, the trim-defined connection system counterpart configuration 2302 includes a trim defined first connection system counterpart 2324 (e.g. a notch 2324) of the first connection system 32, substantially corresponding to the first connection system counterpart 110 (e.g. the notch 124) of the first connection system counterpart 32, of the panel 100, and configured to co-operate with the second connection system counterpart 158 (e.g. the projection 158) of the first connection system 32 of the panel 100 for snap fit engagement.

The trim-defined connection system counterpart configuration 2302 further includes a trim defined first connection system counterpart 2314 (e.g. a projection 2314) substantially corresponding to the first connection system counterpart 114 (e.g. the projection 114) of the second connection system counterpart 34, of the panel 100. The trim defined first connection system counterpart 2314 includes an urging surface 2315, which substantially corresponds to the urging surface 115 of the projection 114 of the panel 100. The trim defined first connection system counterpart 2314 is configured to be received in the recess 164 of the panel 100, and further configured to co-operate with the second connection system counterpart 160 of the second connection system 34, of the panel 100, to resist lifting of the panel 100 away from the trim 2300.

The trim defined configuration 2340 further includes a fastener receiving portion 2316, including a fastener locator 2320 and a fastener-engaging surface 2318, substantially corresponding to the fastener receiving portion 116, for emplacing a fastener in the fastener effective position to secure the trim 2300 to the wall 1. To connect the trim 2300 to a wall 1, the trim 2300 is disposed in abutting engagement against the wall 1, the fastener is emplaced in the fastener effective position via the fastener locator 2320, and penetrated through the fastener-engaging surface 2318 of the trim 2300, and further penetrated through the wall-opposing surface 2306 until the fastener engages the wall, such that the trim 2300 is coupled to the wall via the fastener 1.

The trim defined configuration 2340 further defines a recess 2326, substantially corresponding to the recess 126, and defined between projection 2314 and the fastener receiving portion 2316, that is configured to receive second connection system counterpart 160 of the second connection system 34, of the panel 100.

The trim 2300 and the panel 100 are co-operatively configured such that, while the connection between the trim 2300 and the panel 100 is established, the covering portion 154 is concealing the fastener that is connecting the trim 2300 to the wall 1.

In some embodiments, for example, the trim 2300 includes an outermost end surface 2304 configured for being visible while the trim 2300 is connected to the panel 100. As depicted in FIG. 31, in some embodiments, for example, the outermost end surface 2304 is perpendicular relative to the wall-opposing surface 2306. In some embodiments, for example, the outermost end surface 2304 includes a continuous surface that extends along the length of the trim 2300. In some embodiments, for example, the outermost end surface 2304 has a minimum surface area of at least 0.375 inches squared. In some embodiments, for example, the visible surface of the outermost end surface 2304 has a minimum width or height of at least ⅛ inches. In some embodiments, for example, the visible surface of the outermost end surface 2304 has a minimum length of at least 3 inches.

In some embodiments, for example, the trim defined configuration 2340 includes a wall member 2322, substantially correspond to an outer wall member of the retaining surface defining configuration 122. The wall member 2322 defines an outer surface 2323. In some embodiments, for example, the wall member 2322 is configured to support the covering portion 154 of the interacting portion 60 of the second connection system counterpart configuration 50 of the panel 100 while the trim 2300 is connected to the panel 100.

In some embodiments, for example, as depicted in FIG. 31, the trim defined first connection system counterpart 2324 (e.g. a notch 2324) of the first connection system 32 is defined between the wall member 2322 and the outermost end surface 2304.

In some embodiments, for example, the outer surface 2323 and the end surface 2304 are disposed in a perpendicular relationship.

In some embodiments, for example, the trim 2300 includes a trim-defined space-defining counterpart 2312. In some embodiments, for example, at least a portion of the trim-defined space-defining counterpart 2312 is defined by the trim-defined connection system counterpart configuration 2302. The trim-defined space-defining counterpart 2312 and the second end-defined space-defining counterpart 152 of the panel 100 are co-operatively configured to define an internal space 2350 while the trim 2300 and the panel 100 are connected, as depicted in FIG. 33 to FIG. 36, similar to the manner by which the internal space 302 is defined via connection between first and second panels. The internal space 2350 is configured to receive deformation of at least one of the trim 2300 and the panel 100, for example, at least one of the trim defined space-defining counterpart 2312 and the second end-defined space-defining counterpart 152 of the panel 100, and functions in a manner similar to the internal space 302.

As depicted in FIG. 31, in some embodiments, for example, the trim-defined space-defining counterpart 2312 is defined by at least a portion of the projection 2314.

In some embodiments, for example, the internal space 2350 defined between the connected trim 2300 and panel 100 has a minimum cross-sectional area of at least 0.00097656 inches squared.

In some embodiments, for example, while the trim 2300 is connected to the panel 100, the covering portion 154 of the panel 100 conceals at least a portion of the trim-defined configuration 2340. In some embodiments, for example, while the trim 2300 is connected to the panel 100, the covering portion 154 of the panel 100 conceals the entirety of the trim-defined configuration 2340. In some embodiments, for example, while the trim 2300 is connected to the panel 100, the covering portion 154 of the panel 100 conceals the fastener-receiving portion 2316 of the trim 2300, such that a fastener extending through the fastener-receiving portion 2316 is concealed by the covering portion 154. Such concealment of the of the trim-defined configuration 2340, for example, the trim defined connection system counterpart configuration 2302, the fastener-receiving portion 2316, and a fastener extending through the fastener-receiving portion 2316, provides an aesthetically pleasing appearance to the connected trim 2300 and the panel 100.

In some embodiments, for example, while the trim 2300 is connected to the panel 100, the outermost surface 156 of the covering portion 154 of the panel 100 is perpendicular to the outermost end surface 2304 of the trim 2300.

In some embodiments, for example, while the trim 2300 is connected to the panel 100, the projection 2314 is received in the channel 164, and the second connection system counterpart 160 of the second connection system 34 is received in the recess 2326, similar to the manner in which the shoulder 114 is received in the recess 164, and the second connection system counterpart 160 of the second connection system 34 is received in the recess 126, while two panels are connected.

In some embodiments, for example, while the connected trim 2300 and panel 100 is connected to the wall 1, for example, via a fastener, the visible portion of the outermost surface 156 of the covering portion 154 is parallel to the surface of the wall 1 on which the connected trim 2300 and panel 100 is mounted. In some embodiments, for example, while the connected trim 2300 and panel 100 is connected to the wall 1, for example, via a fastener, the visible portion of the outermost surface 156 of the covering portion 154 is parallel to the outermost surface 104 of the panel 100 to provide an aesthetically pleasing appearance.

In some embodiments, for example, while the trim 2300 is connected to the panel 100, the outermost surface 156 of the covering portion 154 of the panel 100 is perpendicular to the outermost end surface 2304 of the trim 2300. In some embodiments, for example, while the trim 2300 is connected to the panel 100, the outermost surface 156 and the outermost end surface 2304 appears to meet at a corner, for example, a rounded corner, as defined by a surface 159, for example a rounded surface 159, that extends between the outermost surface 156 of the covering portion 154 and an outermost surface of the tongue 158. In this respect, in some embodiments, for example, while the trim 2300 is connected to the panel 100, the outermost surface 156, the projection 158, and the outermost end surface 2304 are co-operatively configured to provide an aesthetically pleasing appearance.

In some embodiments, for example, while the trim 2300 is connected to the panel 100, the trim 2300 is disposed rearwardly of the covering portion 154. In some embodiments, for example, while the trim 2300 is connected to the panel 100, the trim 2300 conceals the space rearwardly of the covering portion 154. In some embodiments, for example, while the trim 2300 is connected to the panel 100, the trim 2300 conceals the recess 164 and at least a portion of the second connection system counterpart 160 of the second connection system 34 of the panel 100, to provide an aesthetically pleasing appearance.

In some embodiments, for example, while the trim 2300 is connected to the panel 100 and the connected trim 2300 and panel 100 are connected to a wall 1, the outermost end surface 2304 of the trim 2300 is perpendicular to the surface of the wall 1, to provide an aesthetically pleasing appearance.

In some embodiments, for example, while the trim 2300 is connected to the panel 100, the wall-opposing surface 2306 of the trim 2300 and the wall-opposing surface 106 of the panel 100 are co-planar, to provide an aesthetically pleasing appearance.

In some embodiments, for example, the visible surface 15A of the residual front facing surface portion 15 and the visible surface 156 of the covering portion 154 of the panel 100 are co-planar while the trim 2300 and the panel 100 are connected, to provide an aesthetically pleasing appearance.

In some embodiments, for example, the connection between the trim 2300 and the panel 100 is audibly discernible. In some embodiments, for example, the snap fit engagement between the trim 2300 and the panel 100 is audibly discernible. In some embodiments, for example, the audibly discernible sound of the connection between the trim 2300 and the panel 100 is effected by the displacement of the interacting portion 60 of the panel 100 from the interference ineffective configuration to the interference effective configuration. In some embodiments, for example, the audibly discernible sound of the connection between the trim 2300 and the panel 100 is effected by impact of the trim-defined connection system counterpart configuration 2302 by the connection system counterpart configuration 50 of the panel 100. In some embodiments, for example, the audibly discernible sound of the connection between the trim 2300 and the panel 100 is effected by the impact of the wall member 2322 by the covering portion 154. In some embodiments, for example, the audibly discernible sound of the connection between the trim 2300 and the panel 100 is effected by the impact of the trim-defined first connection system counterpart 2324 (e.g. the notch 2324) of the first connection system 32 by the second connection system counterpart 158 (e.g. the projection 158) of the first connection system 32, of the panel 100.

In some embodiments, for example, to defeat or release the connection between connected trim 2300 and panel 100, the interacting portion 60 is transitioned from the interference effective configuration to the interference ineffective configuration. At this point, the panel 100 is displaceable away from the trim 2300 in a direction perpendicular to the front facing surface 104.

In some embodiments, for example, to defeat or release the connection between connected trim 2300 and panel 100, one of the trim 2300 and the panel 100 is rotated relative to the other of the trim 2300 and the panel 100.

Figure 32:
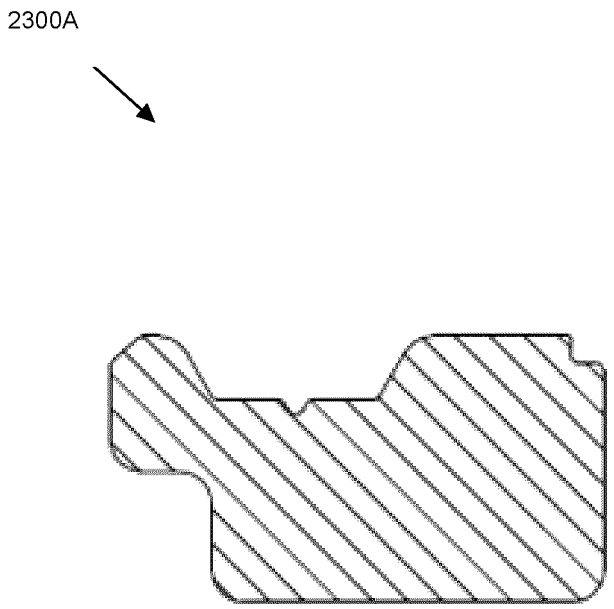
FIG. 32 is an alternate embodiment of the trim of FIG. 31.

In some embodiments, for example, the material of the trim 2300 includes plastic, for example, PVC, polypropylene, or recycled plastic. In some embodiments, for example, the material of the trim 2300 includes a composite, such as, for example, wood fibre composite, recycled material, or cellular foam. In some embodiments, for example, the material of the trim 2300 includes aluminum. In some embodiments, for example, the material of the trim 2300 includes fibreglass. In some embodiments, for example, the material of the trim 2300 includes wood. In some embodiments, for example, the trim 2300 is solid wood. FIG. 32 depicts a trim 2300A that is an alternate embodiment of the trim 2300. The trim 2300 and the trim 2300A are substantially similar, except the panel 2300A is solid wood. As depicted, in some embodiments, for example, where the 2300A is solid wood, there is an absence of hollow portions in the trim 2300A.

In some embodiments, for example, the trim 2300 is manufactured by extrusion. In some embodiments, for example, the trim 2300 is manufactured by molding. In some embodiments, for example, the trim 2300 is manufactured by pultrusion. In some embodiments, for example, the trim 2300 is manufactured by cutting a piece of wood.

In some embodiments, for example, a kit for a wall panel assembly 10 includes one or more trims and one or more panels described herein, for example, one or more of the trim 2200 and the trim 2300, and one or more panels, for example, one or more of the panel 100 to the panel 100F. In some embodiments, for example, the kit for the wall panel assembly 10 includes a trim, a first panel (e.g. one of the panels 100 to 100F), and a second panel (e.g. one of the panels 100 to 100F). In some embodiments, for example, the first panel 100 and the second panel 100 are identical. In some embodiments, for example, the first panel 100 and the second panel 100 are different.

Figure 33:
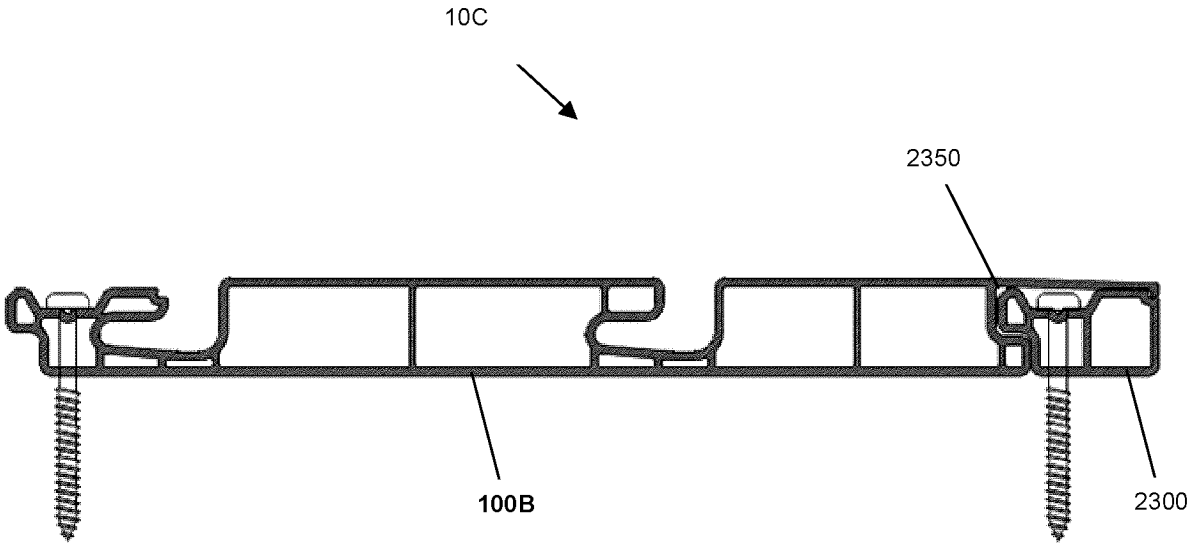
FIG. 33 is a cross-sectional view of a wall panel assembly comprising the panel of FIG. 24 and the trim of FIG. 31.

FIG. 33 depicts a wall panel assembly 10C, including a connected panel 100B and the trim 2300. As depicted, fasteners are extending through the fastener-receiving portion 116 of the panel 100B and the fastener-receiving portion 2316 of the trim 2300.

Figure 34:
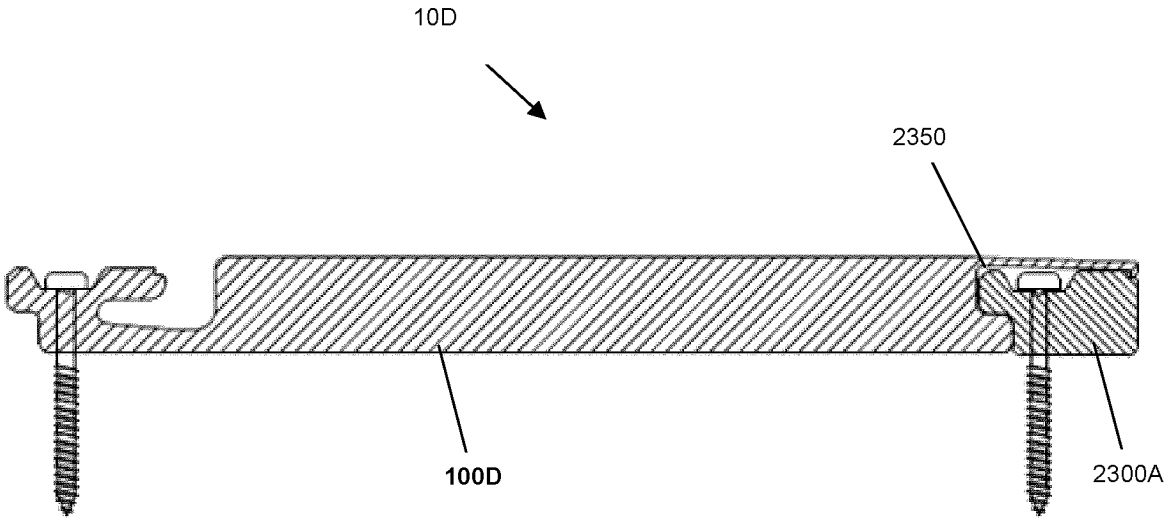
FIG. 34 is a cross-sectional view of a wall panel assembly comprising the panel of FIG. 27 and the trim of FIG. 32.

FIG. 34 depicts a wall panel assembly 10D, including a connected panel 100D and the trim 2300A. As depicted, fasteners are extending through the fastener-receiving portion 116 of the panel 100C and the fastener-receiving portion 2316 of the trim 2300A.

Figure 35:
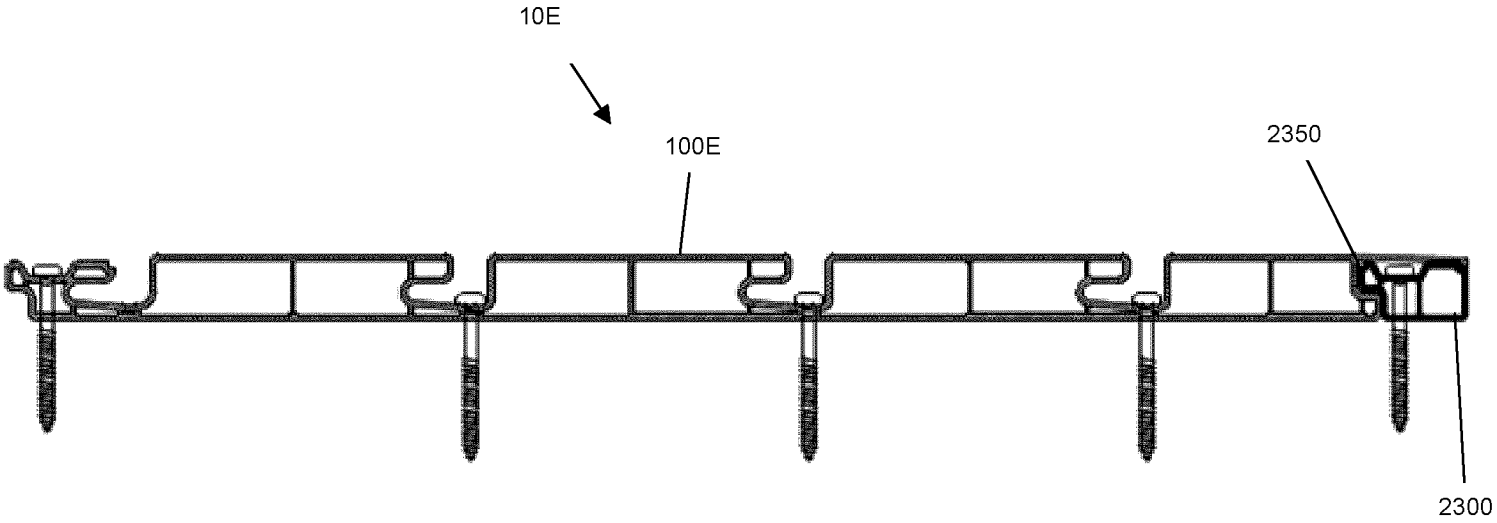
FIG. 35 is a cross-sectional view of a wall panel assembly comprising the panel of FIG. 28 and the trim of FIG. 31.

FIG. 35 depicts a wall panel assembly 10E, including a connected panel 100E and the trim 2300. As depicted, fasteners are extending through the fastener-receiving portion 116 of the panel 100E, the fastener-receiving portion 2316 of the trim 2300, and the fastener-receiving portions 1000 of the panel 100E.

Figure 36:
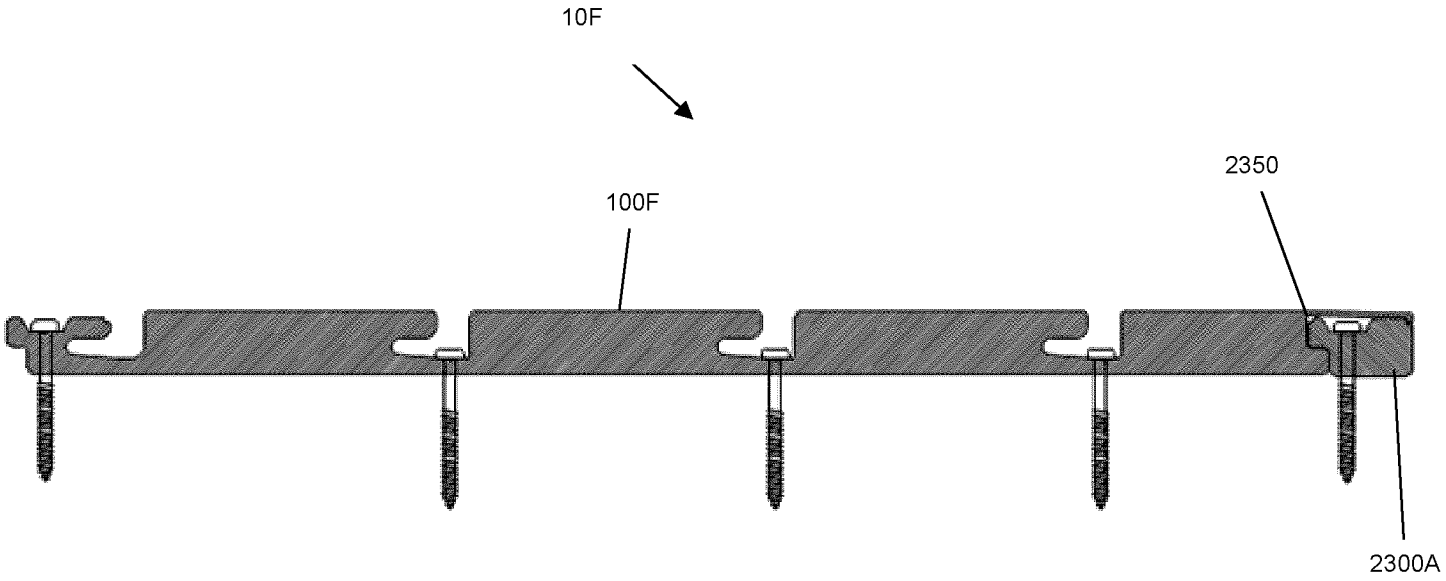
FIG. 36 is a cross-sectional view of a wall panel assembly comprising the panel of FIG. 29 and the trim of FIG. 32.

FIG. 36 depicts a wall panel assembly 10F, including a connected panel 100F and the trim 2300A. As depicted, fasteners are extending through the fastener-receiving portion 116 of the panel 100F and the fastener-receiving portion 2316 of the trim 2300A, and the fastener-receiving portions 1000 of the panel 100F.

FIG. 39 to FIG. 47 depicts an example embodiment of a bracket assembly or a mounting assembly 500. The assembly 500 is configured to be connected to a first wall surface configuration having a first pair of panel-defined connection counterparts 39 spaced apart by a first spacing distance, and further configured to be connected to a second wall surface configuration having a second pair of panel-defined connection counterparts 39 spaced apart by a second spacing distance.

In some embodiments, for example, the assembly 500 comprises a connector 504 or first connection counterpart 504, and further comprises a second connection counterpart 508. In some embodiments, for example, while the assembly 500 is disposed in an operating configuration, the first connection counterpart 504 is disposed above the second connection counterpart 508. In this respect, in some embodiments, for example, the first connection counterpart 504 is an upper connection counterpart 504, and the second connection counterpart 508 is a lower connection counterpart 508. In some embodiments, for example, as described herein, the first connection counterpart 504 is configured to co-operate with the cavity 130 of a panel 100 or a wall panel assembly 10 such that the assembly 500 is hangable from the panel or the wall panel assembly.

Figure 44:
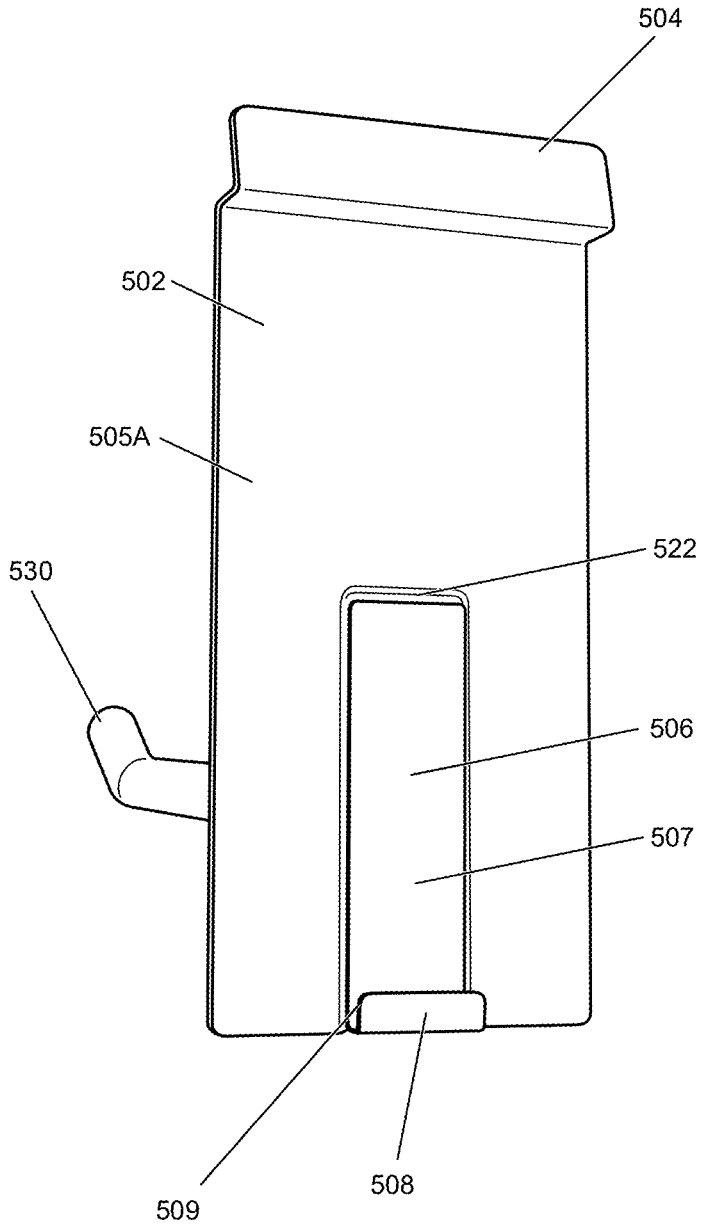
FIG. 44 is a rear perspective view of the mounting assembly of FIG. 39.
Figure 45:
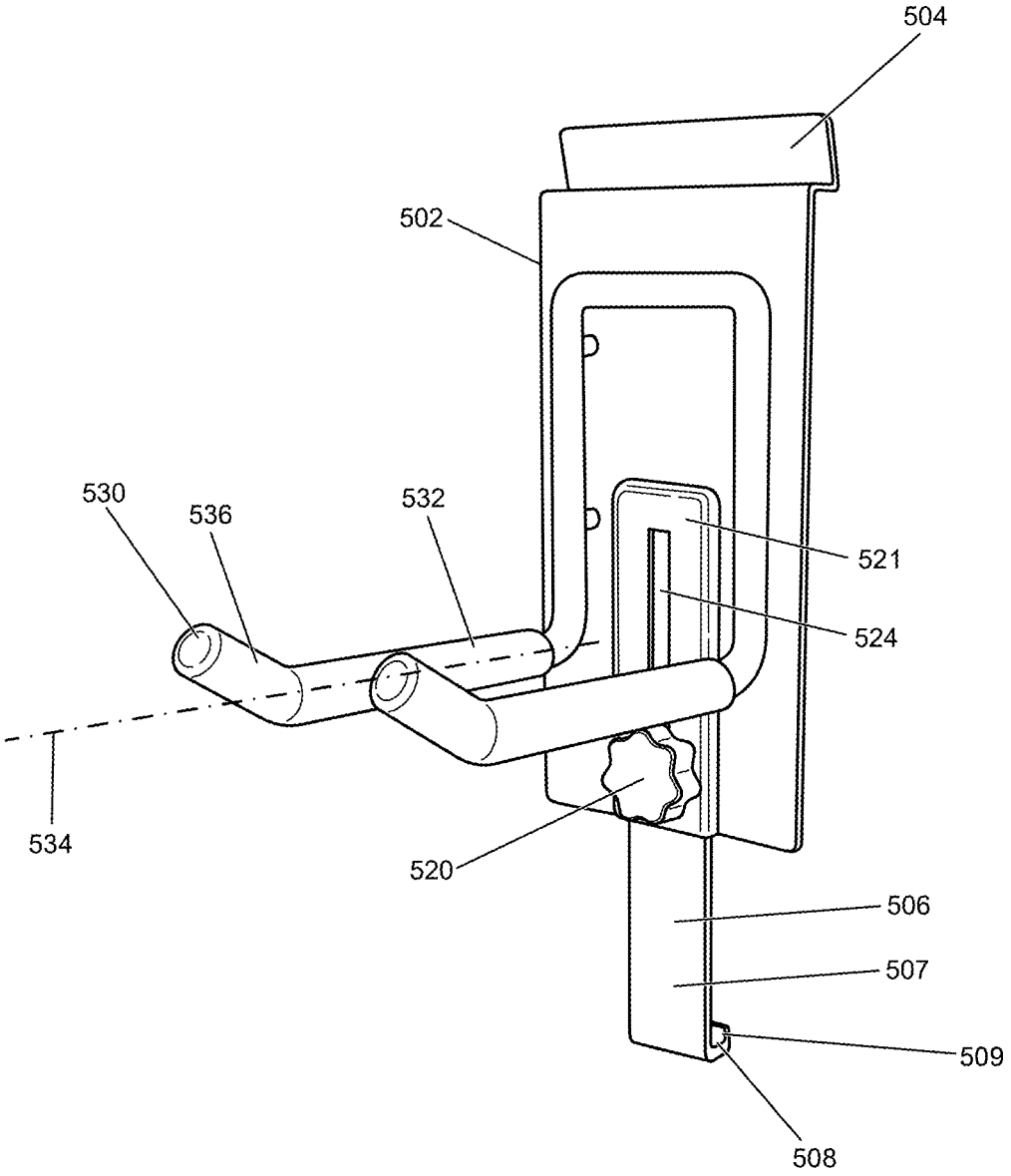
FIG. 45 is a front perspective view of the mounting assembly of FIG. 39, with the mounting assembly disposed in an extended configuration.

In some embodiments, for example, the second connection counterpart 508 includes a channel 509, as depicted in FIG. 44 and FIG. 45, to receive at least a portion of the counterpart 39 of the wall panel assembly 10 or wall panel 100, for example, at least a portion of the retaining surface defining configuration 122 or at least a portion of the interacting portion 60, for securing the assembly 500 to a wall panel assembly 10 or a panel 100. In some embodiments, for example, the second connection counterpart 508 is defined by a hook.

Figure 39:
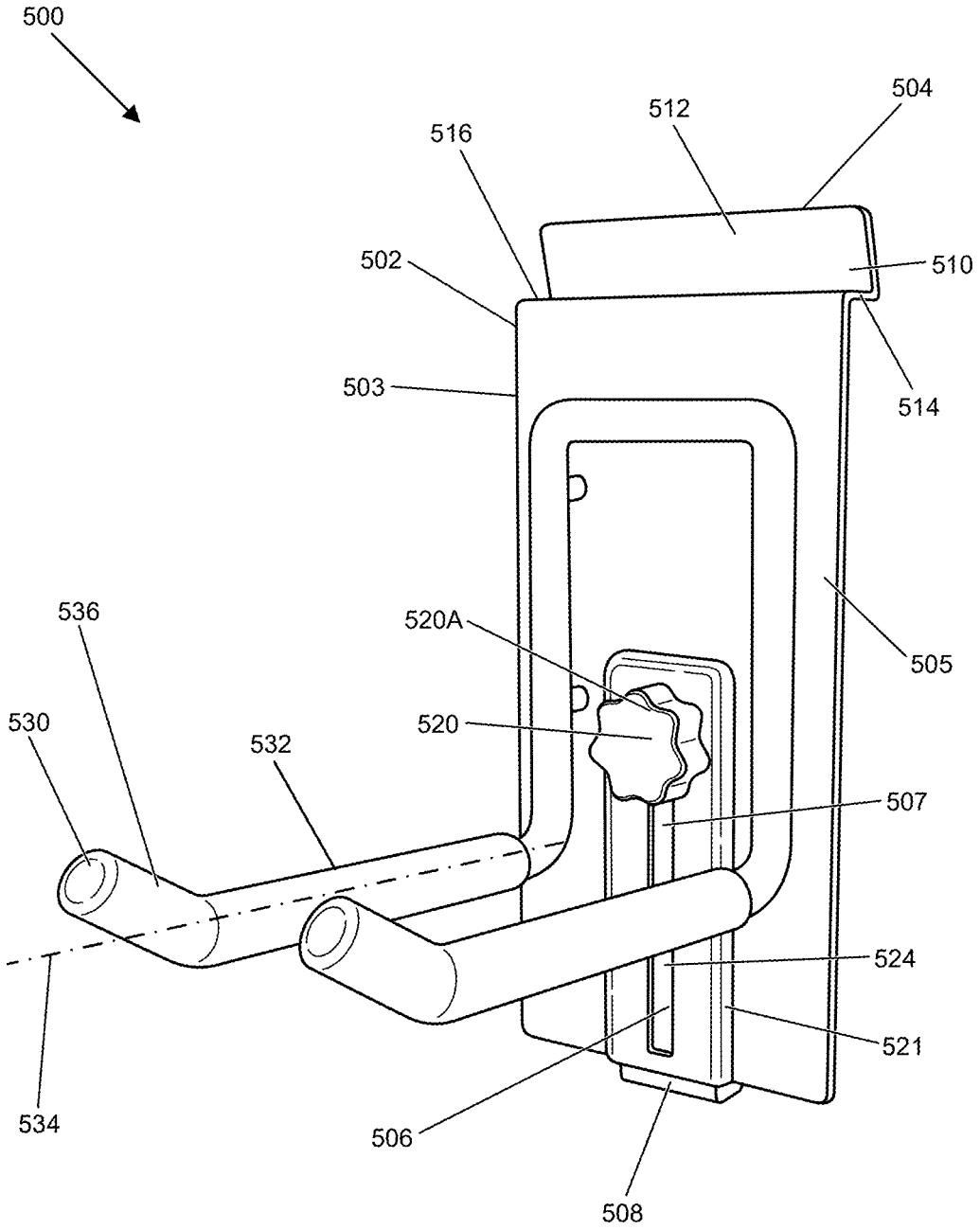
FIG. 39 is a front perspective view of a mounting assembly, with the mounting assembly disposed in a retracted configuration.
Figure 40:
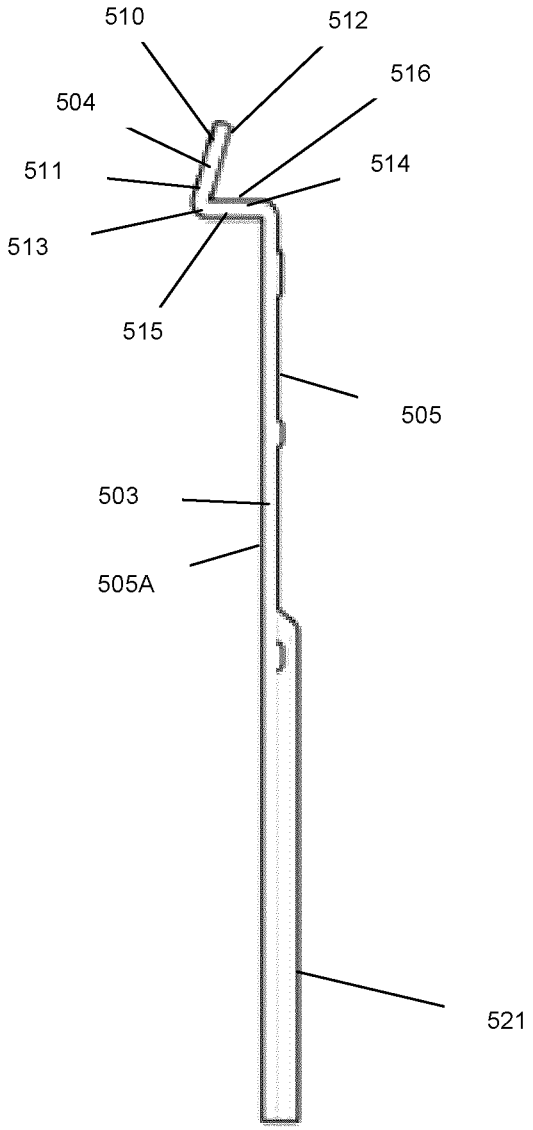
FIG. 40 is a cross-sectional view of a bracket of the mounting assembly of FIG. 39.

As depicted in FIG. 39, in some embodiments, for example, the first connection counterpart 504 and the second connection counterpart 508 are disposed at opposite ends of the assembly 500.

In some embodiments, for example, the assembly 500 is configurable in a fixed configuration and an adjustable configuration. In the fixed configuration, there is an absence of adjustability of the spacing between the first connection counterpart 504 and the second connection counterpart 508. In the adjustable configuration, spacing between the first connection counterpart 504 and the second connection counterpart 508 is adjustable between at least a first spacing and a second spacing. In the first spacing, the first connection counterpart 504 and the second connection counterpart 508 are disposed for connection to the first pair of panel-defined connection counterparts 39, and in the second spacing, the first connection counterpart 504 and the second connection counterpart 508 are disposed for connection to the second pair of panel-defined connection counterparts 39.

In some embodiments, for example, a first panel-defined connection counterpart 39 of the first pair of panel-defined connection counterparts 39 includes a cavity 130, for example, the cavity 130 of the panel 100, as depicted in FIG. 1, for receiving the first connection counterpart 504. In some embodiments, for example, a second panel-defined connection counterpart 39 of the first pair of panel-defined connection counterparts 39 includes a cavity 130, for example, a cavity 130 of the panel 100 or a cavity 130 of another panel 100, for receiving the second connection counterpart 508. In some embodiments, for example, a first panel-defined connection counterpart 39 of the second pair of panel-defined connection counterparts 39 includes a cavity 130, for example, the cavity 130 of the panel 100, for receiving the first connection counterpart 504. In some embodiments, for example, a second panel-defined connection counterparts 39 of the second pair of panel-defined connection counterparts 39 includes a cavity 130, for example, a cavity 130 of the panel 100 or a cavity 130 of another panel 100, for receiving the second connection counterpart 508.

In some embodiments, for example, the first spacing distance of the first pair of panel-defined connection counterparts 39 is different from the second spacing distance of the second pair of panel-defined connection counterparts 39. In some embodiments, for example, the first spacing distance of the first pair of panel-defined connection counterparts 39 is 1 inch. In some embodiments, for example, the second spacing distance of the second pair of panel-defined connection counterparts 39 is 4 inches. In some embodiments, for example, the first spacing distance of the first pair of panel-defined connection counterparts 39 is 3 inches. In some embodiments, for example, the second spacing distance of the second pair of panel-defined connection counterparts 39 is 9 inches. In some embodiments, for example, the first spacing distance of the first pair of panel-defined connection counterparts 39 is 6 inches. In some embodiments, for example, the second spacing distance of the second pair of panel-defined connection counterparts 39 is 8 inches. In some embodiments, for example, the first spacing distance of the first pair of panel-defined connection counterparts 39 is 10 inches. In some embodiments, for example, the second spacing distance of the second pair of panel-defined connection counterparts 39 is 12 inches.

In some embodiments, for example, adjusting of the spacing from the first spacing to the second spacing is effected by displacement of the second connection counterpart 508 towards the first connection counterpart 504. In some embodiments, for example, adjusting of the spacing from the second spacing to the first spacing is effected by displacement of the second connection counterpart 508 away from the first connection counterpart 504.

In some embodiments, for example, adjusting of the spacing from the first spacing to the second spacing is effected by displacement of the second connection counterpart 508 away from the first connection counterpart 504. In some embodiments, for example, adjusting of the spacing from the second spacing to the first spacing is effected by displacement of the second connection counterpart 508 towards the first connection counterpart 504.

In some embodiments, for example, the first wall surface configuration and the second wall surface configuration are defined on the same wall panel assembly 10.

In some embodiments, for example, wherein the first wall surface configuration and the second wall surface configuration are defined on the same wall panel assembly 10, the first pair of panel-defined connection counterparts 39 is defined by a first panel-defined connection counterpart 39 and a second panel-defined connection counterpart 39, and the second pair of panel-defined connection counterpart 39 is defined by a third panel-defined connection counterpart 39 and a fourth panel-defined connection counterpart 39.

In some embodiments, for example, wherein the first wall surface configuration and the second wall surface configuration are defined on the same wall panel assembly 10, the first pair of panel-defined connection counterparts 39 is defined by a first panel-defined connection counterpart 39 and a second panel-defined connection counterpart 39, and the second pair of panel-defined connection counterpart 39 is defined by the first panel-defined connection counterpart 39 and a third panel-defined connection counterpart 39. In some embodiments, for example, wherein the first wall surface configuration and the second wall surface configuration are defined on the same wall panel assembly 10, the first pair of panel-defined connection counterparts 39 is defined by a first panel-defined connection counterpart 39 and a second panel-defined connection counterpart 39, and the second pair of panel-defined connection counterpart 39 is defined by the second panel-defined connection counterpart 39 and a third panel-defined connection counterpart 39.

In some embodiments, for example, the first wall surface configuration is defined on a first wall panel assembly 10, and the second wall surface configuration is defined on a second wall panel assembly 10 that is different from the first wall panel assembly 10.

In some embodiments, for example, the assembly 500 includes a mounting bracket 502. In some embodiments, for example, the first connection counterpart 504 is defined by the bracket 502. In this respect, in some embodiments, for example, the first connection counterpart 504 is a bracket connector 504 or a first bracket-defined connection counterpart 504.

In some embodiments, for example, the bracket 502 comprises a flange 503, as depicted in FIG. 39, to which a load supporter 530 of the assembly is connected. In some embodiments, for example, the flange 503 defines a front surface 505 and a rear surface 505A that is disposed on an opposite side of the flange 503 relative to the front surface 505. In some embodiments, for example, the front surface 505 defines a surface configured for being visible while the mounting assembly 500 is connected to the wall panel assembly 10 or panel 100. In some embodiments, for example, the rear surface 505A defines a panel-opposing surface configured for opposing the front facing surface 104 while the mounting assembly 500 is connected to the wall panel assembly 10 or panel 100. In some embodiments, for example, the front surface 505 is the front surface 505 of the bracket 502.

In some embodiments, for example, the flange 503 and the first connection counterpart 504 are connected. In some embodiments, for example, the bracket 502, comprising the flange 503 and the first connection counterpart 504, is of unitary one piece construction. In some embodiments, for example, the first connection counterpart 504 comprises: 1) a retaining member 510, defining a retaining surface 512, 2) a connecting member 514 defining a connecting member surface 516 and a seating surface 515, wherein the seating surface 515 is disposed on an opposite side of the connecting member 514, relative to the connecting member surface 516, and 3) an intermediate member 511, extending between the retaining member 510 and the connecting member 514, the intermediate member 511 having a member portion that defines an arcuate surface 513, wherein the connecting member 514 connects the retaining member 510 and the intermediate member 511 to the flange 503.

In some embodiments, for example, the retaining member 510 is configured to co-operate with one of the panel-defined connection counterparts 39 of the pair of first panel-defined connection counterparts 39 such that, while the bracket 502 is connected to the wall panel assembly configuration (e.g. while the retained configuration is established), the retaining surface 512 is disposed in opposing relationship with a retaining surface of the one of the panel-defined connection counterparts 39, for example, the retaining surface 134 of the cavity 130, of the pair of panel-defined connection counterparts 39, such that displacement of the mounting bracket 502, away from the wall surface configuration, is resisted.

In some embodiments, for example, as depicted in FIG. 41 and FIG. 43, while the retained configuration is established, the retaining surface 512 is disposed in engagement, for example, abutting engagement, with the retaining surface 134. In some embodiments, for example, as depicted in FIG. 41 and FIG. 43, while the retained configuration is established, the arcuate surface 513 is disposed in engagement, for example, abutting engagement, with the guide surface 136. In some embodiments, for example, while the retained configuration is established, the arcuate surface 513 is disposed in engagement, for example, abutting engagement, with the outer surface 72A of the first wall 72 of the rear wall configuration 70. In some embodiments, for example, as depicted in FIG. 41 and FIG. 43, while the retained configuration is established, the seating surface 515 is disposed in engagement, for example, abutting engagement, with the support surface 142.

In some embodiments, for example, as depicted in FIG. 41 and FIG. 43, while the retained configuration is established, the retaining surface 512 is bearing against the retaining surface 134. In some embodiments, for example, as depicted in FIG. 41 and FIG. 43, while the retained configuration is established, the arcuate surface 513 is bearing against the guide surface 136. In some embodiments, for example, while the retained configuration is established, the arcuate surface 513 is bearing against the outer surface 72A of the first wall 72 of the rear wall configuration 70. In some embodiments, for example, as depicted in FIG. 41 and FIG. 43, while the retained configuration is established, the seating surface 515 is bearing against the support surface 142.

In this respect, while the retained configuration is established, the fit of the first connection counterpart 504 in the cavity 130 is a friction fit. In some embodiments, for example, while the retained configuration is established, the fit of the first connection counterpart 504 in the cavity 130 is an interference fit.

In some embodiments, for example, the tight fit or snug fit of the first connection counterpart 504 in the cavity 130 is to interfere with displacement of the first connection counterpart 504, relative to the cavity 130, and therefore, interfere with displacement of the bracket 502, relative to the cavity 130, such that displacement of the bracket 502, relative to the cavity 130, while a load that is mounted to the load supporter 530, is resisted.

In some embodiments, for example, the retaining surface 512, the retaining surface 134, the arcuate surface 513, and the guide surface 136 are co-operatively configured such that, while the retained configuration is established, forwardly or rearwardly displacement of the bracket 502, relative to the panel 100, in a direction that is parallel to a perpendicular axis of the front facing surface 104 (e.g. parallel to a perpendicular axis of the front facing surface 105 of the residual front facing wall portion 15), is resisted In some embodiments, for example, the arcuate surface 513 and the guide surface 136 are co-operatively configured such that, while the retained configuration is established, rotation of the bracket 502, relative to the panel 100, about a rotation axis that is parallel to a perpendicular axis of the front facing surface 104 (e.g. parallel to a perpendicular axis of the front facing surface 105 of the residual front facing wall portion 15), is resisted In some embodiments, for example, the seating surface 515 and the supporting surface 142 are co-operatively configured such that, while the retained configuration is established, rotation of the bracket 502, relative to the panel 100, about a rotation axis that is parallel to a perpendicular axis of the front facing surface 104 (e.g. parallel to a perpendicular axis of the front facing surface 105 of the residual front facing wall portion 15), is resisted In some embodiments, for example, the arcuate surface 513, the guide surface 136, the seating surface 515, and the supporting surface 142 are co-operatively configured such that, while the retained configuration is established, rotation of the bracket 502, relative to the panel 100, about a rotation axis that is parallel to a perpendicular axis of the front facing surface 104 (e.g. parallel to a perpendicular axis of the front facing surface 105 of the residual front facing wall portion 15), is resisted In some embodiments, for example, as depicted in FIG. 41 and FIG. 43, while the retained configuration is established, the flange 503 and the front facing wall 14 are disposed in opposing relationship. In some embodiments, for example, as depicted in FIG. 41 and FIG. 43, while the retained configuration is established, the flange 503 and the front facing wall 14 are disposed in abutting engagement. In some embodiments, for example, as depicted in FIG. 41 and FIG. 43, while the retained configuration is established, the flange 503 is bearing against the front facing wall 14.

In some embodiments, for example, the retaining surface 512 defines a perpendicular axis, the connecting member surface 516 defines a perpendicular axis, and an acute angle defined between the perpendicular axis of the retaining surface 512 and the perpendicular axis of the connecting member surface 516 has a maximum value of 85 degrees.

In some embodiments, for example, the first connection counterpart 504 is an L-shaped first connection counterpart 504. In some embodiments, for example, the retaining member 510 and the connecting member 514 are disposed in a non-perpendicular relationship.

In some embodiments, for example, the assembly comprises a connection counterpart-defining configuration 506. In some embodiments, for example, the bracket 502 is releasably couplable to the connection counterpart-defining configuration 506. In some embodiments, for example, while the bracket 502 is releasably coupled to the connection counterpart-defining configuration 506, the mounting assembly 500 is defined. In some embodiments, for example, the releasable coupling of the bracket 502 and the connection counterpart-defining configuration 506 is such that the connection counterpart-defining configuration 506 slidably coupled to the bracket 502.

As depicted in FIG. 39, the second connection counterpart 508 is defined by the connection counterpart-defining configuration 506. As depicted in FIG. 39 and FIG. 44 to FIG. 47, in some embodiments, for example, the connection counterpart-defining configuration 506 includes an intermediate member 507. In some embodiments, for example, the second connection counterpart 508 is connected to the intermediate member 507. In some embodiments, for example, the connection counterpart-defining configuration 506, which includes the second connection counterpart 508 and the intermediate member 507, is of unitary one piece construction.

The bracket 502, for example, the flange 503, is releasably couplable to the connection counterpart-defining configuration 506, such that, while the bracket 502 and the connection counterpart-defining configuration 506 are releasably coupled, the relative displacement is effectible between the bracket 502 and the connection counterpart-defining configuration 506. In some embodiments, for example, adjusting of the spacing between the first and second connection counterparts 504 and 508 is effectible by relative displacement between the bracket 502 and the connection counterpart-defining configuration 506. In some embodiments, for example, the relative displacement effectible between the bracket 502 and the connection counterpart-defining configuration 506 includes sliding displacement.

In some embodiments, for example, the assembly 500 includes a locking mechanism 520. In some embodiments, for example, the locking mechanism 520 includes a rotatable head 520A, and a threaded rod or stud that is releasably couplable to the rotatable head 520A via the threading at a first end, and that is also connected to the connection counterpart-defining configuration 506, for example, the intermediate member 507, via welding, at the second end. As depicted in FIG. 39 and FIG. 44, the intermediate member 507 is disposed on a first side of the flange 503 (e.g. rear side of the flange 503), and the rotatable head 520A is disposed on a second side of the flange 503 that is opposite the first side (e.g. front side of the flange 503). In some embodiments, for example, the locking mechanism 520 is configured to effect frictional engagement between the bracket 502, for example, the flange 503, and the intermediate member 507, and further configured to defeat the frictional engagement between the bracket 502, for example, the flange 503, and the intermediate member 507.

The bracket 502, the connection counterpart-defining configuration 506, and the locking mechanism 520 are co-operatively configured to transition between a displacement-effective configuration and a displacement ineffective configuration. In the displacement effective configuration, the bracket 502, the connection counterpart-defining configuration 506, and the locking mechanism 520 are co-operatively configured such that there is an absence of frictional engagement of the flange 503 and the intermediate member 507 by the locking mechanism 520, such that the assembly 500 is disposed in the adjustable configuration, wherein the connection counterpart-defining configuration 506 is displaceable relative to the bracket 502. In the displacement ineffective configuration, the bracket 502, the connection counterpart-defining configuration 506, and the locking mechanism 520 are co-operatively configured such that frictional engagement of the flange 503 and the intermediate member 507 is effected by the locking mechanism 520, such that the assembly 500 is disposed in the fixed configuration, wherein relative displacement between the connection counterpart-defining configuration 506 and the bracket 502 is resisted.

In some embodiments, for example, the bracket 502, the connection counterpart-defining configuration 506, and the locking mechanism 520 are transitionable from the displacement effective configuration to the displacement-ineffective configuration in response to actuation of the locking mechanism 520, for example, by rotation of the head 520A in a first direction, for example, a clockwise direction. In some embodiments, for example, in response to actuation of the locking mechanism 520 in the first direction, a force is applied by the locking mechanism 520 to the connection counterpart-defining configuration 506 to displace the connection counterpart-defining configuration 506 towards the bracket 502, such that at the intermediate member 507 becomes disposed in frictional engagement with the flange 503, with effect that the assembly 500 becomes disposed in the fixed configuration.

In some embodiments, for example, the bracket 502, the connection counterpart-defining configuration 506, and the locking mechanism 520 are transitionable from the displacement ineffective configuration to the displacement effective configuration in response to actuation of the locking mechanism 520, for example, by rotation of the head 520A in a second direction that is opposite the first direction, for example, a counter clockwise direction. In some embodiments, for example, in response to actuation of the locking mechanism 520 in the second direction, a force is applied by the locking mechanism 520 to the connection counterpart-defining configuration 506 to displace the connection counterpart-defining configuration 506 away from the bracket 502, such that frictional engagement between the flange 503 and the intermediate member 507 is defeated, with effect that the assembly 500 becomes disposed in the fixed configuration.

In some embodiments, for example, the bracket 502 includes a slot 524. As depicted, in some embodiments, for example, the slot 524 is a linear slot. As depicted, the slot 524 is defined by the flange 503. The slot 524 extends from a bottom end of the flange 503. As depicted in FIG. 39, the slot 524 extends from the bottom end of the flange 503 to the middle of the flange 503. In some embodiments, for example, the length of the slot 524 is generally half the length of the flange 503. The slot 524 is configured to receive at least a portion of the threaded stud of the locking mechanism 520, such that the threaded stud extends through the slot 524, such that, while the rotatable head 520A is releasably coupled to the threaded stud via the threading, the bracket 502 and the connection counterpart-defining configuration 506 are releasably coupled, and the intermediate member 507 is disposed on the first side of the flange 503 (e.g. rear side of the flange 503), and the rotatable head 520A is disposed on the second side of the flange 503 that is opposite the first side (e.g. front side of the flange 503). In some embodiments, for example, the slot 524 limits displacement of the threaded stud of the locking mechanism 520, and therefore, limits the displacement of the connection counterpart-defining configuration 506, relative to the bracket 502. In some embodiments, for example, the slot 524 defines an upper terminal end that limits further upward displacement of the threaded stud of the locking mechanism 520 and therefore, limits further upward displacement of the connection counterpart-defining configuration 506, relative to the bracket 502. In some embodiments, for example, the slot 524 defines a lower terminal end that limits further downward displacement of the threaded stud of the locking mechanism 520 and therefore, limits further downward displacement of the connection counterpart-defining configuration 506, relative to the bracket 502.

In some embodiments, for example, the flange 503 includes a raised portion 521 that defines a recess 522 for receiving at least a portion of the connection counterpart-defining configuration 506, in particular, for receiving at least a portion of the intermediate member 507. While the bracket 502 and the connection counterpart-defining configuration 506 are releasably coupled, at least a portion of the intermediate member 507 is received in the recess 522.

In some embodiments, for example, the flange 503 includes the recess 522 for receiving at least a portion of the intermediate member 507, while the bracket 502 and the connection counterpart-defining configuration 506 are releasably coupled, such that, while the bracket 502 and the connection counterpart-defining configuration 506 are releasably coupled, the intermediate member 507 is not disposed rearwardly of the rear surface 505A of the flange 503. In some embodiments, for example, it is desirable for the intermediate member 507 to not be disposed rearwardly of the rear surface 505A of the flange 503, while the bracket 502 and the connection counterpart-defining configuration 506 are releasably coupled, as disposition of the intermediate member 507 rearwardly of the rear surface 505A, while the bracket 502 and the connection counterpart-defining configuration 506 are releasably coupled, interferes with the securing of the mounting assembly 500 to the wall panel assembly 10 or the panel 100.

In some embodiments, for example, the recess 522 and the connection counterpart-defining configuration 506 are co-operatively configured such that the connection counterpart-defining configuration 506 is slidable, relative to the bracket 502, while the at least a portion of the connection counterpart-defining configuration 506, for example, the intermediate member 507, is received in the recess 522.

As depicted, in some embodiments, for example, the slot 524 is defined by the raised portion 521.

In some embodiments, for example, the assembly 500 is configurable in a retracted configuration, an extended configuration, and an intermediate configuration. In the retracted configuration, the spacing distance between the first connection counterpart 504 and the second connection counterpart 508 is a minimum spacing distance, as depicted in FIG. 39 and FIG. 44. In some embodiments, for example, the bracket 502, the locking mechanism 520, and the connection counterpart-defining configuration 506 are co-operatively configured such that, while the locking mechanism 520, for example, the threaded stud, is disposed at the upper terminal end of the slot 524, the assembly 500 is disposed in the retracted configuration. In some embodiments, for example, while the assembly 500 is disposed in the retracted configuration, the intermediate member 507 is entirely disposed in the recess 522, for example, as depicted in FIG. 44. In the extended configuration, the spacing distance between the first connection counterpart 504 and the second connection counterpart 508 is a maximum spacing distance, as depicted in FIG. 45. In some embodiments, for example, the bracket 502, the locking mechanism 520, and the connection counterpart-defining configuration 506 are co-operatively configured such that, while the locking mechanism 520, for example, the threaded stud, is disposed at the lower terminal end of the slot 524, the assembly 500 is disposed in the extended configuration. In the intermediate configuration, the spacing distance between the first connection counterpart 504 and the second connection counterpart 508 is between the minimum spacing distance and the maximum spacing distance. In some embodiments, for example, the bracket 502, the locking mechanism 520, and the connection counterpart-defining configuration 506 are co-operatively configured such that, while the locking mechanism 520, for example, the threaded stud, is disposed between the upper terminal end and the lower terminal end of the slot 524, the assembly 500 is disposed in the intermediate configuration.

In some embodiments, for example, the minimum and maximum spacing distances between the first connection counterpart 504 and the second connection counterpart 508 is defined based on: 1) the length of the slot 524, 2) the position of the slot 524 on the flange 503, and 2) the length of the intermediate member 507.

In some embodiments, for example, the bracket 502 and the connection counterpart-defining configuration 506 are co-operatively configured such that the minimum spacing distance between the first connection counterpart 504 and the second connection counterpart 508 is 1 inch, and the maximum spacing distance between the first connection counterpart 504 and the second connection counterpart 508 is 12 inches.

In some embodiments, for example, for a given length of the slot 524, a decrease in length of the intermediate member 507 decreases the minimum and maximum spacing distances between the first connection counterpart 504 and the second connection counterpart 508, and an increase in length of the intermediate member 507 increases the minimum and maximum spacing distances between the first connection counterpart 504 and the second connection counterpart 508.

In some embodiments, for example, for a given length of the intermediate member 507, and for a slot 524 that extends from the bottom of the flange 503 in an upward direction, a decrease in length of the slot 524 increases the minimum spacing distance between the first connection counterpart 504 and the second connection counterpart 508, but does not increase the maximum spacing distance between the first connection counterpart 504 and the second connection counterpart 508, and an increase in length of the slot 524 decreases the minimum spacing distance between the first connection counterpart 504 and the second connection counterpart 508, but does not decrease the maximum spacing distance between the first connection counterpart 504 and the second connection counterpart 508

In some embodiments, for example, the mounting assembly 500 includes a load supporter 530. In some embodiments, for example, the load supporter 530 is connected to the bracket 502, for example, the flange 530, for example, by welding, mechanical fasteners, adhesives, and the like. The load supporter 530 includes a load-supporting portion 532, the load-supporting portion configured to support a load, such as tires, storage boxes and bins, tools, sports equipment, outdoor equipment, lumber, clothes, appliances, pool accessories and toys, and the like. As depicted in FIG. 39, in some embodiments, for example the load supporter 530 includes two hooks. In some embodiments, for example, the load supporter includes 530 one hook. In some embodiments, for example, the load supporter includes 530 a ring from which a load is hung. In some embodiments, for example, the load supporter includes 530 a ring from which a load is received. In some embodiments, for example, the load supporter 300 includes a basket in which a load is received. In some embodiments, for example, the load supporter 300 includes a rod on which a load is supported, for example, a rod to hang clothes.

In some embodiments, for example, as depicted in FIG. 39, FIG. 41, and FIG. 45, the load-supporting portion 532 extends outwardly, relative to the front surface 505 of the flange 503. In some embodiments, for example, the load-supporting portion 532 extends outwardly, relative to the front surface 505 of the flange 503, along a plane that is perpendicular to a plane defined by the front surface 505 of the flange 503. In some embodiments, for example, the load-supporting portion 532 extends in a direction along an axis 534 that traverses a plane defined by the front surface 505 of the flange 503. In some embodiments, for example, the traversing of the plane defined by the front surface 505 of the flange 503 by the extension axis of the load-supporting portion 532 is such that the axis 534 is normal to the plane defined by the front surface 505 of the flange 503. In some embodiments, for example, the traversing of the plane defined by the front surface 505 of the flange 503 by the extension axis 534 of the load-supporting portion 532 is such that the axis 534 is angled relative to the plane defined by the front surface 505 of the flange 503, the axis 534 and the plane defining an acute angle (e.g. the load supporting portion 532 extends from the flange 503 in a direction to the left or to the right). In some embodiments, for example, the acute angle defined between the axis 534 and the plane defined by the front surface 505 of the flange 503 has a minimum value of at least 60 degrees.

In some embodiments, for example, as depicted in FIG. 41, the load-supporting portion 532 extends outwardly and in an upward direction, relative to the front surface 505 of the flange 503. In this respect, in some embodiments, for example, the axis 534 is angled upwardly relative to a normal axis of the plane defined by the front surface 505 of the flange 503, the axis 534 and the normal axis defining an acute angle therebetween. In some embodiments, for example, the acute angle defined between the axis 534 and the normal axis of the plane defined by the front surface 505 of the flange 503 has a minimum value of at least 1 degree.

In some embodiments, for example, the load-supporting portion 532 extends outwardly and in a downward direction, relative to the front surface 505 of the flange 503. In this respect, in some embodiments, for example, the axis 534 is angled downwardly relative to a normal axis of the plane defined by the front surface 505 of the flange 503, the axis 534 and the normal axis defining an acute angle therebetween. In some embodiments, for example, the acute angle defined between the axis 534 and the normal axis of the plane defined by the front surface 505 of the flange 503 has a maximum value of 5 degrees.

In some embodiments, for example, the load supporter 530 includes a load-retaining portion 536, configured to resist removal of a load that is supported by the load-supporting portion 532. As depicted in FIG. 39 and FIG. 41, the load-retaining portion 536 is angled relative to the load-supporting portion 532. In some embodiments, for example, the acute angle defined between load supporting portion 532 and the load-retaining portion 536 has a minimum value of at least 5 degrees. Due to the angled disposition of the load-retaining portion 536, relative to the load-supporting portion 532, while a load is supported by the load-supporting portion 532, if the load is displaced in a direction that is parallel to the axis 534, the load will engage the load-retaining portion 536, which will resist further displacement of the load in the direction that is parallel to the axis 534. To remove the load, the direction of displacement of the load is to be changed, in particular, to a direction along an axis of extension of the load-retaining portion 536, which is angled relative to the axis 534.

In some embodiments, for example, the mounting assembly 500 includes one bracket 502, and a load supporter 530, for example, one or more hooks, baskets, hanging rods, and the like, that is connected to the bracket 502, and further includes one connection counterpart-defining configuration 506 that is releasably coupled to the bracket 502. In such embodiments, for example, while the mounting assembly 500 is secured to a wall panel assembly 10 or panel 100, the load that is supported by the load supporter 530 is distributed to the wall panel assembly 10 or panel 100 via the bracket 502.

In some embodiments, for example, the mounting assembly 500 includes one bracket 502, and a load supporter 530, for example, one or more hooks, baskets, hanging rods, and the like, that is connected to the bracket 502, and further includes more than one connection counterpart-defining configuration 506 that is releasably coupled to the bracket 502. In such embodiments, for example, for each one of the plurality of connection counterpart-defining configuration 506, the flange 503 defines a recess 522 for receiving the intermediate member 507, and further defines a slot 524 for receiving the threaded stud of the connection counterpart-defining configuration 506 and defining the minimum and maximum spacing distances between the first connection system counterpart 504 and the second connection system counterpart 508 of the connection counterpart-defining configuration 506. In such embodiments, for example, while the mounting assembly 500 is secured to a wall panel assembly 10 or panel 100, the load that is supported by the load supporter 530 is distributed to the wall panel assembly 10 or panel 100 via the bracket 502.

In some embodiments, for example, the mounting assembly 500 includes more than one bracket 502, and a load supporter 530, for example, one or more hooks, baskets, hanging rods, and the like, that is connected to the brackets 502, and, for each one of the brackets 502, independently, the assembly 500 further includes a connection counterpart-defining configuration 506 that is connected to the bracket 502. In such embodiments, for example, while the mounting assembly 500 is secured to a wall panel assembly 10 or panel 100, the load that is supported by the load supporter 530 is distributed to the wall panel assembly 10 or panel 100 via the plurality of brackets 502.

To connect the assembly 500 to a wall panel assembly 10, as depicted in FIG. 41, the spacing of the first connection counterpart 504 and the second connection counterpart 508 is adjusted to correspond to the spacing distance between a pair of cavities 130, the pair of cavities 130 including an upper cavity 130 and a lower cavity 130, wherein the upper cavity 130 is disposed above the lower cavity 130 while the wall panel assembly 10 is connected to a wall. As depicted, the upper cavity 130 is the cavity 130 of a panel 100 (e.g. an upper panel 100), and the lower cavity 130 is the cavity 130 of an adjacent panel 100 (e.g. a lower panel 100). Then, the first connection counterpart 504 is inserted into the upper cavity 130 and rotated, relative to the wall panel assembly 10, to retain the bracket 502 to the wall panel assembly 10, as described herein. At this point, the bracket 502 is hanging from the wall panel assembly 10, wherein the bracket 502 is vertically supported by the wall panel assembly 10, and displacement of the bracket 502, relative to the wall panel assembly 10, in a direction that is normal to the outermost surface of the wall panel assembly 10, is opposed. At the same time, the second connection counterpart 508 is disposed into the lower cavity 130, as depicted in FIG. 41. To secure the bracket 502 to the wall panel assembly 10, the spacing of the first connection counterpart 504 and the second connection counterpart 508, while the first connector counterpart 504 is disposed in the upper cavity 130 and the second connection counterpart 508 is disposed in the lower cavity 130, is adjusted, for example, decreased, such that the mounting assembly 500 is gripping the wall panel assembly 10. In some embodiments, for example, the adjusting of the spacing between the first connection counterpart 504 and the second connection counterpart 508 to grip the wall panel assembly 10 is with effect that: 1) at least a portion of the retaining surface defining configuration 122 of the lower panel 100, and 2) at least a portion of the interacting portion 60 of the upper panel 100, are disposed in the channel 509 of the second connection counterpart 508. In this respect, in some embodiments, for example, the panel-defined connection counterpart 39 includes the retaining surface defining configuration 122 of the lower panel 100, and, in some embodiments, for example, the panel-defined connection counterpart 39 includes the interacting portion 60 of the upper panel 100. In some embodiments, for example, while the first connection counterpart 504 is disposed in the upper cavity 130, such that the retained configuration is established, the first connection counterpart 504, the guiding surface 136, and the retaining surface 134 of the upper panel 100 are co-operatively configured to resist forwardly or rearwardly displacement of the first connection counterpart 504, in a direction parallel to the front facing surface 104, while the spacing between the first connection counterpart 504 and the second connection counterpart 508 is being adjusted. In some embodiments, for example, while the second connection counterpart 508 is disposed in the lower cavity 130, and while the retaining surface defining configuration 122 of the lower panel is disposed in the channel 509, the second connection counterpart 508 and the retaining surface defining configuration 122 of the lower panel 100 co-operate to oppose forwardly or rearwardly displacement of the second connection counterpart 508, in a direction parallel to the front facing surface 104. In some embodiments, for example, while the second connection counterpart 508 is disposed in the lower cavity 130, and while the retaining surface defining configuration 122 of the lower panel is disposed in the channel 509, the second connection counterpart 508 and the retaining surface 134 of the lower panel 100 co-operate to oppose rotation of the bracket 502, relative to the wall panel assembly 10, in the direction away from the wall panel assembly 10. At this point, while the bracket 502 is gripping the wall panel assembly 10, the assembly 500 is transitioned from the adjustable configuration to the fixed configuration, for example, via actuation of the locking mechanism 520, to secure the assembly 500 to the wall panel assembly 10. In some embodiments, for example, while the assembly 500 is secured to the wall panel assembly 10, a load that is supported by the load supporter 530 is supported by the wall panel assembly 10 via the assembly 500 that is secured to the wall panel assembly 10. In some embodiments, for example, while the assembly 500 is secured to the wall panel assembly 10, rotation of the assembly 500, for example, the bracket 502, relative to the wall panel assembly 10, is resisted. In some embodiments, for example, by resisting rotation of the assembly 500, for example, the bracket 502 relative to the wall panel assembly 10, the securing of the assembly 500 to the wall panel assembly 10 secures the retention of the assembly 500 to the wall panel assembly 10, and resists disconnection, for example, accidental disconnection, of the assembly 500 from the wall panel assembly 10.

In some embodiments, for example, while the spacing between the first connection counterpart 504 and the second connection counterpart 508 are gripping the wall panel assembly 10, the assembly 500 is disposed in the intermediate configuration.

In some embodiments, for example, the hanging and securing of the assembly 500 to the wall panel assembly 10 or the panel 100 is effectible without the use of fasteners, for example, mechanical fasteners.

In some embodiments, for example, to release the assembly 500 from the wall panel assembly 10, the assembly 500 is transitioned from the fixed configuration to the adjustable configuration, for example, via actuation of the locking mechanism 520, and the spacing between the first connection counterpart 504 and the second connection counterpart 508 is adjusted, for example, increased, such that the assembly 500 is no longer gripping the wall panel assembly 10, and is rotatable relative to the wall panel assembly 10. At this point, the assembly 500 is released from retention from the wall panel assembly 10, for example, by rotating the bracket connector 504 via rotation of the bracket 502 away from the wall panel assembly 10, and displacing the assembly 500 from the upper cavity 130 of the wall panel assembly 10. In some embodiments, for example, while the assembly 500 is released from the wall panel assembly 10, the assembly 500 is repositionable to another part of the wall panel assembly 10 and connectible to the wall panel assembly 10 at said another part of the wall panel assembly 10, or is repositionable to another wall panel assembly 10 and connectible to said another wall panel assembly 10.

The assembly 500 can be hung, retained, and secured to a panel 100 that includes more than one cavity 130, and can be released from the panel 100, similar to the manner in which the mounting assembly 500 is hung, retained, secured, and released from the wall panel assembly 10.

Figure 46:
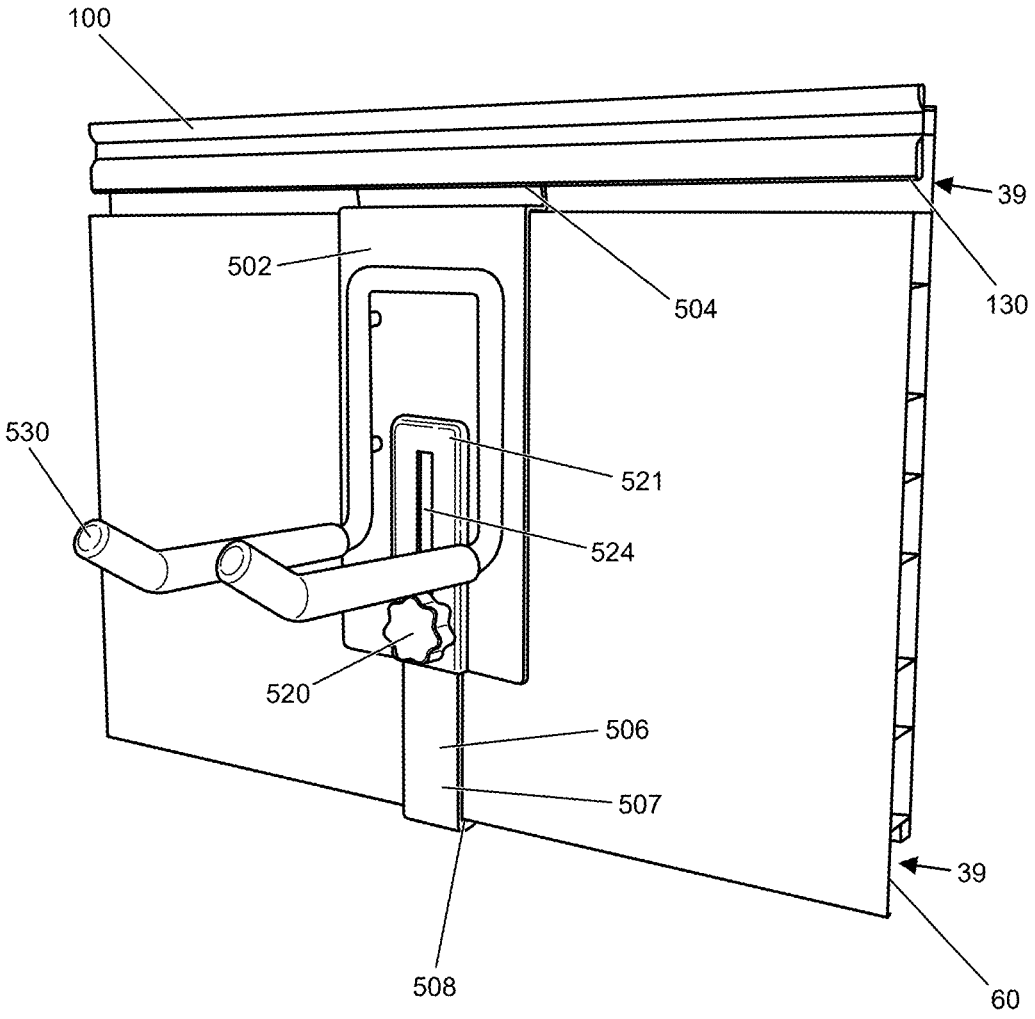
FIG. 46 is a front perspective view of the mounting assembly of FIG. 39, connected to a panel.
Figure 47:
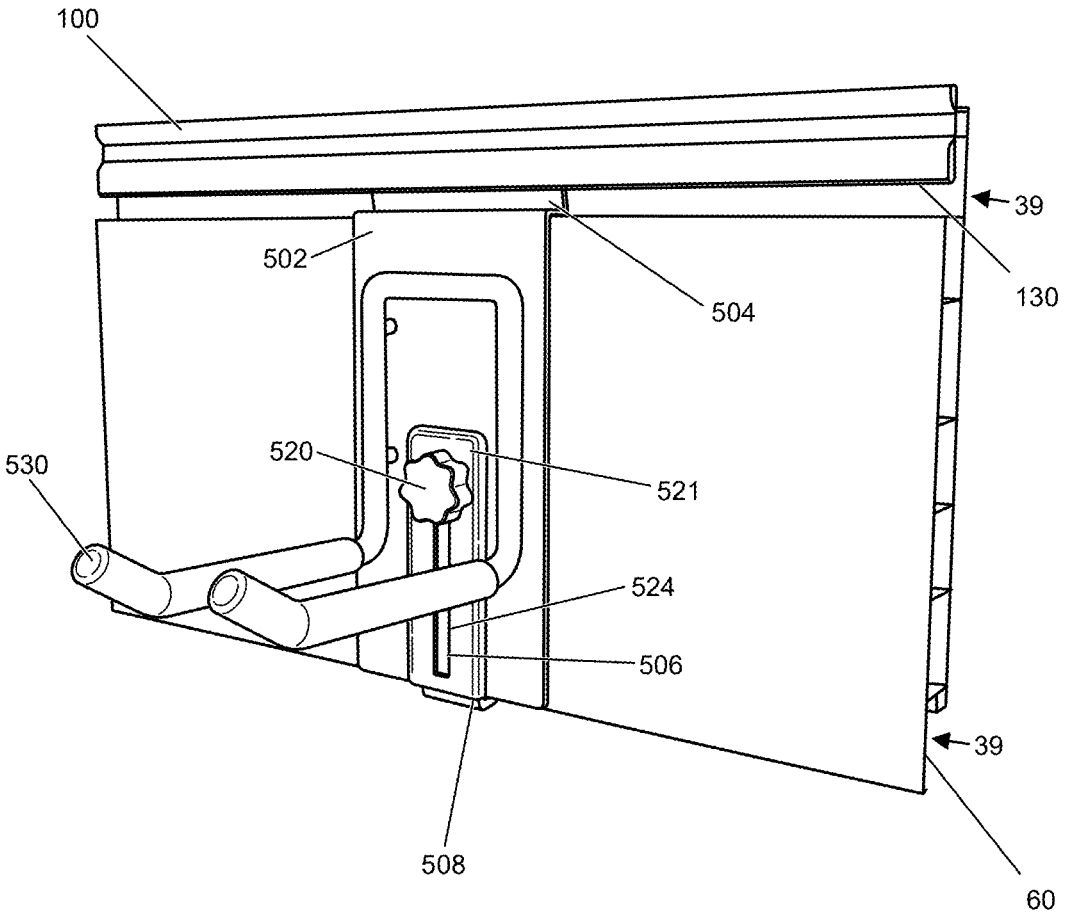
FIG. 47 is a front perspective view of the mounting assembly of FIG. 39, connected to another panel.

As depicted in FIG. 46 and FIG. 47, the assembly 500 can be hung, retained, and secured to a panel 100, and can be released from the panel 100, similar to the manner in which the assembly 500 is hung, retained, secured, and released from the wall panel assembly 10. In some embodiments, for example, the assembly 500 is connectible to a panel described herein, for example, the panels 100 to 100F. In such embodiments for example, the first connection counterpart 504 is connectible to the cavity 130 of the panel, and the second connection counterpart 508 is connectible to the interacting portion 60 of the panel 100. In this respect, the pair of panel-defined connection counterparts 39 includes the cavity 130 and the space disposed rearwardly of the interacting portion 60 of the panel 100. In some embodiments, for example, the assembly 500 is secured to the panel in a manner similar to securing the assembly 500 to the wall panel assembly 10, except, in some embodiments, for example, the adjusting of the spacing between the first connection counterpart 504 and the second connection counterpart 508 to grip the panel 100 is with effect that at least a portion of the interacting portion 60, for example, the second connection system counterpart 158 (e.g. the projection 158) of the second connection system 34, and at least a portion of the covering portion 154, are disposed in the channel 509 of the second connection counterpart 508.

Accordingly, the spacing distance between the first connection counterpart 504 and the second connection counterpart 508 is adjustable such that the assembly 500 is connectible and securable to the first wall surface configuration having the first pair of panel-defined connection counterparts 39 spaced apart by the first spacing distance, for example, as depicted in FIG. 46, and such that the assembly 500 is also connectible and securable to the second wall surface configuration having the second pair of panel-defined connection counterparts 39 spaced apart by the second spacing distance, for example, as depicted in FIG. 47. As depicted, the first spacing distance and the second spacing distance are different.

In some embodiments, for example, the material of the bracket 502 includes steel.

Figure 48:
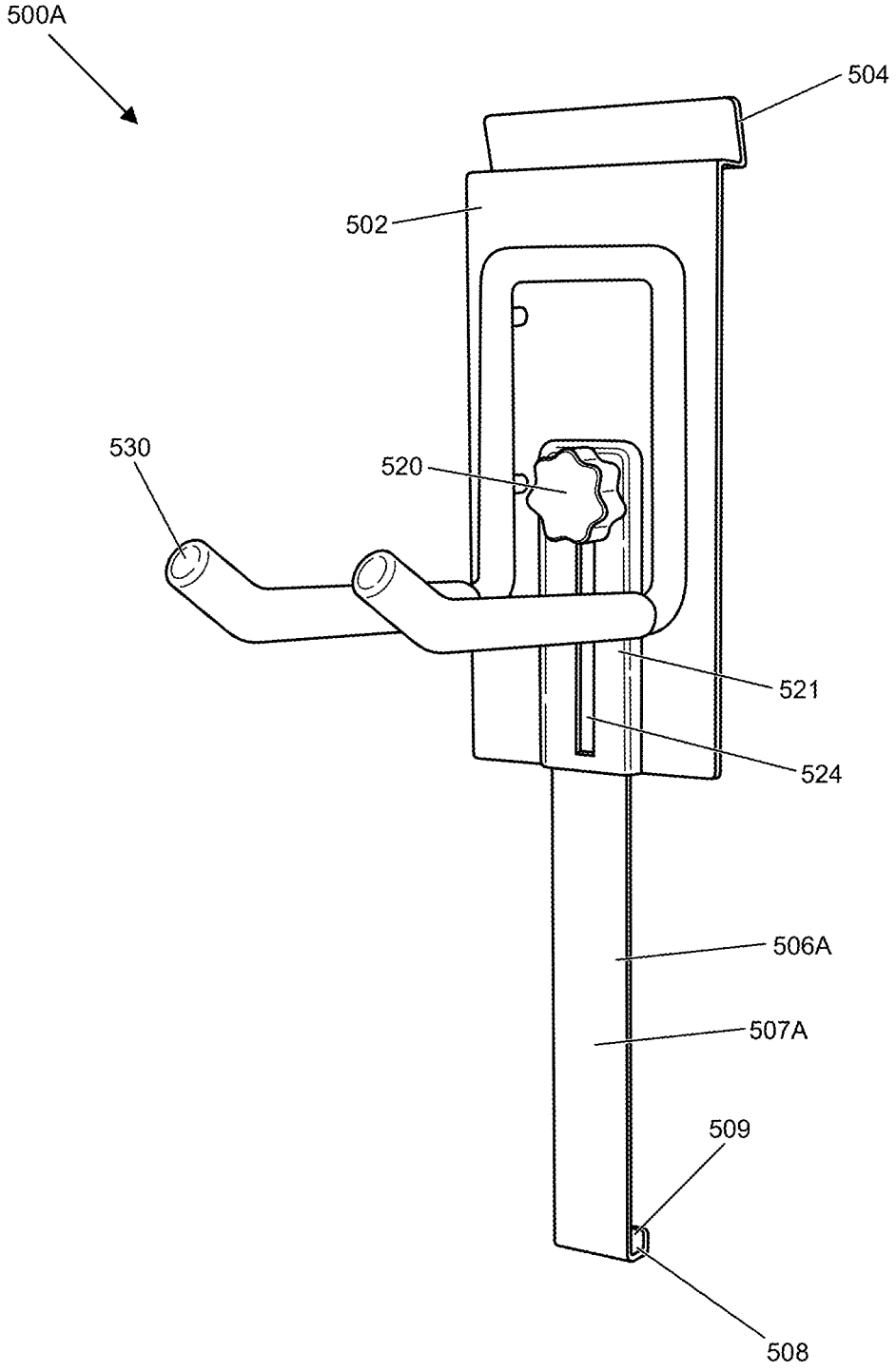
FIG. 48 is a front perspective view of an alternate embodiment of the mounting assembly of FIG. 39, with the mounting assembly disposed in a retracted configuration.
Figure 49:
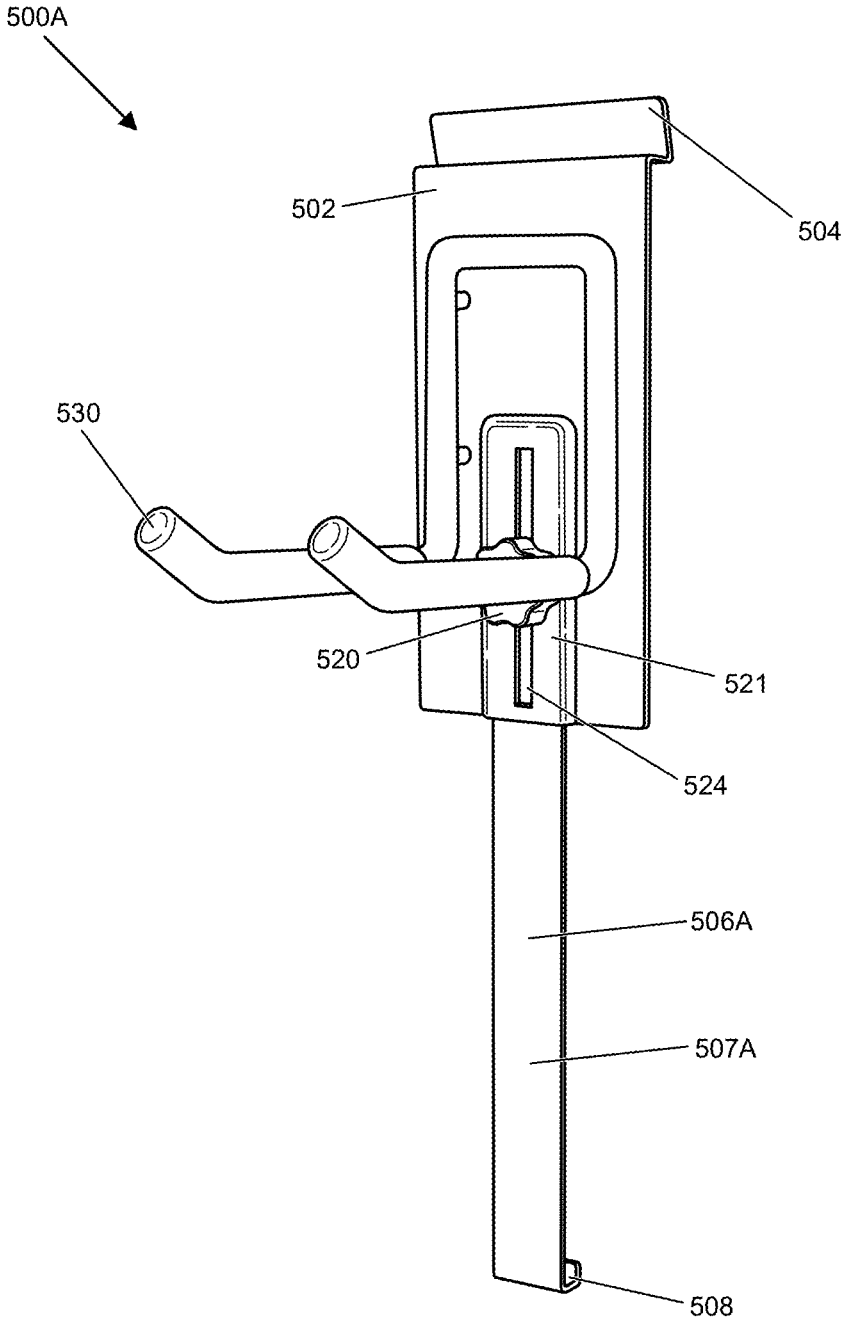
FIG. 49 is a front perspective view of the mounting assembly of FIG. 48, with the mounting assembly disposed in an intermediate configuration.
Figure 50:
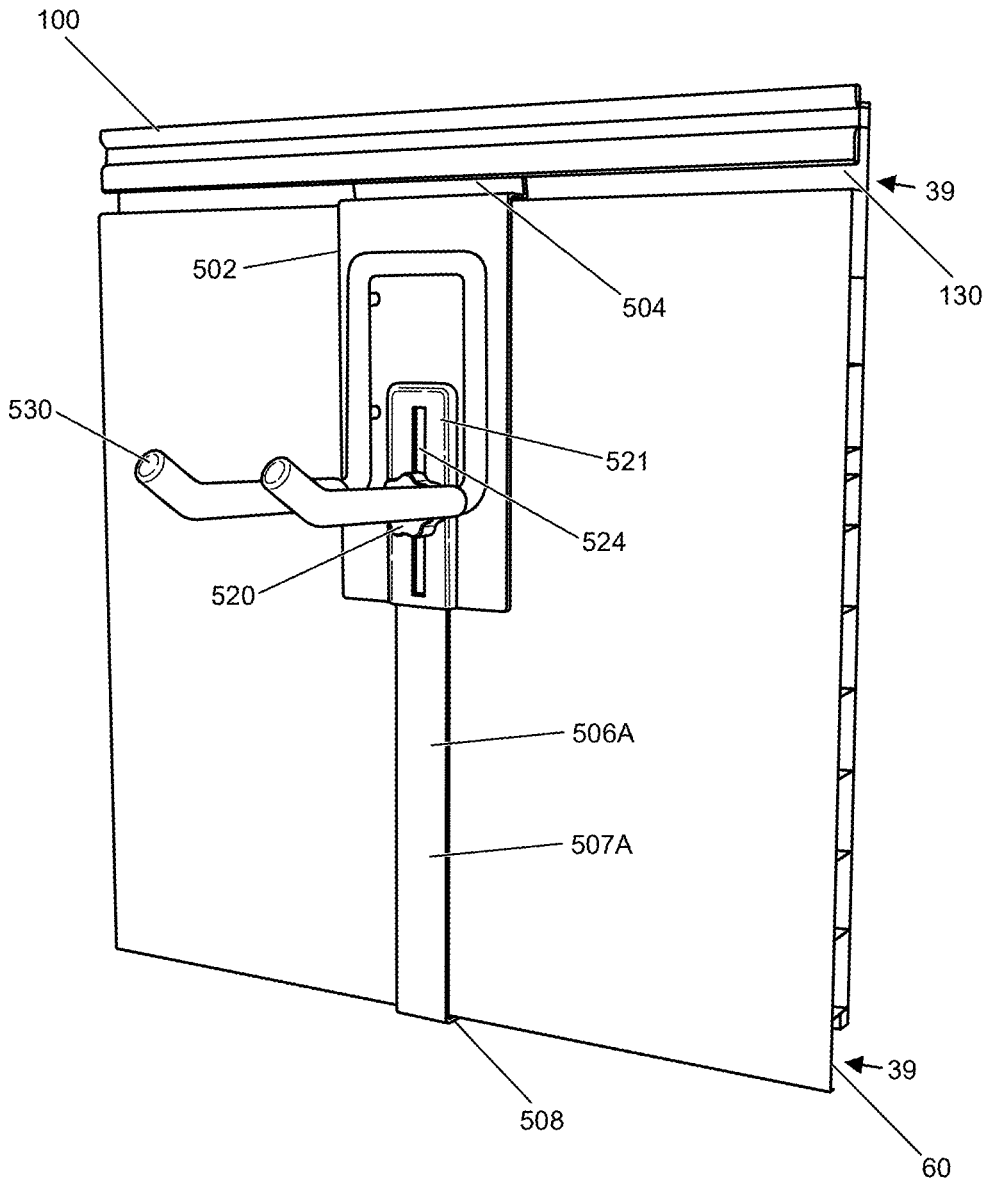
FIG. 50 is a front perspective view of the mounting assembly of FIG. 48, connected to a panel.

FIG. 48 to FIG. 50 depict a mounting assembly 500A that is an embodiment of the mounting assembly 500 as depicted in FIG. 39 to FIG. 47. The mounting assembly 500A substantially corresponds to the mounting assembly 500, except the intermediate member 507A of the connection counterpart-defining configuration 506A of the mounting assembly 500A is longer than the intermediate member 507 of the connection counterpart-defining configuration 506 of the mounting assembly 500, such that the mounting assembly 500A is connectible to a pair of panel-defined connection counterparts 39 that are spaced relatively far apart. In some embodiments, for example, the intermediate member 507A is shorter than the intermediate member 507. In some embodiments, for example, the length of the intermediate member 507A of the connection counterpart-defining configuration 506A is based on the spacing between the pairs of panel-defined connection counterparts 39 to which the mounting assembly 500A is to be connected.

The mounting assembly 500A can be connected to, and secured to, a wall panel assembly 10 or a panel 100, similar to the manner by which the connection and securing between the mounting assembly 500 to the wall panel assembly 10 or the panel 100, is established.

In some embodiments, for example, the mounting assembly 500A can be assembled from the mounting assembly 500. In such embodiments, for example, the connection counterpart-defining configuration 506 is disconnected from the bracket 502, by decoupling the rotatable head 520A of the locking mechanism 520 from the threaded stud that is connected to the connection counterpart-defining configuration 506 of the mounting assembly 500. At this point, the connection between the bracket 502 and the connection counterpart-defining configuration 506 is defeated, and the connection counterpart-defining configuration 506 is separated from the bracket 502. Then, the connection counterpart-defining configuration 506A is connected to the bracket 502. To connect the connection counterpart-defining configuration 506A to the bracket 502, the threaded stud is received through the slot 524 of the bracket, and the rotatable head 520A is connected to the threaded stud of the connection counterpart-defining configuration 506A. At this point, the bracket 502 and the connection counterpart-defining configuration 506A is releasably coupled, and the assembly 500A is defined Accordingly, the bracket 502 is releasably couplable to the connection counterpart-defining configuration 506, and also releasably couplable to the connection counterpart-defining configuration 506A, for defining the assembly 500 and the assembly 500A, respectively.

While the bracket 502 is releasably coupled to the connection counterpart-defining configuration 506A, the mounting assembly 500A is defined, wherein the mounting assembly 500A is configurable in a fixed configuration and an adjustable configuration, similar to the mounting assembly 500.

In the fixed configuration, the releasably coupling between the bracket 502 and the connection counterpart-defining configuration 506A is such that there is an absence of displaceability of the connection counterpart-defining configuration 508 of the connection counterpart-defining configuration 506A, relative to the bracket 502, such that there is an absence of adjustability of the spacing between the connection counterparts 504 and 508.

In the adjustable configuration, the releasably coupling between the bracket 502 and the connection counterpart-defining configuration 506A is such that the connection counterpart-defining configuration 506A is displaceable, relative to the bracket 502, such that spacing between the connection counterparts 504 and 508 is adjustable between at least a third spacing and a fourth spacing, wherein:

in the third spacing, the connection counterparts 504 and 508 are disposed for connection to a third wall surface configuration having a third pair of panel-defined connection counterparts 39 spaced apart by a third spacing distance;

in the fourth spacing, the connection counterparts 504 and 508 are disposed for connection to a fourth wall surface configuration having a fourth pair of panel-defined connection counterparts 39 spaced apart by a fourth spacing distance.

In some embodiments, for example, the third spacing distance of the third pair of panel-defined connection counterparts 39 is different from the fourth spacing distance of the fourth pair of panel-defined connection counterparts 39.

In some embodiments, for example, adjusting of the spacing from the third spacing to the fourth spacing is effected by displacement of the second connection counterpart 508 towards the first connection counterpart 504. In some embodiments, for example, adjusting of the spacing from the fourth spacing to the third spacing is effected by displacement of the second connection counterpart 508 away from the first connection counterpart 504.

In some embodiments, for example, adjusting of the spacing from the third spacing to the fourth spacing is effected by displacement of the second connection counterpart 508 away from the first connection counterpart 504. In some embodiments, for example, adjusting of the spacing from the fourth spacing to the third spacing is effected by displacement of the second connection counterpart 508 towards the first connection counterpart 504.

In some embodiments, for example, the first spacing distance of the first pair of panel-defined connection counterparts 39, to which the mounting assembly 500 is connectible, is different from the third spacing distance of the third pair of panel-defined connection counterparts 39, to which the mounting assembly 500A is connectible.

In some embodiments, for example, the second spacing distance of the second pair of panel-defined connection counterparts 39, to which the mounting assembly 500 is connectible, is different from the third spacing distance of the third pair of panel-defined connection counterparts 39, to which the mounting assembly 500A is connectible.

In some embodiments, for example, the first spacing distance of the first pair of panel-defined connection counterparts 39, to which the mounting assembly 500 is connectible, is different from the fourth spacing distance of the fourth pair of panel-defined connection counterparts 39, to which the mounting assembly 500A is connectible.

In some embodiments, for example, the second spacing distance of the second pair of panel-defined connection counterparts 39, to which the mounting assembly 500 is connectible, is different from the fourth spacing distance of the fourth pair of panel-defined connection counterparts 39, to which the mounting assembly 500A is connectible.

In some embodiments, for example, each one of the first wall surface configuration, the second wall surface configuration, the third wall surface configuration, and the fourth wall surface configuration is defined on the same wall panel assembly 10.

In some embodiments, for example, wherein each one of the first wall surface configuration, the second wall surface configuration, the third wall surface configuration, and the fourth wall surface configuration is defined on the same wall panel assembly 10, the first pair of panel-defined connection counterparts 39 is defined by a first panel-defined connection counterpart 39 and a second panel-defined connection counterpart 39, the second pair of panel-defined connection counterpart 39 is defined by a third panel-defined connection counterpart 39 and a fourth panel-defined connection counterpart 120, the third pair of panel-defined connection counterpart 39 is defined by a fifth panel-defined connection counterpart 39 and a sixth panel-defined connection counterpart 39, and the fourth pair of panel-defined connection counterpart 39 is defined by a seventh panel-defined connection counterpart 39 and a eighth panel-defined connection counterpart 120.

In some embodiments, for example, wherein each one of the first wall surface configuration, the second wall surface configuration, the third wall surface configuration, and the fourth wall surface configuration is defined on the same wall panel assembly 10, the first pair of panel-defined connection counterparts 39 is defined by a first panel-defined connection counterpart 39 and a second panel-defined connection counterpart 39, the second pair of panel-defined connection counterpart 39 is defined by the first panel-defined connection counterpart 39 and a third panel-defined connection counterpart 120, the third pair of panel-defined connection counterpart 39 is defined by the first panel-defined connection counterpart 39 and a fourth panel-defined connection counterpart 39, and the fourth pair of panel-defined connection counterpart 39 is defined by the first panel-defined connection counterpart 39 and a fifth panel-defined connection counterpart 120.

In some embodiments, for example, at least one of the first, second, third, and fourth wall configuration is defined on a first wall panel assembly 10, and at least one of the other of the first, second, third, and fourth wall configuration is defined on a second wall panel assembly 10.

In some embodiments, for example, the first wall surface configuration is defined on a first wall panel assembly 10, and each one of the second wall surface configuration, the third wall surface configuration, and the fourth wall surface configuration is on a second wall panel assembly 10.

In some embodiments, for example, each one of the first wall surface configuration, the second wall surface configuration, and the third wall surface configuration are defined on a first wall panel assembly 10, and the fourth wall surface configuration is on a second wall panel assembly 10.

In some embodiments, for example, each one of the first wall surface configuration and the second wall surface configuration is defined on a first wall panel assembly 10, and each one of the third wall surface configuration and the fourth wall surface configuration is on a second wall panel assembly 10.

In some embodiments, for example, the first wall surface configuration is defined on a first wall panel assembly 10, the second wall surface configuration is defined on a second wall panel assembly 10, and each one of the third wall surface configuration and the fourth wall surface configuration is on a third wall panel assembly 10.

In some embodiments, for example, each one of the first wall surface configuration and the third wall surface configuration is defined on a first wall panel assembly 10, and each one of the second wall surface configuration and the fourth wall surface configuration is on a second wall panel assembly 10.

In some embodiments, for example, the first wall surface configuration is defined on a first wall panel assembly 10, the second wall surface configuration is defined on a second wall panel assembly 10, the third wall surface configuration is defined on a third wall panel assembly 10, and the fourth wall surface configuration is defined on a fourth wall panel assembly 10.

In some embodiments, for example, the first wall surface configuration is defined on a first wall panel assembly 10, the second wall surface configuration and the third wall surface configuration are defined on a second wall panel assembly 10, and the fourth wall surface configuration is defined on a third wall panel assembly 10.

In some embodiments, for example, wherein at least two of the first, second, third, and fourth wall surface configurations are defined on the same panel, two of the at least two of the first, second, third, and fourth wall surface configurations share a common panel-defined connection counterpart 39. In some embodiments, for example, wherein the third wall surface configuration and the fourth wall surface configuration are defined on the same wall panel assembly 10, the third pair of panel-defined connection counterparts 39 is defined by a first panel-defined connection counterpart 39 and a second panel-defined connection counterpart 39, and the fourth pair of panel-defined connection counterpart 39 is defined by the first panel-defined connection counterpart 39 and a third panel-defined connection counterpart 39. In some embodiments, for example, wherein the third wall surface configuration and the fourth wall surface configuration are defined on the same wall panel assembly 10, the third pair of panel-defined connection counterparts 39 is defined by a first panel-defined connection counterpart 39 and a second panel-defined connection counterpart 39, and the fourth pair of panel-defined connection counterpart 39 is defined by the second panel-defined connection counterpart 39 and a third panel-defined connection counterpart 39.

Accordingly, if it is desirable to connect and secure the mounting assembly 500 to a wall surface configuration having a first pair of panel-defined connection counterparts 39 spaced apart by a first spacing distance, and also having a second pair of panel-defined connection counterparts 39 spaced apart by a second spacing distance but the spacing between the first connection counterpart 504 and the second connection counterpart 508 is not adjustable to correspond to the first and second spacing distances between the first and second pairs of panel-defined connection counterparts 39, the connection counterpart-defining configuration 506 can be decoupled from the bracket 502, and the connection counterpart-defining configuration 506A can be coupled to the bracket 502, to define the assembly 500A, such that the spacing between the connection counterparts 504 and 508 can be adjusted to correspond to the spacing distances between the first and second pair of panel-defined connection counterparts 39, for connecting and securing the assembly 500A to the first and pairs of panel-defined connection counterparts 39. In this respect, the same bracket 502 and locking mechanism 520 (e.g. rotatable head 520A and threaded stud) are used, and different embodiments of the connection counterpart-defining configuration 506, having different lengths of the intermediate member 507, can be connected to the bracket 502 via the locking mechanism 520 to connect to the desired pair of panel-defined connection counterparts 39.

FIG. 51 to FIG. 54 depict a mounting assembly 500B that is an alternate embodiment of the mounting assembly 500 and mounting assembly 500A. The mounting assembly 500B substantially corresponds to the mounting assembly 500 and mounting assembly 500A, except: 1) the bracket 502A of the mounting assembly 500B includes a slot 524A that is longer than the slot 524 of the mounting assembly 500 and mounting assembly 500A, and 2) the intermediate member 507B of the connection counterpart-defining configuration 506B is shorter than the intermediate member 507 of the connection counterpart-defining configuration 506 of the mounting assembly 500, and also shorter than the intermediate member 507A of the connection counterpart-defining configuration 506A of the mounting assembly 500A.

As depicted, the slot 524A is longer than the slot 524 of the mounting assembly 500 and mounting assembly 500A. The slot 524A extends from the bottom of the flange 503A to substantially the top of the flange 503A. In some embodiments, for example, the length of the slot 524A is generally the length of the flange 503A.

As depicted, the intermediate member 507B of the connection counterpart-defining configuration 506B is relatively short. In some embodiments, for example, the length of the intermediate member is 0.75 inches.

Figure 51:
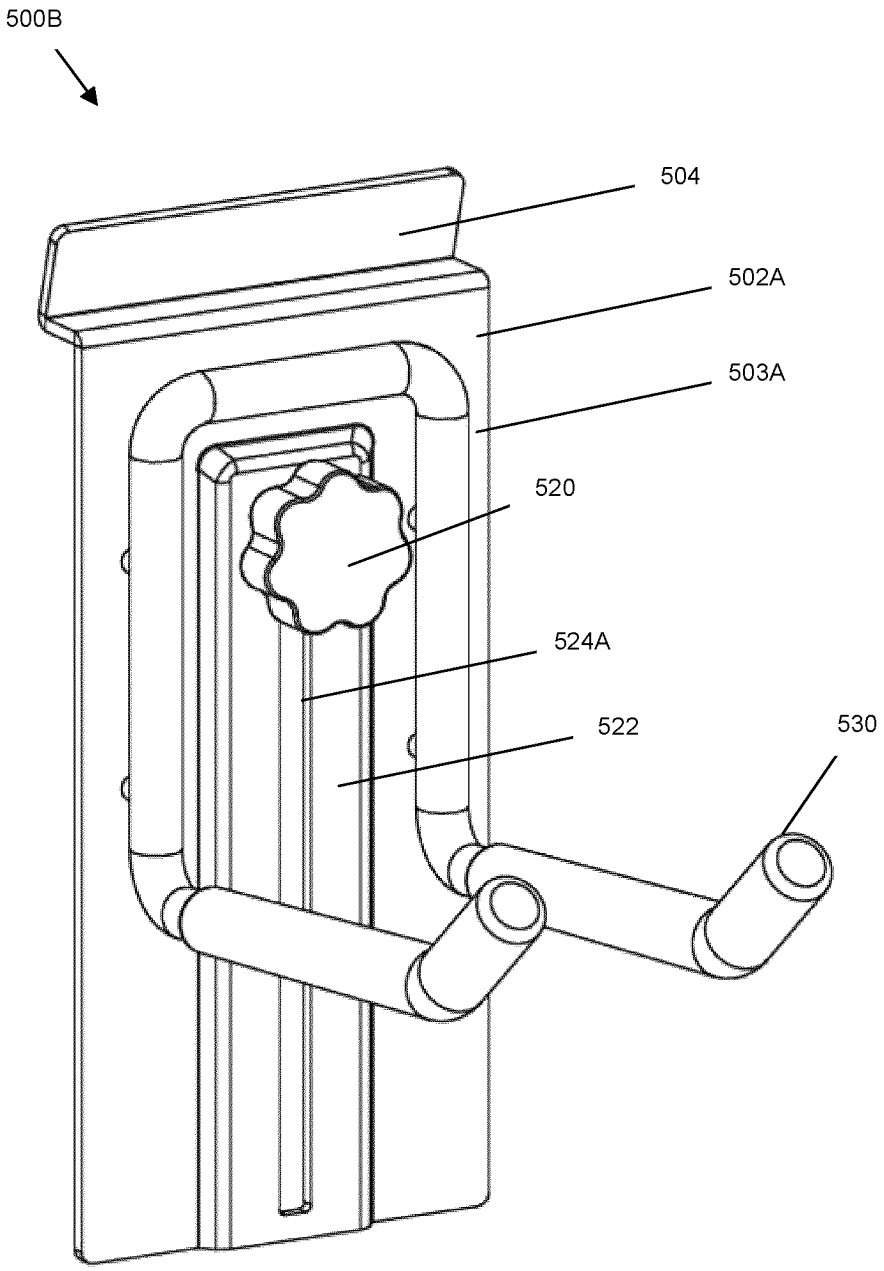
FIG. 51 is a front perspective view of an alternate embodiment of the mounting assembly of FIG. 39, with the mounting assembly disposed in a retracted configuration.
Figure 52:
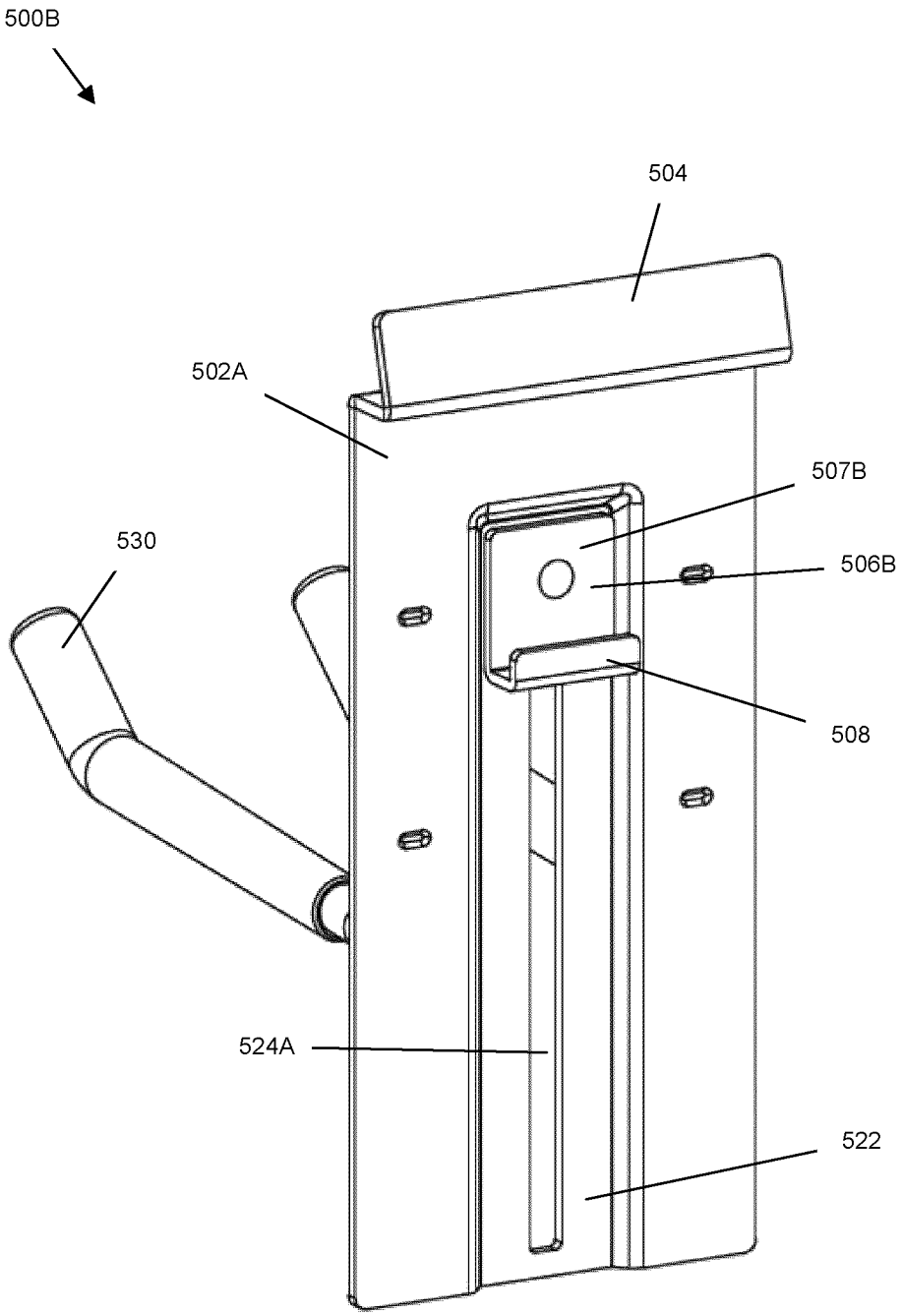
FIG. 52 is a rear perspective view of the mounting assembly of FIG. 51.

The increase in length of the slot 524A, and the decrease in length of the intermediate member 507B, is with effect that the minimum spacing distance between the first connection counterpart 504 and the second connection counterpart 508, of the mounting assembly 500B, is reduced, relative to the minimum spacing distance between the first connection counterpart 504 and the second connection counterpart 508, of the mounting assembly 500, and also of the mounting assembly 500A. In some embodiments, for example, the minimum spacing distance between the first connection counterpart 504 and the second connection counterpart 508 is defined while the assembly 500B is disposed in the retracted configuration, as depicted in FIG. 51 and FIG. 52. In some embodiments, for example, the minimum spacing distance between the first connection counterpart 504 and the second connection counterpart 508 has a minimum value of 1 inch.

Figure 53:
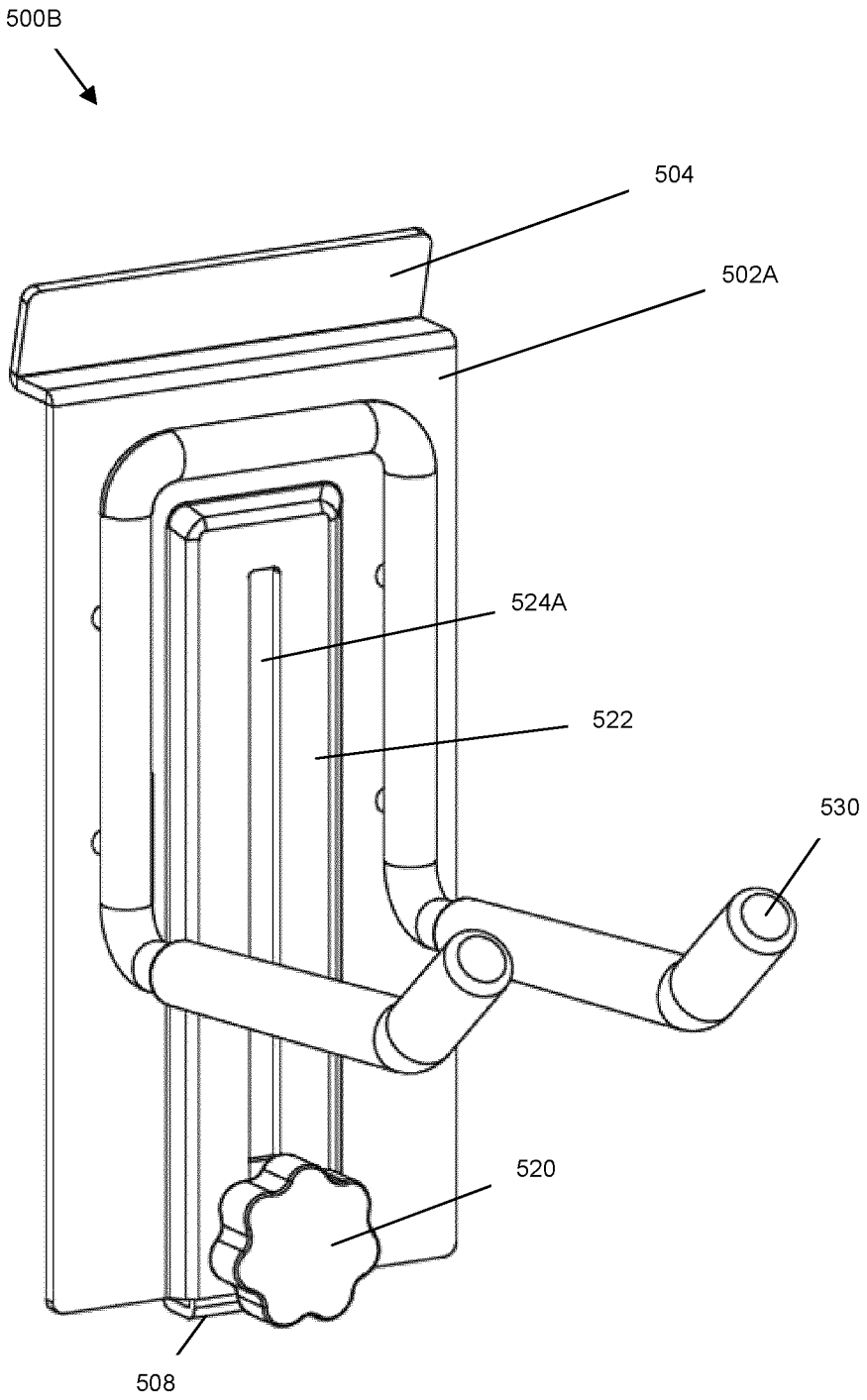
FIG. 53 is a front perspective view of the mounting assembly of FIG. 51, with the mounting assembly disposed in an extended configuration.
Figure 54:
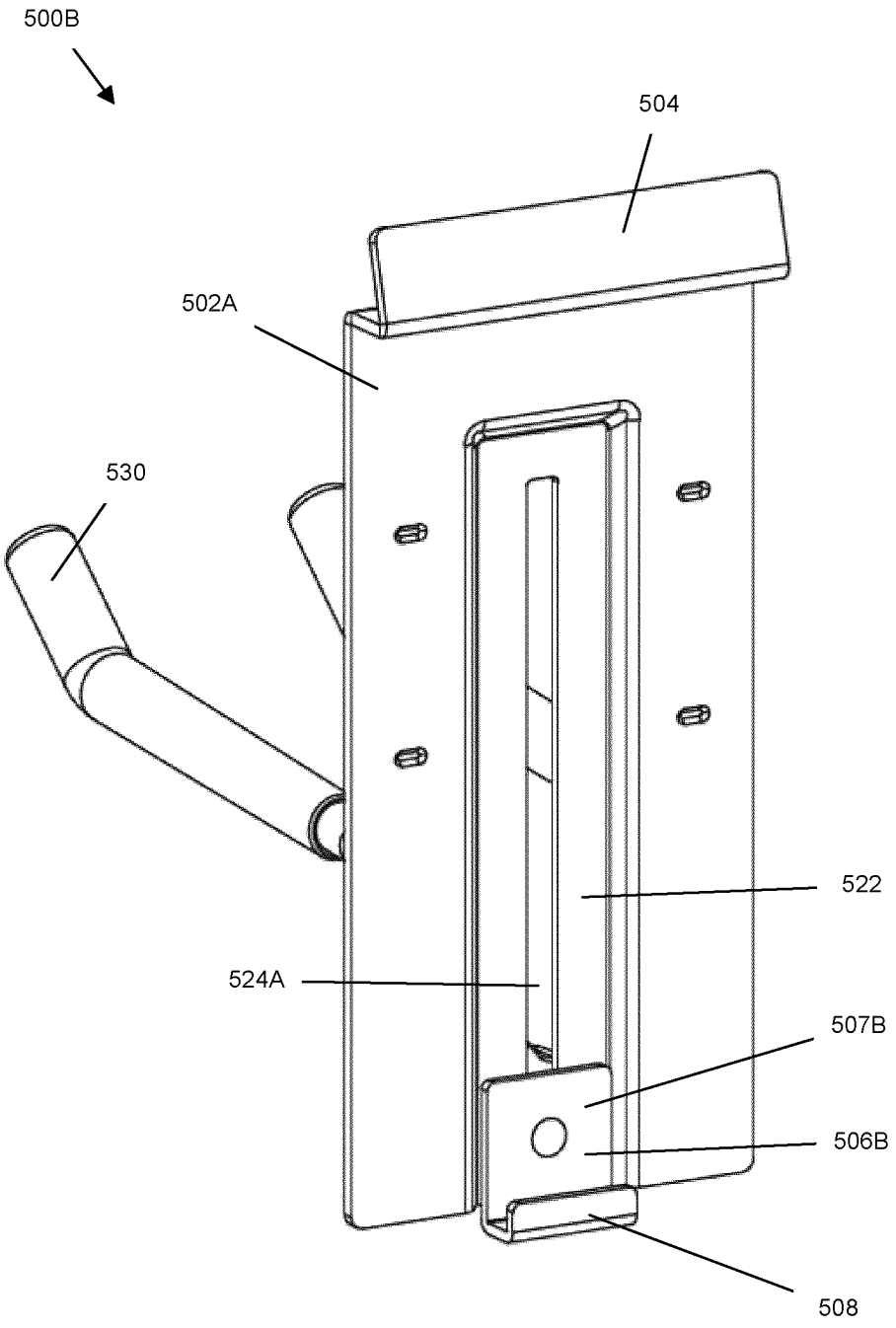
FIG. 54 is a rear perspective view of the mounting assembly of FIG. 53.

The decrease in length of the intermediate member 507B, is with effect that the maximum spacing distance between the first connection counterpart 504 and the second connection counterpart 508, of the mounting assembly 500B, is reduced, relative to the maximum spacing distance between the first connection counterpart 504 and the second connection counterpart 508, of the mounting assembly 500, and also of the mounting assembly 500A. In some embodiments, for example, the maximum spacing distance between the first connection counterpart 504 and the second connection counterpart 508 is defined while the assembly 500B is disposed in the extended configuration, as depicted in FIG. 53 and FIG. 54. In some embodiments, for example, the maximum spacing distance between the first connection counterpart 504 and the second connection counterpart 508 has a maximum value of 6 inch inches.

FIG. 55 to FIG. 58 depict a mounting assembly 5000 that is an alternate embodiment of the mounting assembly 500B. The mounting assembly 500B substantially corresponds to the mounting assembly 500B, except the intermediate member 507C of the connection counterpart-defining configuration 506C is longer than the intermediate member 507B of the connection counterpart-defining configuration 506B of the mounting assembly 500B.

As depicted, the intermediate member 507C of the connection counterpart-defining configuration 506C is relatively long. In some embodiments, for example, the length of the intermediate member is 7 inches.

Figure 55:
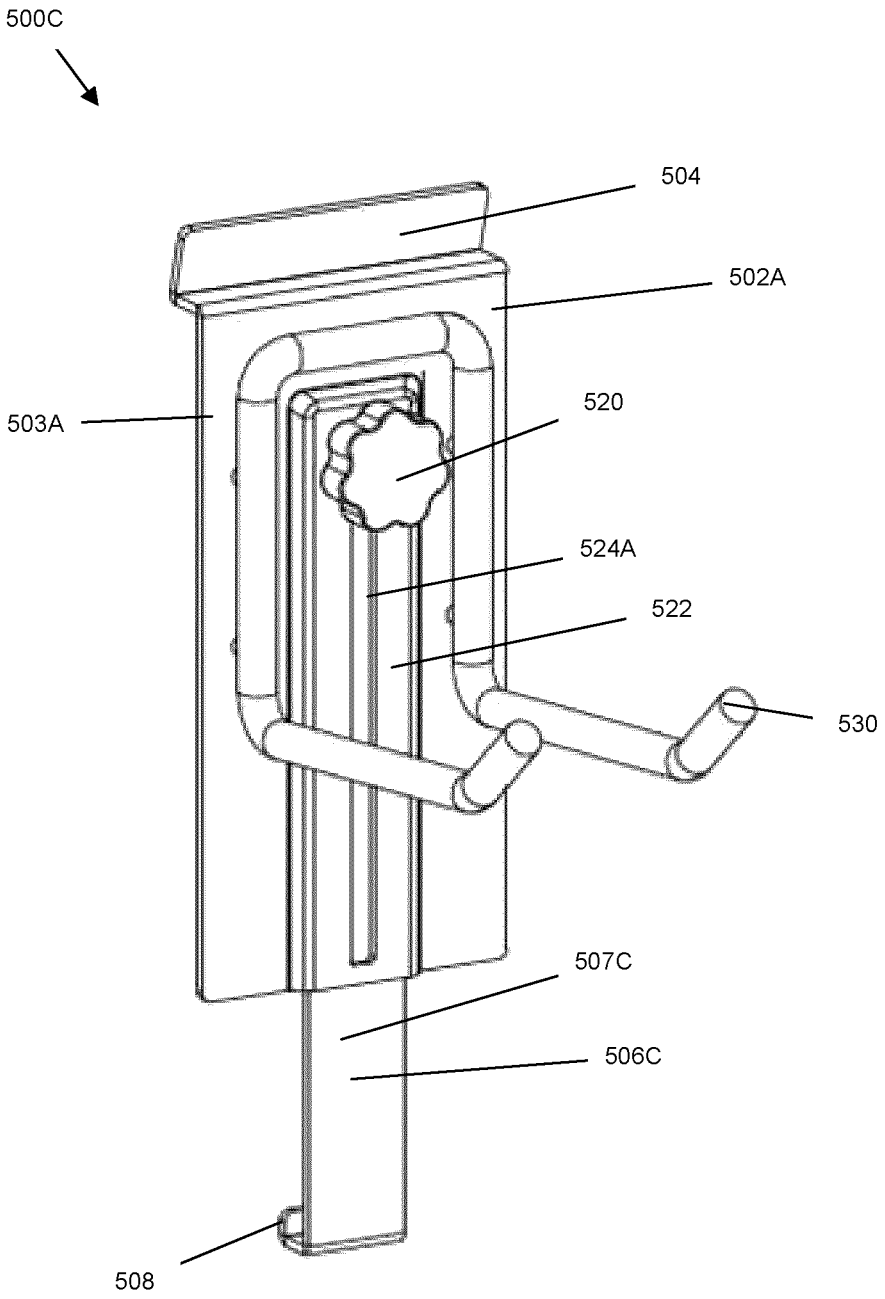
FIG. 55 is a front perspective view of an alternate embodiment of the mounting assembly of FIG. 51, with the mounting assembly disposed in a retracted configuration.
Figure 56:
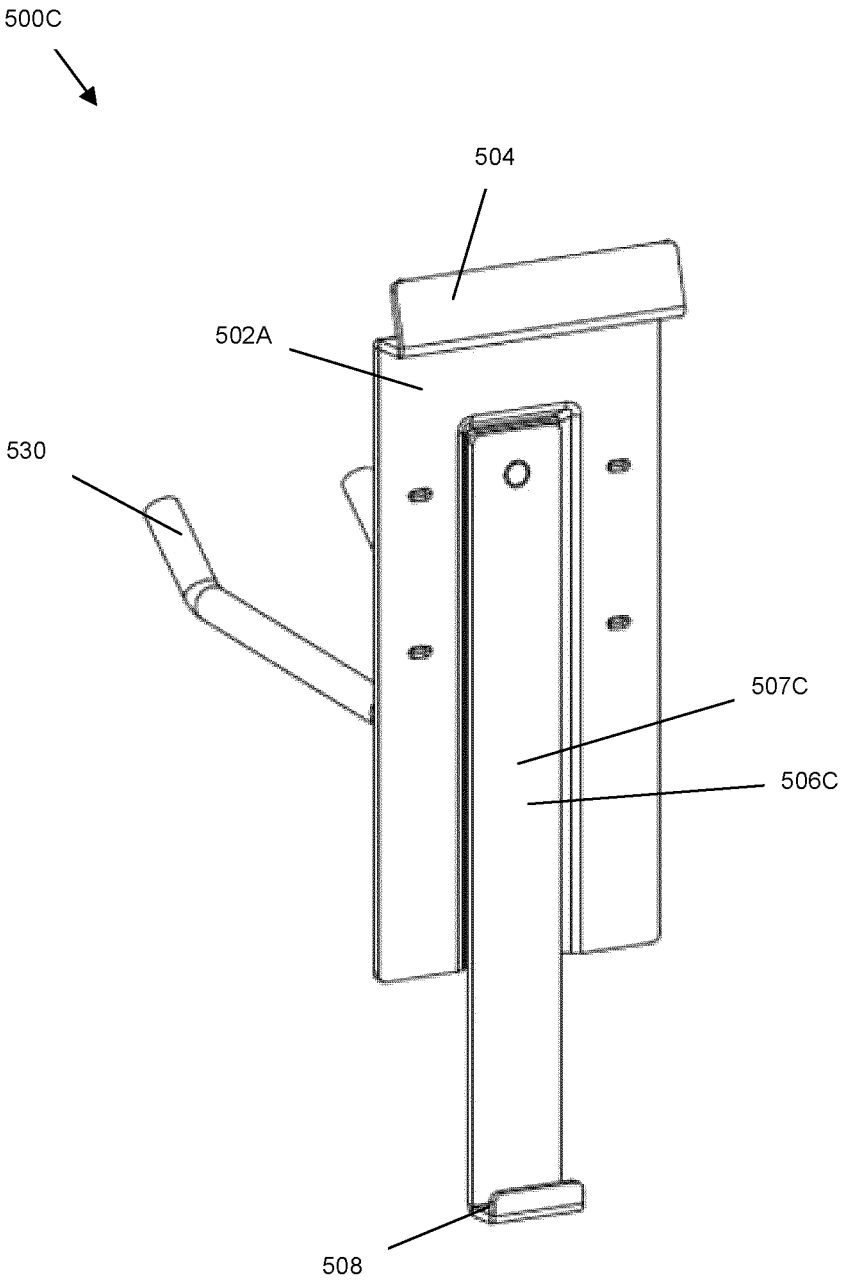
FIG. 56 is a rear perspective view of the mounting assembly of FIG. 55.

The increase in length of the intermediate member 507C, is with effect that the minimum spacing distance between the first connection counterpart 504 and the second connection counterpart 508, of the mounting assembly 5000, is increased, relative to the maximum spacing distance between the first connection counterpart 504 and the second connection counterpart 508, of the mounting assembly 500B. In some embodiments, for example, the minimum spacing distance between the first connection counterpart 504 and the second connection counterpart 508 is defined while the assembly 5000 is disposed in the retracted configuration, as depicted in FIG. 55 and FIG. 56. In some embodiments, for example, the minimum spacing distance between the first connection counterpart 504 and the second connection counterpart 508 has a minimum value of 8 inch inches.

Figure 57:
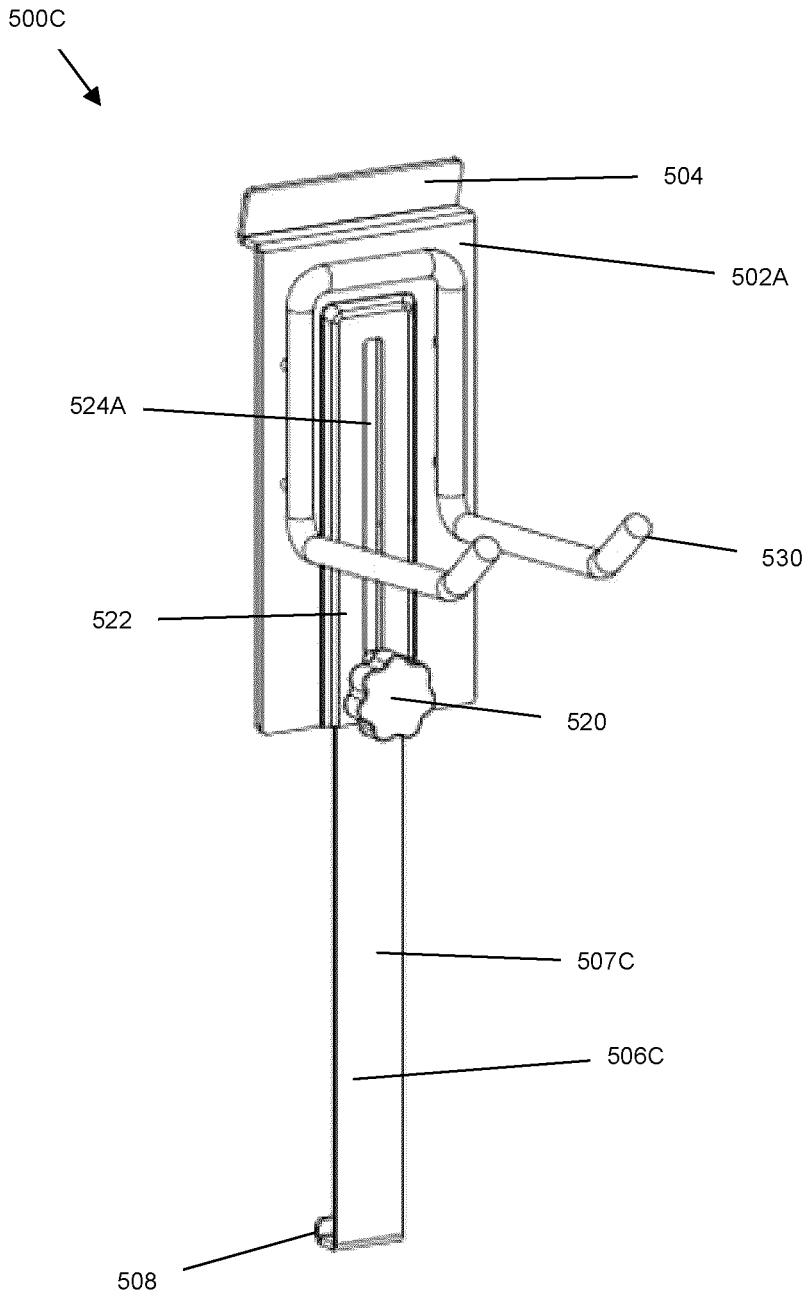
FIG. 57 is a front perspective view of the mounting assembly of FIG. 55, with the mounting assembly disposed in an extended configuration.
Figure 58:
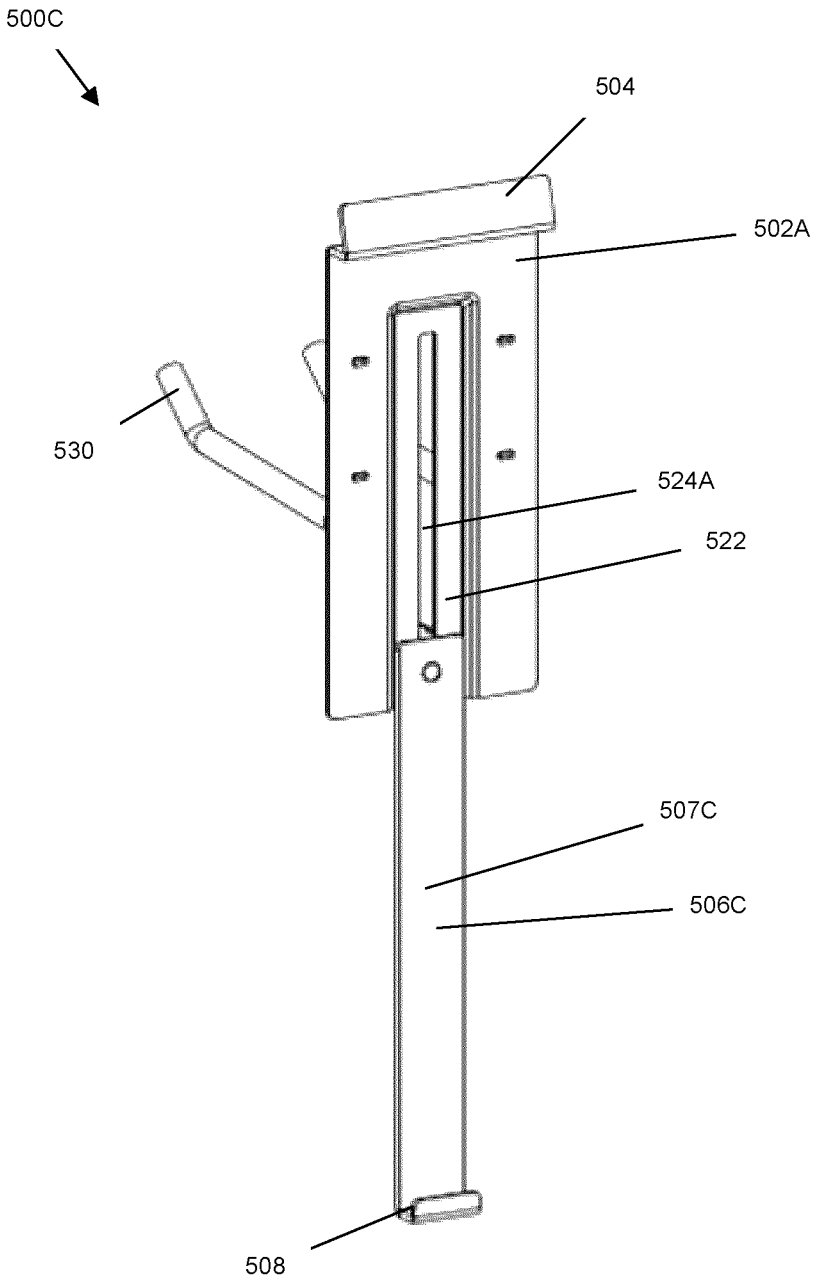
FIG. 58 is a rear perspective view of the mounting assembly of FIG. 57.

The increase in length of the intermediate member 507C, is with effect that the maximum spacing distance between the first connection counterpart 504 and the second connection counterpart 508, of the mounting assembly 5000, is increased, relative to the maximum spacing distance between the first connection counterpart 504 and the second connection counterpart 508, of the mounting assembly 500B. In some embodiments, for example, the maximum spacing distance between the first connection counterpart 504 and the second connection counterpart 508 is defined while the assembly 5000 is disposed in the extended configuration, as depicted in FIG. 57 and FIG. 58. In some embodiments, for example, the maximum spacing distance between the first connection counterpart 504 and the second connection counterpart 508 has a maximum value of 12 inch inches.

In some embodiments, for example, the mounting assembly 5000 can be assembled from the mounting assembly 500B by decoupling the connection counterpart-defining configuration 506B from the bracket 502A, and coupling the connection counterpart-defining configuration 506C to the bracket 502A, similar to the manner by which the mounting assembly 500A can be assembled from the mounting assembly 500.

In some embodiments, for example, a kit for a mounting assembly configured to be connected to a first wall surface configuration having a first pair of panel-defined connection counterparts 39 spaced apart by a first spacing distance, and further configured to be connected to a second wall surface configuration having a second pair of panel-defined connection counterparts 39 spaced apart by a second spacing distance includes a bracket described herein, for example, the bracket 502 or the bracket 502A, and further includes one of the connection counterpart-defining configurations described herein, for example, one of the connection counterpart-defining configuration 506, the connection counterpart-defining configuration 506A, connection counterpart-defining configuration 506B, and connection counterpart-defining configuration 506C.

In some embodiments, for example, a kit for a mounting assembly configured to be connected to: 1) a first wall surface configuration having a first pair of panel-defined connection counterparts spaced apart by a first spacing distance, 2) a second wall surface configuration having a second pair of panel-defined connection counterparts spaced apart by a second spacing distance, 3) a third wall surface configuration having a third pair of panel-defined connection counterparts spaced apart by a third spacing distance, and 4) a fourth wall surface configuration having a fourth pair of panel-defined connection counterparts spaced apart by a fourth spacing distance, includes a bracket described herein, for example, the bracket 502 or the bracket 502A, and further includes two or more of the connection counterpart-defining configurations described herein, for example, two or more of the connection counterpart-defining configuration 506, the connection counterpart-defining configuration 506A, connection counterpart-defining configuration 506B, and connection counterpart-defining configuration 506C.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations could be made herein.

Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

As can be understood, the examples described above and illustrated are intended to be examples only. The invention is defined by the appended claims.

What is claimed is:

1. A kit for a slatwall assembly, the kit comprising at least two panels mountable to a wall when in use, each panel having:

a front-facing surface and a rear-facing surface opposite the front-facing surface, wherein the rear-facing surface opposes the wall when the panel is mounted to the wall;

an upper connection structure including a projection extending upward from an upper end of a central panel portion when oriented in use, wherein the projection is connected to the central panel portion about a first joint and a second joint spaced rearward of the first joint, the projection including a front web extending from a front web proximal end at the first joint to a front web distal end spaced above and forward of the front web proximal end, a rear web extending upward from a rear web proximal end at the second joint to a rear web distal end spaced vertically above the rear web proximal end, and a linking web extending between and joined to the front and rear web distal ends, wherein a recess is formed behind the rear web;

a wall member extending between the first joint and the second joint; and a lower connection structure including an abutment member extending downward from a lower end of t central panel portion when oriented in use;

wherein each panel is configured for interlocking engagement with a vertically adjacent one of the at least two panels when mounted to said wall;

wherein a first panel of the at least two panels and a second panel of the at least two panels are connected by snap-fit engagement between the upper connection structure of the first panel and the lower connection structure of the second panel;

wherein the second panel is alignable against the wall above the first panel and displaceable vertically towards the first panel such that the abutment member of the second panel is positionable into the recess behind the projection of the first panel;

wherein forward displacement of the abutment member of the second panel away from the wall is resisted by the projection of the first panel; and wherein each panel further comprises a fastener-receiving portion configured to receive a fastener to mount the panel to the wall, and the projection is connected to the fastener-receiving portion about the first joint and the second joint.

2. The kit of claim 1, wherein a distance between the first joint and the second joint is at least 0.03 inches.

3. The kit of claim 1, wherein the forward displacement of the abutment member of the second panel is resisted by the rear web of the projection of the first panel, and forward pivoting of the rear web about the second joint is resisted by connection of the rear web distal end to the front web distal end and the spacing between the first and second joints.

4. The kit of claim 1, wherein:

the front-facing surface of the first panel defines an outermost surface that is visible when mounted to the wall;

the front-facing surface of the second panel defines an outermost surface that is visible when mounted to the wall; and the front-facing surfaces of the first and second panels are co-planar when mounted to the wall.

5. The kit of claim 1, wherein:

the lower connection structure of each panel includes a resiliently deflectable flange extending downward from the lower end the central panel portion when oriented in use, and a lower end of the flange includes a rearwardly extending tab; and the upper connection structure of each panel includes a notch spaced downwardly from the projection when oriented in use; and the snap-fit engagement between the first and second panels includes the notch of the upper connection structure of the first panel receiving the rearwardly extending tab of the lower connection structure of the second panel.

6. The kit of claim 1, wherein each panel further comprises a cavity for receiving a connector of a mounting bracket to secure the mounting bracket to the panel.

7. The kit of claim 1, wherein each panel is made from a plastic material.

8. The kit of claim 1, wherein each panel is manufactured by extrusion.

9. A panel mountable to a wall when in use, the panel comprising:

a front-facing surface and a rear-facing surface opposite the front-facing surface, wherein the rear-facing surface opposes the wall when the panel is mounted to the wall;

an upper connection structure including a projection extending upward from an upper end of a central panel portion when oriented in use, wherein the projection is connected to the central panel portion about a first joint and a second joint spaced rearward of the first joint, the projection including a front web extending from a front web proximal end at the first joint to a front web distal end spaced above and forward of the front web proximal end, a rear web extending upward from a rear web proximal end at the second joint to a rear web distal end spaced vertically above the rear web proximal end, and a linking web extending between and joined to the front and rear web distal ends;

a wall member extending between the first joint and the second joint; and a lower connection structure including a resiliently deflectable flange extending downward from a lower end of the central panel portion when oriented in use;

wherein the lower connection structure of the panel is configured for interlocking snap-fit engagement with the upper connection structure of another one of said panel that is mounted to the wall below;

wherein forward pivoting of the rear web about the second joint is resisted by connection of the rear web distal end to the front web distal end and the spacing between the first and second joints; and wherein the panel further comprises a fastener-receiving portion configured to receive a fastener to mount the panel to the wall, and the projection is connected to the fastener-receiving portion about the first joint and the second joint.

10. The panel of claim 9, wherein a distance between the first joint and the second joint is at least 0.03 inches.

11. The panel of claim 9, wherein the front-facing surface of the panel defines an outermost surface that is visible when mounted to the wall.

12. The panel of claim 9, wherein the resiliently deflectable flange has a lower end that includes a rearwardly extending tab.

13. The panel of claim 12, wherein the upper connection structure includes a notch spaced downwardly from the projection when oriented in use.

14. The panel of claim 9, wherein the lower connection structure includes an abutment member extending downward from the lower end of the central panel portion when oriented in use.

15. The panel of claim 9, wherein the panel further comprises a cavity for receiving a connector of a mounting bracket to secure the mounting bracket to the panel.

16. The panel of claim 9, wherein the panel is made from a plastic material.

17. The panel of claim 9, wherein the panel is manufactured by extrusion.

* * * * *